US008157342B2

(12) United States Patent
Morino et al.

(10) Patent No.: US 8,157,342 B2
(45) Date of Patent: Apr. 17, 2012

(54) LIQUID-JET DEVICE, IMAGE FORMING APPARATUS, AND METHOD FOR ADJUSTING LANDING POSITIONS OF LIQUID DROPLETS

(75) Inventors: Tetsu Morino, Kanagawa (JP); Noboru Sawayama, Kanagawa (JP); Kenichi Kawabata, Kanagawa (JP); Mamoru Yorimoto, Tokyo (JP); Tetsuro Hirota, Kanagawa (JP); Takumi Hagiwara, Aichi (JP); Masatoshi Sakakitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1047 days.

(21) Appl. No.: 12/047,973

(22) Filed: Mar. 13, 2008

(65) Prior Publication Data

US 2008/0225068 A1 Sep. 18, 2008

(30) Foreign Application Priority Data

Mar. 17, 2007 (JP) ..... 2007-069688

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS

| | | | | |
|---|---|---|---|---|
| 4,644,372 | A | 2/1987 | Hirota | |
| 4,661,822 | A | 4/1987 | Hirota et al. | |
| 5,754,202 | A | 5/1998 | Sekiya et al. | |
| 5,818,482 | A | 10/1998 | Ohta et al. | |
| 5,821,953 | A | 10/1998 | Nakano et al. | |
| 6,053,597 | A | 4/2000 | Hirota | |
| 6,331,052 | B1 | 12/2001 | Murai et al. | |
| 2004/0131402 | A1 * | 7/2004 | Kurotori et al. | 399/340 |
| 2005/0052488 | A1 * | 3/2005 | Inoue | 347/19 |
| 2005/0194730 | A1 | 9/2005 | Nishida et al. | |
| 2006/0050104 | A1 | 3/2006 | Sakakitani | |
| 2006/0181569 | A1 | 8/2006 | Kawashima et al. | |
| 2006/0215008 | A1 | 9/2006 | Kibayashi | |
| 2007/0064032 | A1 | 3/2007 | Kawabata | |
| 2007/0120936 | A1 | 5/2007 | Kawabata | |

FOREIGN PATENT DOCUMENTS

| | | |
|---|---|---|
| JP | 4-39041 | 2/1992 |
| JP | 5-249787 | 9/1993 |
| JP | 2004-1310 | 1/2004 |

(Continued)

OTHER PUBLICATIONS

Jun. 9, 2009 European search report in connection with a counterpart European patent application No. 08 25 0882.

(Continued)

*Primary Examiner* — Uyen Chau N Le
*Assistant Examiner* — Hoang Tran
(74) *Attorney, Agent, or Firm* — Cooper & Dunham LLP

(57) ABSTRACT

A disclosed liquid-jet device includes a liquid-jet head configured to jet liquid droplets; a pattern formation control unit configured to control the liquid-jet head and thereby to form a test pattern composed of separate liquid droplets on a water-repellent part; a detecting unit including a light-emitting element configured to illuminate the test pattern on the water-repellent part and a light-receiving element configured to receive specularly reflected light from the illuminated test pattern and to output a detection signal proportional to the received specularly reflected light; and a landing position adjusting unit configured to adjust landing positions of the liquid droplets based on the detection signal from the light-receiving element.

19 Claims, 43 Drawing Sheets

FOREIGN PATENT DOCUMENTS

| | | |
|---|---|---|
| JP | 2004-106415 | 4/2004 |
| JP | 2004-136582 | 5/2004 |
| JP | 2005-178246 | 7/2005 |
| JP | 2005-342899 | 12/2005 |
| JP | 2006-178396 | 7/2006 |
| JP | 3838251 | 8/2006 |
| JP | 2006-247904 | 9/2006 |
| JP | 2007-30458 | 2/2007 |

OTHER PUBLICATIONS

Aug. 13, 2009 European search report in connection with a counterpart European patent application No. 08 25 0882.

Oct. 18, 2011 Japanese official action in connection with a counterpart Japanese patent application.

* cited by examiner

LIQUID-JET DEVICE, IMAGE FORMING APPARATUS, AND METHOD FOR ADJUSTING LANDING POSITIONS OF LIQUID DROPLETS

BACKGROUND

1. Technical Field

This disclosure generally relates to a liquid jet device, an image forming apparatus, and a method for adjusting landing positions of liquid droplets.

2. Description of the Related Art

There are image forming apparatuses (e.g., a printer, a fax machine, a copier, and a multifunction copier having functions of a printer, a fax machine, and a copier) that use a liquid-jet device including a recording head implemented by a liquid-jet head to form (record or print) an image on paper (not limited to a sheet of paper but also refers to any medium on which an image can be formed, and may also be called a recording medium, recording paper, recording sheet, recording material, etc.). A liquid-jet device jets droplets of a recording liquid (or ink) from a liquid-jet head onto paper being carried in an image forming apparatus and thereby forms an image on the paper.

In the present application, an image forming apparatus refers to an apparatus that forms an image by jetting a liquid onto a recording medium made of paper, thread, fabric, silk, leather, metal, plastic, glass, wood, ceramic, etc. Also, "image forming" indicates not only a process of forming an image such as a character or a figure having a meaning on a recording medium, but also a process of forming a meaningless image such as a pattern on a recording medium. In other words, an image forming apparatus may even refer to a textile printer or an apparatus for forming a metal wiring pattern. Liquids used in an image forming apparatus are not limited to a recording liquid and ink. Further, a liquid-jet device refers to any device that jets a liquid from its liquid-jet head. The use of a liquid-jet device is not limited to image forming.

In a liquid-jet device or an image forming apparatus, a carriage having a recording head is moved forward (forward scan) and backward (backward scan) and recording (or printing) is performed in both the forward and backward directions (bidirectional printing). When printing lines with such a liquid-jet device or an image forming apparatus, misalignment tends to occur between lines printed by the forward and backward scans.

To solve this problem, some inkjet recording apparatuses have a line-adjustment function for adjusting the positions of lines. With a line-adjustment function, for example, the user prints a test chart and enters an adjustment value based on the results on the printed test chart to adjust the timing of jetting ink. However, selection of the adjustment value varies between users and depends on the ability of the user. If an incorrect adjustment value is entered, it may worsen the problem.

Patent document 1 discloses a liquid-jet image forming apparatus having a function to correct image density irregularity. In the disclosed image forming apparatus, a test pattern is printed on a recording medium or a conveyor belt, color data of the test pattern are obtained by scanning, and drive conditions for a recording head are adjusted based on the obtained color data to correct image density irregularity.

[Patent document 1] Japanese Patent Application Publication No. 4-39041

Patent document 2 discloses an inkjet recording apparatus capable of detecting a defective nozzle of a liquid-jet head. In the disclosed inkjet recording apparatus, a test pattern composed of dots of different colors is formed using a cyan ink, a magenta ink, and a yellow ink in an area on a recording medium conveying part, the test pattern is scanned by an RGB sensor, and a defective nozzle is determined based on the scanned test pattern.

[Patent document 2] Japanese Patent No. 3838251

Patent document 3 discloses an inkjet recording apparatus having a calibration function. In the disclosed inkjet recording apparatus, a test pattern composed of one or more of a nozzle clogging detection pattern for detecting nozzle clogging, a color shift detection pattern for detecting a color shift, and a head position adjustment pattern for adjusting the position of a recording head is formed on a part of a conveyor belt, the formed test pattern is scanned using an imaging device such as a charge-coupled device (CCD), and calibration is performed based on the scanned test pattern.

[Patent document 3] Japanese Patent Application Publication No. 2005-342899

Patent document 4 discloses an electrophotographic image forming apparatus capable of detecting the density of toner images formed on a photosensitive drum using a sensor. The sensor includes a light-emitting element for illuminating the toner images, a light-receiving element for receiving specularly reflected light from the toner images, and a light-receiving element for receiving diffusely reflected light from the toner images. With the sensor, the image forming apparatus can detect the density of toner images having different characteristics.

[Patent document 4] Japanese Patent Application Publication No. 5-249787

Patent document 5 discloses a method of determining the amount of adhering toner based on detection results from a sensor capable of detecting both specularly reflected light and diffusely reflected light from a toner image.

[Patent document 5] Japanese Patent Application Publication No. 2006-178396

According to technology disclosed in patent documents 1 through 3 described above, a test pattern is formed on a conveyor belt and the formed test pattern is scanned to obtain its color data based on which various adjustments are made. One problem with the disclosed technology is that if the color of an ink is similar to that of the conveyor belt, it becomes difficult to obtain accurate color data of a test pattern. One way to obviate this problem is to use light sources with different wavelengths corresponding to respective colors. However, this method increases the cost of a detecting unit or an imaging unit for obtaining color data of a test pattern. For example, there is a conveyor belt implemented by an electrostatic belt comprising an insulating layer on the upper side and a medium-resistance layer containing carbon for adjusting electrical conductivity on the back side. Since such a conveyor belt has a black color similar to that of a black ink, it is difficult to correctly detect a black part of a test pattern based solely on reflected light from the test pattern or by scanning the test pattern with an imaging unit.

More specifically, with the image forming apparatus disclosed in patent document 1, since a test pattern formed on a recording medium conveying part is scanned by a sensor, it is difficult to obtain accurate color data of the test pattern if the color of an ink used to form the test pattern is similar to that of the conveying part. Thus, the disclosed configuration makes it necessary to provide a filter for each color and therefore increases the production cost. In the inkjet recording apparatus disclosed in patent document 2, an RGB sensor is used to scan a test pattern formed on a recording medium conveying part. Also with this configuration, it is difficult to obtain accurate color data of the test pattern if the color of an ink used to form the test pattern is similar to that of the conveying part. Therefore, to improve the accuracy of the color data, it is necessary to limit the colors of inks used with the recording medium conveying part. Also, since a laser beam used by the RGB sensor scans extremely small spots one by one, the result of scanning tends to be affected by a tiny foreign object or a flaw on the conveying part. Further, an RGB sensor requires a light-receiving element for each color and is therefore expensive. In the inkjet recording apparatus disclosed in patent document 3, an imaging device is used to scan a test pattern formed on a recording medium conveying part. With this configuration, it is difficult to obtain accurate color data of the test pattern if the color of an ink used to form the test pattern is similar to that of the conveying part. Also, since the imaging device recognizes the test pattern as a two-dimensional image, a processing system with higher performance than that for processing a one-dimensional image is necessary. This in turn increases the cost of the inkjet recording apparatus.

To obviate the above problems, research is being conducted to apply the method disclosed in patent documents 4 and 5 for detecting the density of toner images or the amount of adhering toner to a liquid-jet image forming apparatus. Since the shape of toner particles does not change even when they are brought into contact with each other, it is possible to form a test pattern by heaping up toner in the form of a line and to accurately scan the test pattern. However, if this method is applied to a liquid-jet image forming apparatus without change, it is not possible to accurately scan a test pattern since liquid droplets clump together.

Meanwhile, a method where a test pattern is formed by jetting ink droplets onto plain paper and is scanned by an optical sensor also has a problem. With this method, bleeding caused by penetration of ink into the plain paper results in a blurred test pattern and makes it difficult to accurately detect the landing positions of ink droplets (positions of jetted ink droplets on a target surface).

BRIEF SUMMARY

In an aspect of this disclosure, there is provided a liquid-jet device that includes a liquid-jet head configured to jet liquid droplets; a pattern formation control unit configured to control the liquid-jet head and thereby to form a test pattern composed of separate liquid droplets on a water-repellent part; a detecting unit including a light-emitting element configured to illuminate the test pattern on the water-repellent part and a light-receiving element configured to receive specularly reflected light from the illuminated test pattern and to output a detection signal proportional to the received specularly reflected light; and a landing position adjusting unit configured to adjust landing positions of the liquid droplets based on the detection signal from the light-receiving element.

In another aspect, there is provided an image forming apparatus for forming an image on a recording medium. The image forming apparatus includes a water-repellent conveyor belt configured to convey the recording medium, and a liquid-jet device. The liquid-jet device includes a liquid-jet head configured to jet liquid droplets; a pattern formation control unit configured to control the liquid-jet head and thereby to form a test pattern composed of separate liquid droplets on the conveyor belt; a detecting unit including a light-emitting element configured to illuminate the test pattern on the conveyor belt and a light-receiving element configured to receive specularly reflected light from the illuminated test pattern and to output a detection signal proportional to the received specularly reflected light; and a landing position adjusting unit configured to adjust landing positions of the liquid droplets based on the detection signal from the light-receiving element.

DESCRIPTION OF THE PREFERRED EMBODIMENTS

Figure 1:
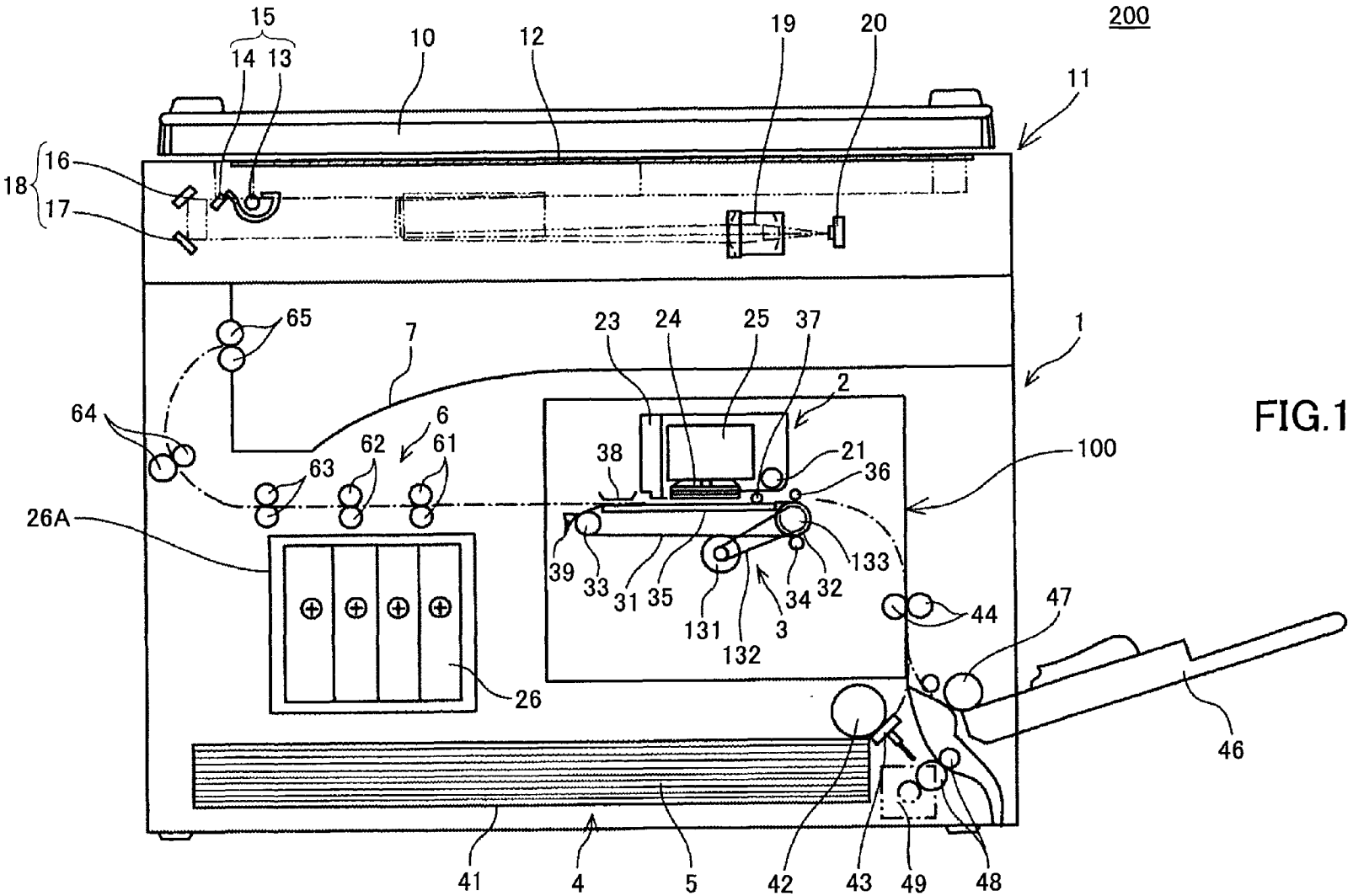
FIG. 1 is a schematic diagram illustrating a configuration of an image forming apparatus 200 according to an embodiment of the present invention.
Figure 2:
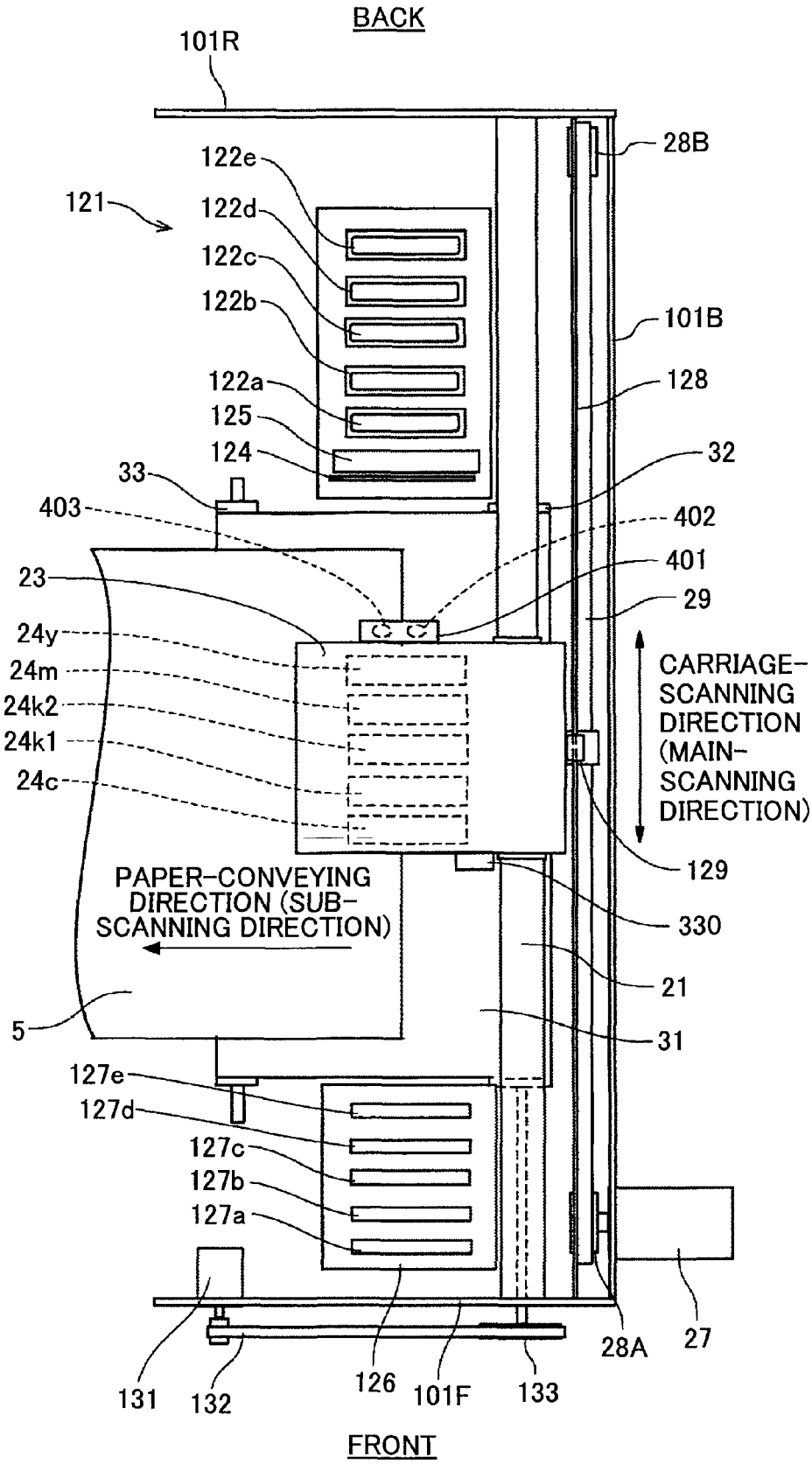
FIG. 2 is a plan view of an image forming unit and a paper conveying unit of the image forming apparatus 200.
Figure 3:
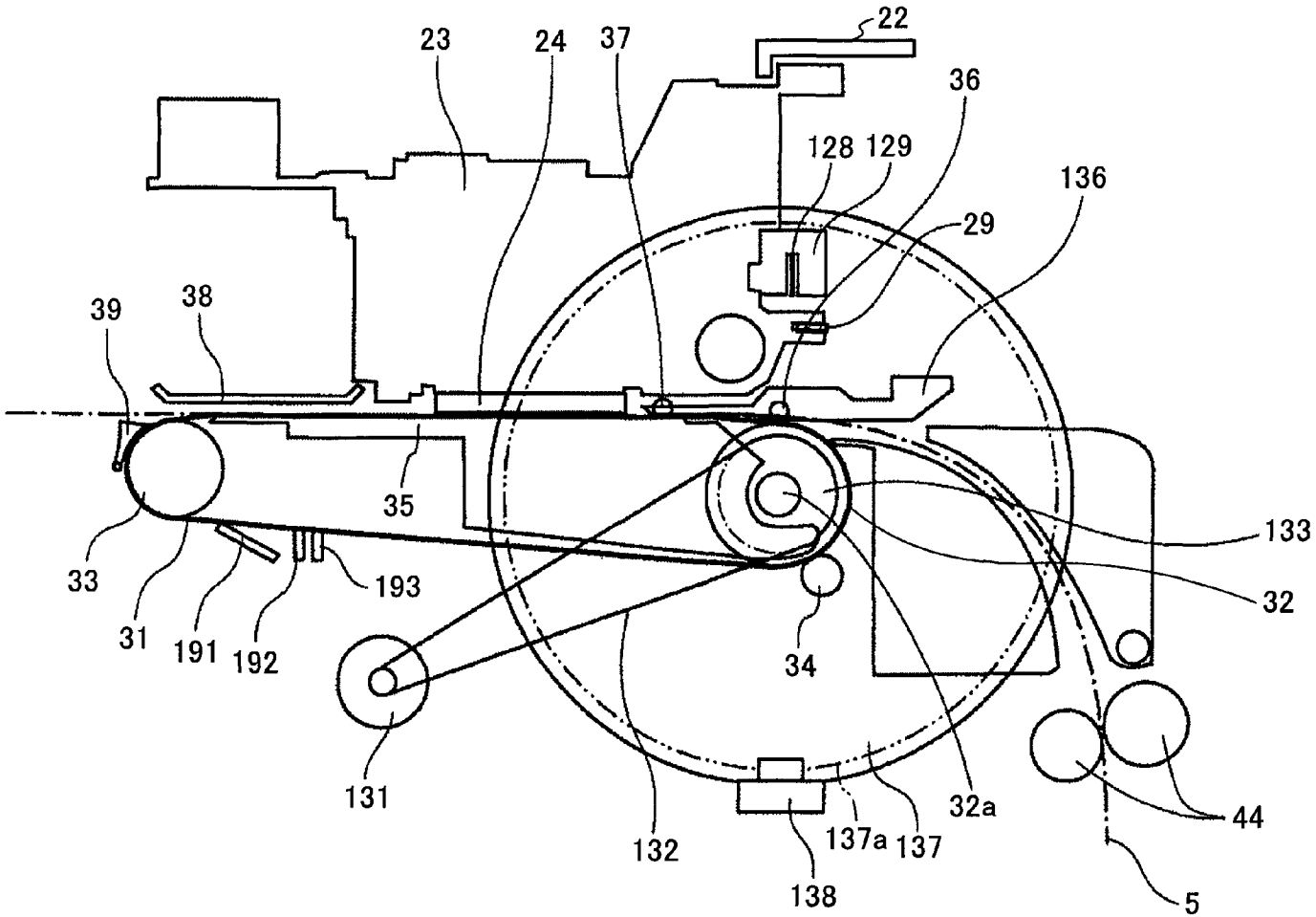
FIG. 3 is an elevational view of the image forming unit and the paper conveying unit shown in FIG. 2.

Preferred embodiments of the present invention are described below with reference to the accompanying drawings. An image forming apparatus including a paper conveying unit (recording medium conveying unit) according to an embodiment of the present invention is described below with reference to FIGS. 1 through 5. FIG. 1 is a schematic diagram illustrating a configuration of an image forming apparatus 200. FIG. 2 is a plan view of an image forming unit and a paper conveying unit of the image forming apparatus 200. FIG. 3 is an elevational view of the image forming unit and the paper conveying unit shown in FIG. 2.

The image forming apparatus 200 includes a body 1, and includes an image forming unit 2 (may also be called a liquid-jet device) for forming an image, a paper conveying unit (recording medium conveying unit) 3, a paper feeding unit 4, and a paper ejecting unit 6 in the body 1. In the image forming apparatus 200, paper sheets 5 (may also be called recording media, and the material is not limited to paper) are fed one by one from the paper feeding unit 4 at the bottom of the case, the paper conveying unit 3 conveys the paper sheet 5 intermittently in a position facing the image forming unit 2, the image forming unit 2 jets liquid droplets onto the paper sheet 5 being conveyed and thereby forms (records) an image, then the paper ejecting unit 6 ejects the paper sheet 5 onto a paper catch tray 7 on the upper side of the body 1. The image forming unit 2 and the paper conveying unit 3 are integrated as an imaging engine unit 100 that is attachable to and detachable from the body 1.

The image forming apparatus 200 also includes an image scanning unit 11 for scanning an image. The image scanning unit 11 is disposed above the paper catch tray 7 of the body 1 and is used to input image data (print data) to be formed by the image forming unit 2. The image scanning unit 11 includes a scanning optical system 15 including a light source 13 and a mirror 14; a scanning optical system 18 including mirrors 16 and 17; a contact glass 12; a lens 19; and an imaging element 20 behind the lens 19. The scanning optical system 15 and the scanning optical system 18 move and scan a document on the contact glass 12, and the imaging element 20 converts the optical image of the scanned document into an image signal. The image signal is digitized and processed, and an image is printed according to the processed image signal. The image scanning unit 11 also includes a pressing plate 10 above the contact glass 12 to hold down a document.

As shown in FIG. 2, the image forming unit 2 includes a carriage guide rod 21 used as a primary guide part and disposed between a front board 101F and a rear board 101R, a guide stay 22 (see FIG. 3) used as a secondary guide part and disposed near a rear stay 101B, a carriage 23 supported by the carriage guide rode 21 and the guide stay 22 so as to be movable in the main-scanning direction (carriage-scanning direction), and a main-scanning motor 27. The main-scanning motor 27 moves the carriage 23 in the main-scanning direction via a timing belt 29 stretched between a drive pulley 28A and a driven pulley 28B.

The carriage 23 comprises recording heads 24*k*1 and 24*k*2 each implemented by a liquid-jet head for jetting a black (K) ink, and recording heads 24*c*, 24*m*, and 24*y* implemented, respectively, by liquid-jet heads for jetting cyan (C), magenta (M), and yellow (Y) inks (the recording heads may be collectively called recording head(s) 24 for brevity when color distinction is not important). The image forming unit 2 is a shuttle type where an image is formed by moving the carriage 23 in the main-scanning direction and jetting ink droplets from the recording heads (liquid-jetting units) 24 while the paper sheet 5 is carried in the sub-scanning direction by the paper conveying unit 3.

The carriage 23 also includes sub-tanks 25 for supplying corresponding color inks to the recording heads 24. Referring back to FIG. 1, the body 1 includes a cartridge holder 26A for detachably holding ink cartridges (recording liquid cartridges) 26 containing, respectively, a black (K) ink, a cyan (C) ink, a magenta (M) ink, and a yellow (Y) ink. The inks (recording liquids) are supplied from the ink cartridges 26 to the corresponding sub-tanks 25 via tubes (not shown). The ink cartridges 26 can be inserted into the cartridge holder 26A from the front side of the body 1. The black ink is supplied from one of the ink cartridges 26 to two sub-tanks 25 corresponding to the recording heads 24*k*1 and 24*k*2.

As the recording head 24, one of the following three types, which employ different types of pressure-generating units (actuator units) for pressurizing ink in an ink channel (pressure generating chamber), may be used: a piezoelectric type employing a piezoelectric element that causes ink droplets to be discharged by deforming a vibrating plate forming a wall of the ink channel and thereby changing the volume of the ink channel; a thermal type employing a heat element that heats ink in the ink channel to generate air bubbles and causes ink droplets to be discharged by the pressure of the air bubbles; and an electrostatic type that includes an electrode facing a vibrating plate forming a wall of the ink channel and causes ink droplets to be discharged by deforming the vibrating plate with an electrostatic force generated between the vibrating plate and the electrode and thereby changing the volume of the ink channel.

Referring to FIGS. 2 and 3, a linear scale 128 having slits is provided along the main-scanning direction between the front board 101F and the rear board 101R. An encoder sensor 129 implemented by a transmissive photosensor for detecting slits of the linear scale 128 is attached to the carriage 23. The linear scale 128 and the encoder sensor 129 constitute a linear encoder for detecting the position of the carriage 23.

Also, as shown in FIG. 2, an image sensor 401 (detecting unit) for detecting positional deviation (deviation from correct landing positions) of ink (or liquid) droplets is attached to a side of the carriage 23. The image sensor 401 is implemented by a reflective photosensor including a light-emitting element and a light-receiving element, and scans a test pattern formed on a water-repellent conveyor belt 31 (water-repellent part) and used to detect positional deviation of ink droplets.

Further, as shown in FIG. 2, a maintenance/cleaning mechanism 121 is provided in a non-image-forming area on one side of the carriage 33 with respect to the main-scanning direction. The maintenance/cleaning mechanism 121 maintains and cleans the nozzles of the recording heads 24. The maintenance/cleaning mechanism 121 includes caps for covering nozzle surfaces 24*a* of the recording heads 24. The maintenance/cleaning mechanism 121 includes a moisture-retention/suction cap 122*a*, four moisture retention caps 122*b* through 122*e*, a wiper blade 124 for wiping the nozzle surfaces 24*a*, and a waste-ink receiver 125 for receiving ink used to purge dried ink from nozzles of the recording heads 24. In a non-image-forming area on the other side of the carriage 33 with respect to the main-scanning direction, a waste-ink receiver 126 is provided. The waste-ink receiver 126 is used to receive ink used to purge dried ink from the nozzles of the recording heads 24. The waste-ink receiver 126 has openings 127*a* through 127*e*.

The paper conveying unit 3 includes a conveying roller 32 used as a drive roller; a driven roller 33 used as a tension roller; and an endless conveyor belt 31 stretched between the conveying roller 32 and the driven roller 33. The conveyor belt 31 changes the direction of the paper sheet 5 fed from the paper feeding unit 4 approximately 90 degrees and then conveys the paper sheet 5 in a position facing the image forming unit 2. The paper conveying unit 3 also includes a charging roller 34 to which an AC bias voltage for charging the surface of the conveyor belt 31 is applied; a platen guide 35 for guiding the conveyor belt 31 in an area facing the image forming unit 2; a first pressing roller (entrance pressing roller) 36 for pressing the paper sheet 5 against the conveyor belt 31 in a position facing the conveying roller 32; a second pressing roller (edge pressing roller) 37 disposed between the conveying roller 32 and the recording heads 24 and used to press the paper sheet 5 against the conveyor belt 31 in a position facing the platen guide 35; a holding part 136 for holding the first pressing roller 36 and the second pressing roller 37; and separating claws 39 for separating the paper sheet 5, on which an image has been formed by the image forming unit 2, from the conveyor belt 31.

Figure 4:
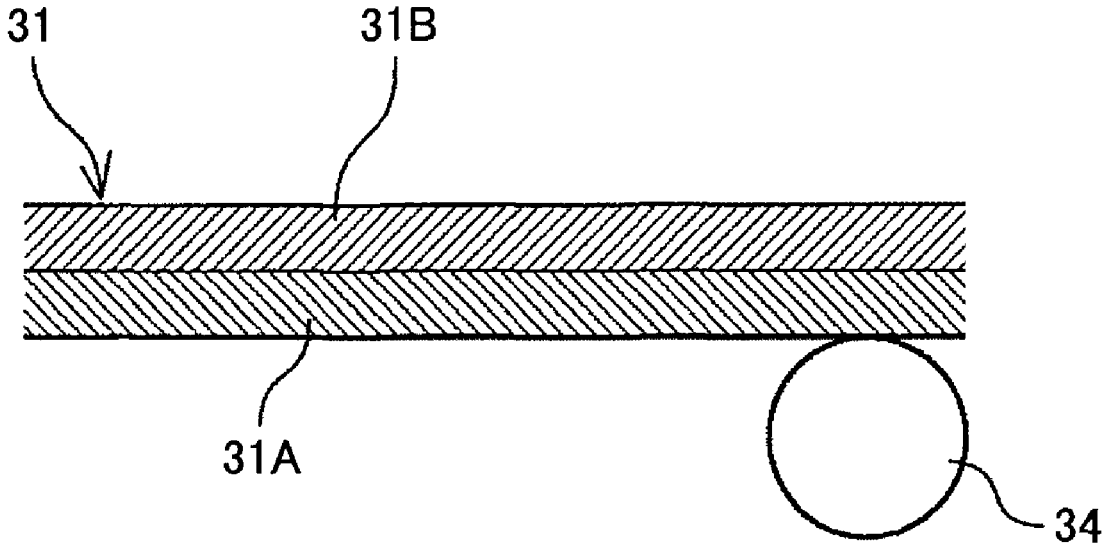
FIG. 4 is a cut-away side view of a conveyor belt.

The conveyor belt 31 is turned in the paper conveying direction (sub-scanning direction) shown in FIG. 2 by the conveying roller 32 that is rotated by a sub-scanning motor 131, implemented by a DC brushless motor, via a timing belt 132 and a timing roller 133. In this embodiment, as shown in FIG. 4, the conveyor belt 31 comprises an outside layer 31A that attracts the paper sheet 5 and an inside layer (medium-resistance layer or earth layer) 31B. The outside layer 31A is made of a pure resin material, such as an ethylene-tetrafluoroethylene (ETFE) pure material, that is not resistance-adjusted. The inside layer 31B is made of a material prepared by adjusting the resistance of the material of the outside layer 31A with carbon. Alternatively, the conveyor belt 31 may be composed of one layer, or three or more layers.

A paper dust removing part 191 made of a polyethylene terephthalate (PET) film or Mylar (DuPont) is provided between the driven roller 33 and the charging roller 34. The paper dust removing part 191 is in contact with the surface of the conveyor belt 31 and removes paper dust being carried on the conveyor belt 31 from the upstream. Also, a cleaning brush 192 in contact with the conveyor belt 31 and a discharging brush 193 for discharging the surface of the conveyor belt 31 are provided between the driven roller 33 and the charging roller 34.

Further, a code wheel 137 is attached to a shaft 32*a* of the conveying roller 32 and an encoder sensor 138 implemented by a transmissive photosensor is provided to detect slits 137*a* formed in the code wheel 137. The code wheel 137 and the encoder sensor 138 constitute a rotary encoder.

The paper feeding unit 4 includes a paper feed tray 41 that is removable from the body 1 and holds the paper sheets 5; a paper feed roller 42 and a friction pad 43 for separating and feeding the paper sheets 5 one by one from the paper feed tray 41; and resist rollers 44 for feeding the paper sheets 5 further to the paper conveying unit 3.

The paper feeding unit 4 also includes a manual feed tray 46 for holding the paper sheets 5, a manual feed roller 47 for feeding the paper sheets 5 one by one from the manual feed tray 46, and vertical feed rollers 48 for feeding the paper sheets 5 fed from an optional paper feed tray attachable to the underside of the body 1 or from a duplex unit. The paper feed roller 42, the resist rollers 44, the manual feed roller 47, and the vertical feed rollers 48, which are used to feed the paper sheets 5 to the paper conveying unit 3, are rotated by a paper feed motor (driving unit) 49, implemented by an HB stepping motor, via an electromagnetic clutch (not shown).

The paper ejecting unit 6 includes paper ejecting rollers 61, 62, and 63 for conveying the paper sheet 5 on which an image has been formed, and paper ejecting rollers 64 and 65 for ejecting the paper sheet 5 to the paper catch tray 7.

Figure 5:
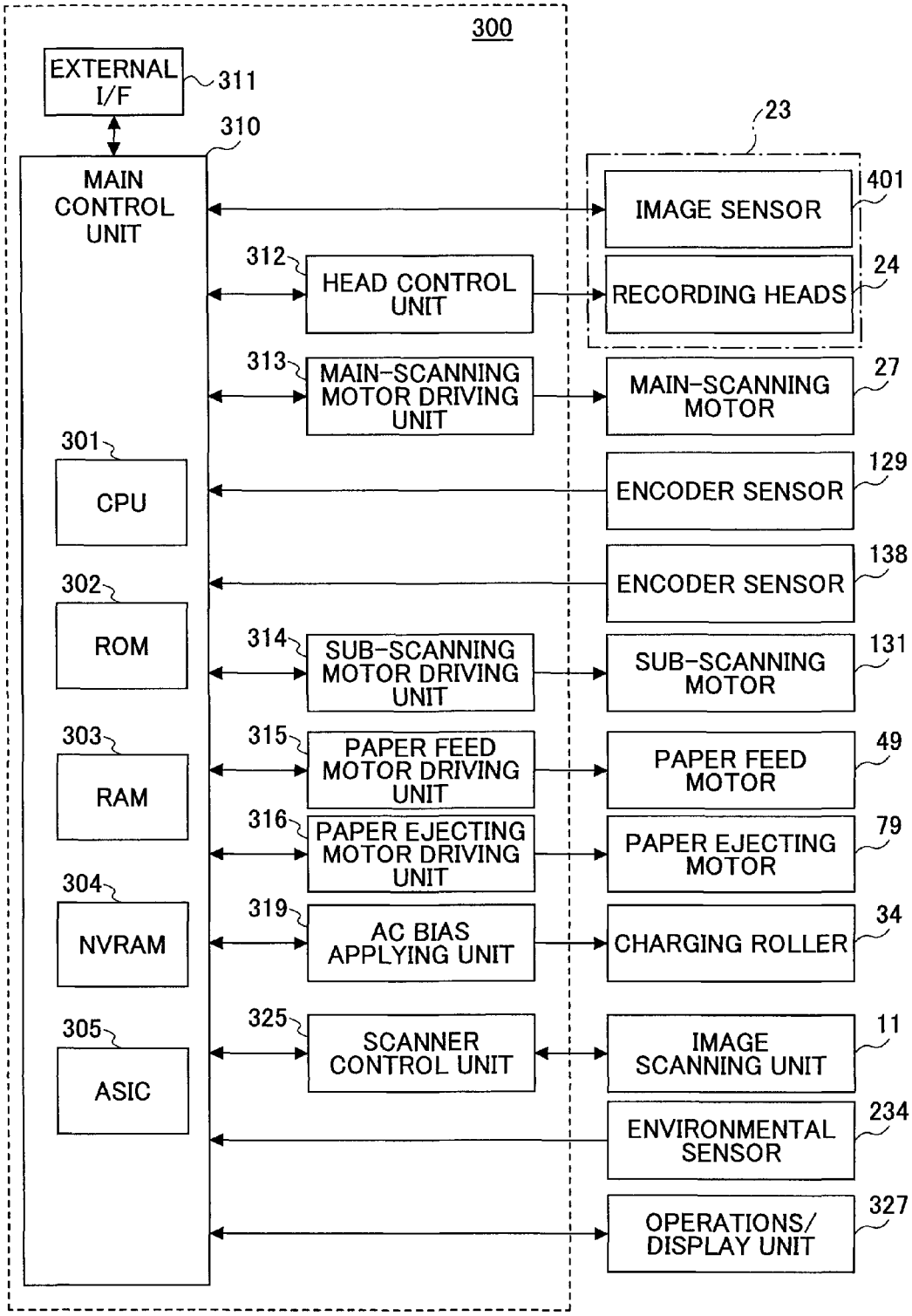
FIG. 5 is a block diagram illustrating a configuration of a control unit of the image forming apparatus 200.

A control unit 300 of the image forming apparatus 200 is described below with reference to a block diagram shown in FIG. 5.

The control unit 300 includes a main control unit 310 comprising a CPU 301, a ROM 302 for storing programs to be executed by the CPU 301 and other fixed data, a RAM 303 for temporarily storing image data, a non-volatile memory (NVRAM) 304 that can retain data even when the power is cut off, and an ASIC 305 that performs, for example, signal processing and sort operations on image data and handles input/output signals for controlling the image forming apparatus 200. The main control unit 310 controls the entire image forming apparatus 200 and also controls processes of detecting and adjusting landing positions of liquid droplets.

The control unit 300 also includes an external I/F 311 for sending and receiving data and signals between the main control unit 310 and a host; a head control unit 312 including a head driver (disposed near the recording heads 24) comprising a head data arrangement conversion ASIC for controlling the recording heads 24; a main-scanning motor driving unit (motor driver) 313 for driving the main-scanning motor 27 that moves the carriage 23; a sub-scanning motor driving unit (motor driver) 314 for driving the sub-scanning motor 131; a paper feed motor driving unit 315 for driving the paper feed motor 49; a paper ejecting motor driving unit 316 for driving a paper ejecting motor 79 that drives rollers in the paper ejecting unit 6; an AC bias applying unit 319 for applying an AC bias voltage to the charging roller 34; and a scanner control unit 325 for controlling the image scanning unit 11. Although not shown in FIG. 5, the control unit 300 further includes a maintenance/cleaning motor driving unit for driving a maintenance/cleaning motor that drives the maintenance/cleaning mechanism 121; a duplex unit driving unit for driving a duplex unit; a solenoid driving unit (driver) for driving solenoids (SOLs); and a clutch driving unit for driving electromagnetic clutches.

The main control unit 310 receives a detection signal from an environmental sensor 234 that detects the temperature and humidity (environmental conditions) around the conveyor belt 31. Although the main control unit 310 also receives detection signals from other sensors, those sensors are omitted in FIG. 5. The main control unit 310 receives key inputs from and sends display information to an operations/display unit 327 on the body 1. The operations/display unit 327 includes keys, such as numeric keys and a print start key, and displays.

Also, the main control unit 310 receives a signal from the encoder sensor 129 constituting a part of the linear encoder for detecting the position of the carriage 23. Based on the received signal, the main control unit 310 causes the main-scanning motor driving unit 313 to drive the main-scanning motor 27 and thereby moves the carriage 23 back and forth in the main-scanning direction. Also, the main control unit 310 receives a signal (pulse) from the encoder sensor 138 constituting a part of the rotary encoder for detecting the amount of movement of the conveyor belt 31. Based on the received signal, the main control unit 310 causes the sub-scanning motor driving unit 314 to drive the sub-scanning motor 131 to rotate the conveying roller 32 and thereby turns the conveyor belt 31.

Further, the main control unit 310 causes the light-emitting element of the image sensor 401, which scans a test pattern formed on the conveyor belt 31, to emit light, detects the amount of positional deviation of liquid droplets based on a detection signal from the light-receiving element of the image sensor 401, and adjusts the timing (liquid-jet timing) of jetting liquid droplets from the recording heads 24 based on the detected amount of positional deviation. Details of this process are described later.

An exemplary image forming process in the image forming apparatus 200 is described below. The main control unit 310 detects the amount of rotation of the conveying roller 32 that drives the conveyor belt 31, and controls the sub-scanning motor 131 based on the detected amount of rotation. Meanwhile, the main control unit 310 causes the AC bias applying unit 319 to apply a high AC voltage having a rectangular wave with positive and negative peaks to the charging roller 34. The charging roller 34 charges the conveyor belt 31 and forms positively-charged and negatively-charged strip-shaped-areas alternately in the paper conveying direction. As a result, a non-uniform electric field is formed on the conveyor belt 31.

The paper sheet 5 is fed from the paper feeding unit 4 into the space between the conveying roller 32 and the first pressing roller 36, and is placed on the conveyor belt 31 where the non-uniform electric field is formed. When placed on the conveyor belt 31, the paper sheet 5 is instantly polarized along the direction of the electric field, thereby electrostatically attracted to the conveyor belt 31, and conveyed as the conveyor belt 31 turns.

The paper sheet 5 is intermittently conveyed by the conveyor belt 31. While the paper sheet 5 is momentarily stopped, the carriage 23 moves in the main-scanning direction and the recording heads 24 jet droplets of recording liquids onto the paper sheet 5 to form an image. Then, the paper sheet 5 is separated by the separating claws 39 from the conveyor belt 31, fed into the paper ejecting unit 6, and ejected onto the paper catch tray 7.

When the image forming apparatus 200 is in a standby mode, the carriage 23 is moved into a position above the maintenance/cleaning mechanism 121. In the position, the nozzle surfaces 24*a* of the recording heads 24 are covered by the caps 122 to retain moisture in the nozzles and thereby to prevent nozzle clogging caused by dried ink. The moisture-retention/suction cap 122*a* also suctions the nozzles of any one of the recording heads 24 being covered to remove dried ink or air bubbles. Ink adhered to the nozzle surfaces 24*a* of the recording heads 24 during this cleaning process is wiped off by the wiper blade 124. Also, before or during an image forming process, ink is jetted into the waste-ink receiver 125 in order to clean the nozzles. With the above measures, performance of the recording heads 24 is maintained.

Figure 6:
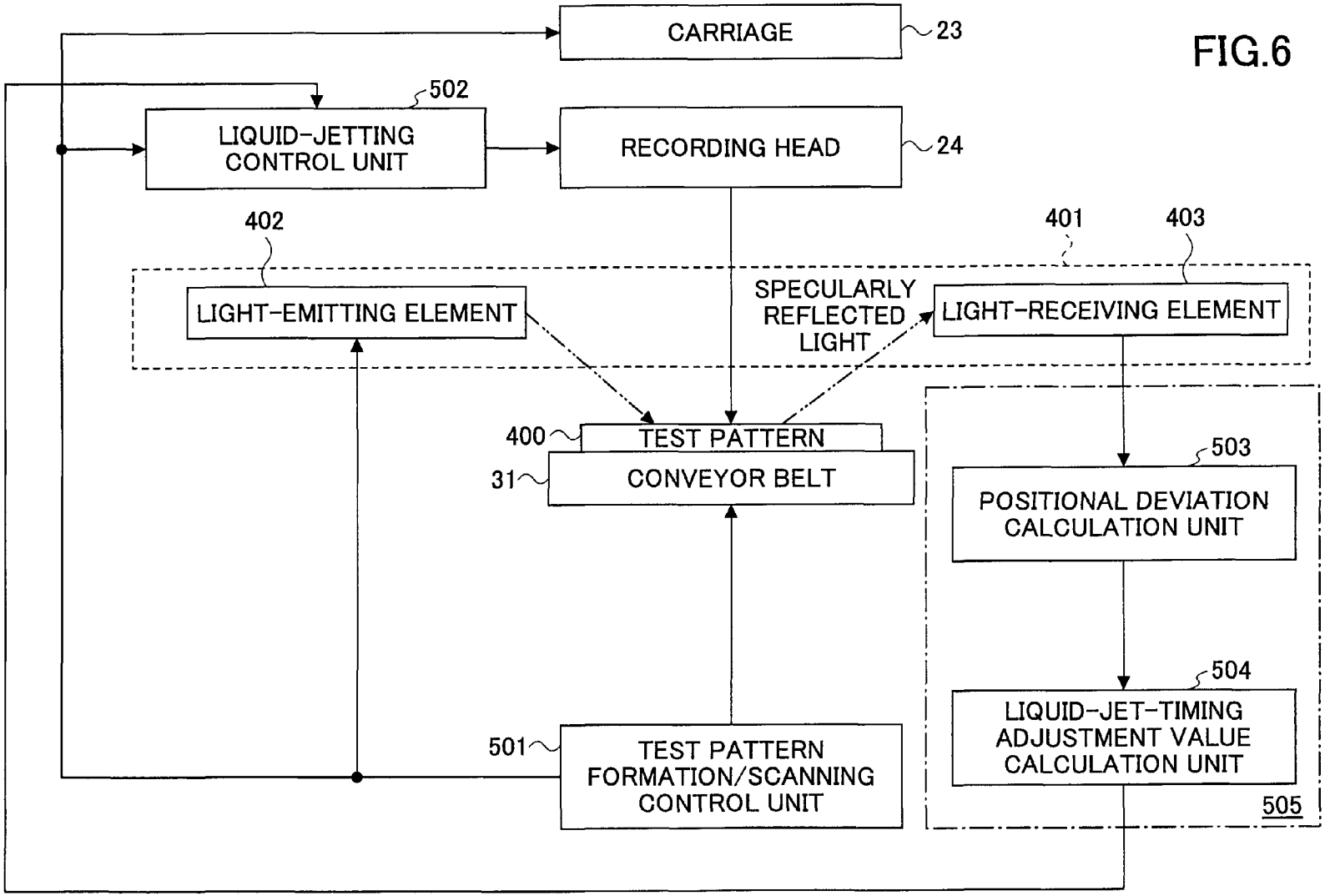
FIG. 6 is a block diagram illustrating an exemplary mechanism for detecting and adjusting landing positions of liquid droplets according to a first embodiment of the present invention.
Figure 7:
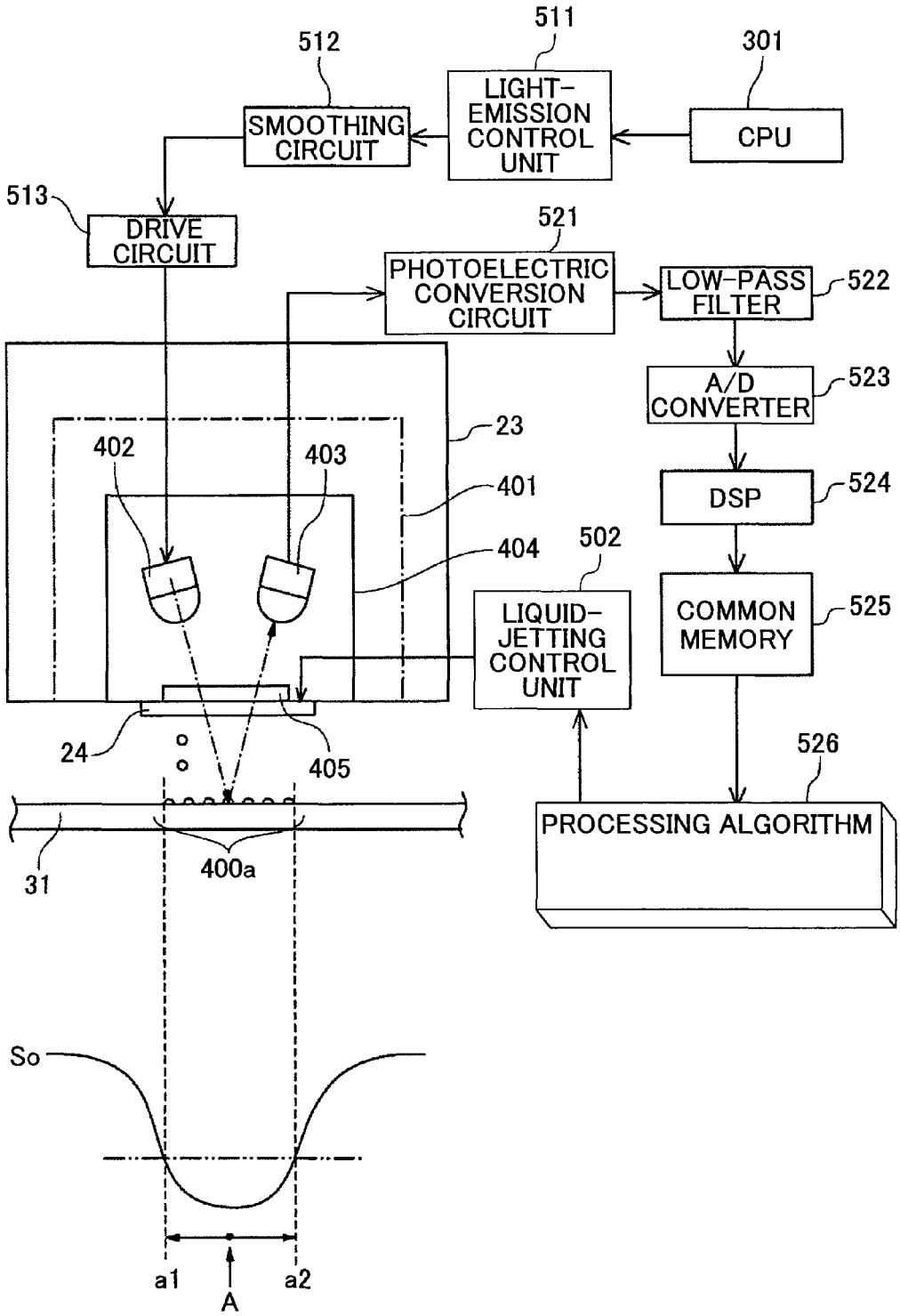
FIG. 7 is a drawing illustrating the exemplary mechanism for detecting and adjusting landing positions of liquid droplets in more detail.

A first embodiment of the present invention is described below. First, a mechanism for detecting and adjusting landing positions of liquid droplets in the image forming apparatus 200 is described with reference to FIGS. 6 and 7. FIG. 6 is a block diagram illustrating an exemplary mechanism for detecting and adjusting landing positions of liquid droplets. FIG. 7 is a drawing illustrating the exemplary mechanism for detecting and adjusting landing positions of liquid droplets in more detail.

Figure 9:
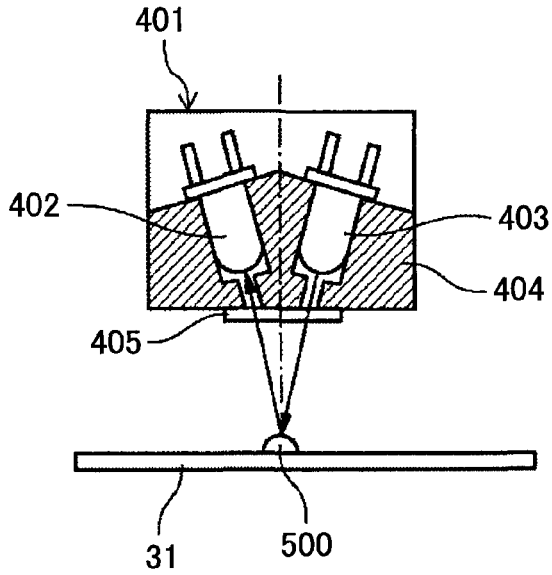
FIG. 9 is a drawing illustrating an image sensor.

As shown in FIG. 7 (see FIG. 9 also), the carriage 23 is equipped with the image sensor 401 (detecting unit) that detects a test pattern 400 (may also be called an adjustment pattern or a detection pattern) formed on the conveyor belt 31 made of a water-repellent material. The image sensor 401 includes a light-emitting element 402 for illuminating the test pattern 400 on the conveyor belt 31 and a light-receiving element 403 for receiving specularly reflected light from the test pattern 400. Actually, the light-emitting element 402 also illuminates the surface of the conveyor belt 31 and the light-receiving element 403 also receives specularly reflected light from the surface of the conveyor belt. The light-emitting element 402 and the light-receiving element 403 are held in a holder 404. A lens 405 is provided at a light exit/entry opening of the holder 404.

As shown in FIG. 2, in the holder 404, the light-emitting element 402 and the light-receiving element 403 are arranged in a direction orthogonal to the main-scanning direction of the carriage 23. This arrangement reduces the influence of variation in the moving speed of the carriage 23 on detection results of the image sensor 401. As the light-emitting element 402, a comparatively simple and inexpensive light source, such as a LED, that emits infrared light or visible light may be used. The spot diameter (detection range or detection area) of a light source is preferably on the order of millimeters to allow the use of an inexpensive lens instead of an expensive, high-precision lens.

Figure 8:
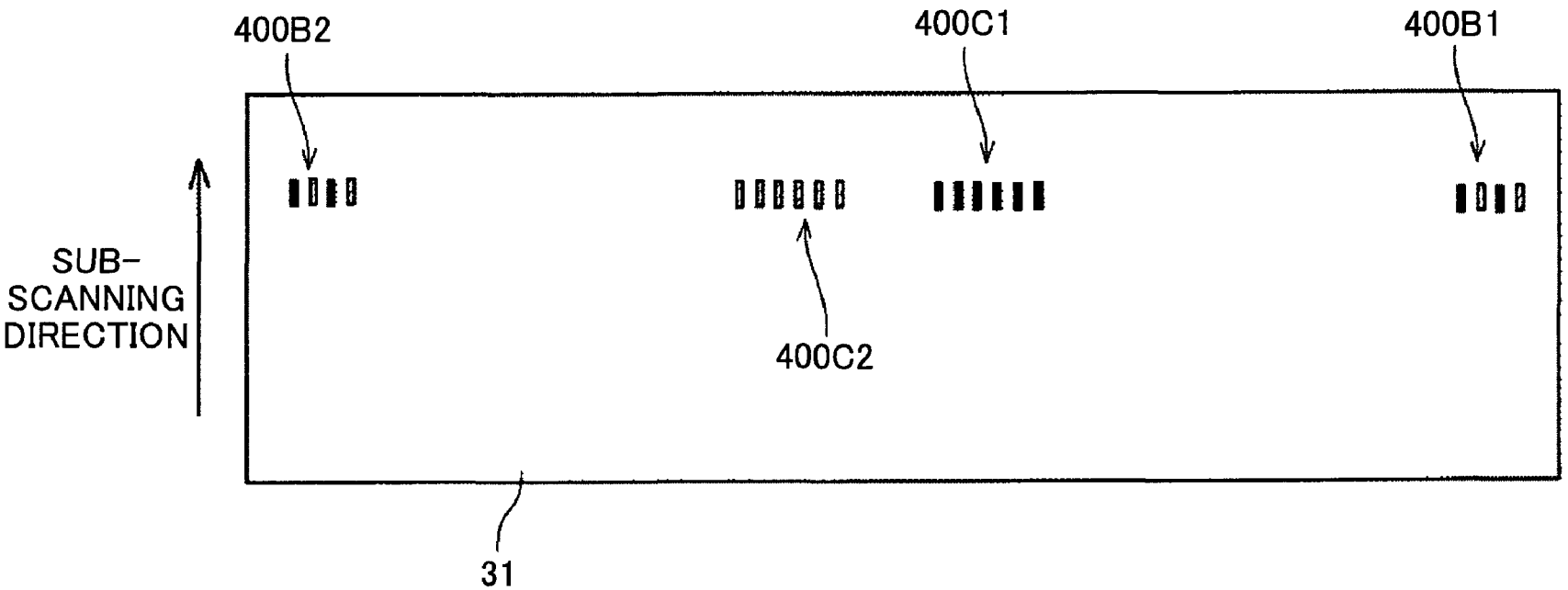
FIG. 8 is a drawing illustrating an exemplary test pattern formed on a conveyor belt.

When requested to perform a landing position adjusting process, a test pattern formation/scanning control unit 501 (may also be called a pattern formation control unit) requests a liquid-jetting control unit 502 to jet liquid droplets from the recording heads 24 onto the conveyor belt 31 while moving the carriage 23 back and forth in the main-scanning direction, and thereby forms test patterns 400 (400B1, 400B2, 400C1, and 400C2) composed of separate liquid droplets 500 as shown in FIG. 8. The test pattern formation/scanning control unit 501 may be implemented by the CPU 301 of the main control unit 310.

The test pattern formation/scanning control unit 501 also controls a process of scanning the test patterns 400 with the image sensor 401. In this process, the test pattern formation/scanning control unit 501 causes the light-emitting element 402 of the image sensor 401 to emit light while moving the carriage 23 in the main-scanning direction. More specifically, as shown inn FIG. 7, the CPU 301 of the main control unit 310 sets a PWM value, based on which the light-emitting element 402 of the image sensor 401 is driven, in a light-emission control unit 511. A smoothing circuit 512 smoothes an output signal from the light-emission control unit 511 and outputs the smoothed signal to a drive circuit 513. The drive circuit 513 causes the light-emitting element 402 to illuminate each of the test patterns 400 on the conveyor belt 31.

Specularly reflected light from the test pattern 400 illuminated by the light-emitting element 402 enters the light-receiving element 403 of the image sensor 401. The light-receiving element 403 outputs a detection signal proportional to the amount of received specularly reflected light to a positional deviation calculation unit 503 of a landing position adjusting unit 505. More specifically, as shown in FIG. 7, a photoelectric conversion circuit 521 (not shown in FIG. 5) of the main control unit 310 photoelectrically converts the detection signal from the light-receiving element 403. A low-pass filter 522 removes noise from the photoelectrically converted signal (sensor output voltage). An A/D converter 523 converts the sensor output voltage from analog to digital, and a digital signal processor (DSP) 524 stores the converted sensor output voltage in a common memory 525.

The positional deviation calculation unit 503 of the landing position adjusting unit 505 determines the position of the test pattern 400 (or the position of each line pattern constituting the test pattern 400) based on the detection signal from the light-receiving element 403 and calculates positional deviation of liquid droplets from a reference position. The positional deviation calculated by the positional deviation calculation unit 503 is output to a liquid-jet-timing adjustment value calculation unit 504. The liquid-jet-timing adjustment value calculation unit 504 calculates an adjustment value for adjusting a liquid-jet timing at which the recording head 24 is driven, and sets the adjustment value in the liquid-jetting control unit 502. The liquid-jetting control unit 502 adjusts the liquid-jet timing based on the adjustment value and drives the recording head 24 at the adjusted liquid-jet timing so as to reduce the positional deviation of liquid droplets.

The above process in the landing position adjusting unit 505 is described in more detail below with reference to FIG. 7. The landing position adjusting unit 505 is implemented by a processing algorithm 526 executed by the CPU 301. The processing algorithm 526 determines the center point (point A) of each of line patterns constituting the test pattern 400 (400*a* indicates each of the line patterns; each of the line patterns may also be called a test pattern) based on a sensor output voltage So, calculates the positional deviation of liquid droplets jetted from the corresponding one of the recording heads 24 with respect to the reference position (reference head), calculates an adjustment value for adjusting the liquid-jet timing based on the positional deviation, and sets the adjustment value in the liquid-jetting control unit 502.

The test pattern 400 according to an embodiment of the present invention is described below.

Figure 10:
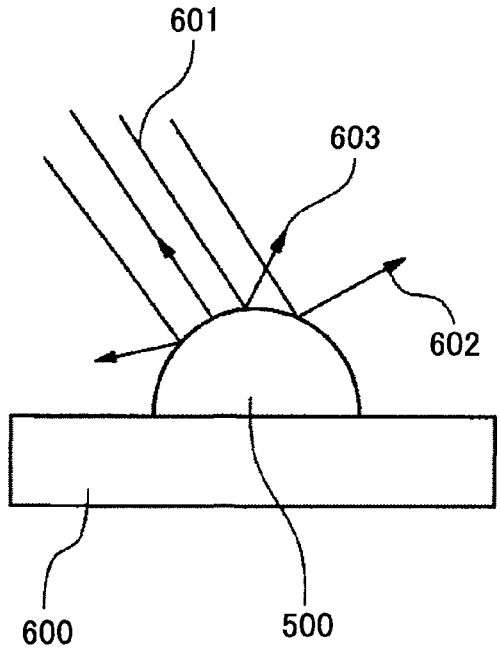
FIG. 10 is a drawing illustrating diffusely reflected light from a liquid droplet.

First, a mechanism of detecting landing positions of liquid droplets (a pattern) is described. FIG. 10 is a drawing illustrating diffusely reflected light from a liquid droplet 500 (may also be called an ink droplet 500).

Figure 11:
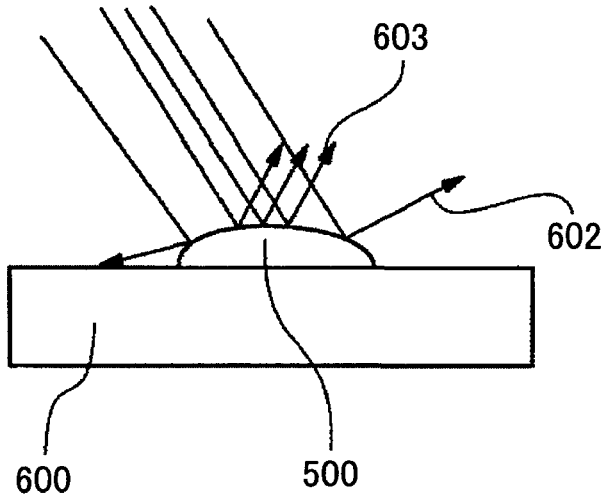
FIG. 11 is a drawing illustrating diffusely reflected light from a flattened liquid droplet.
Figure 12:
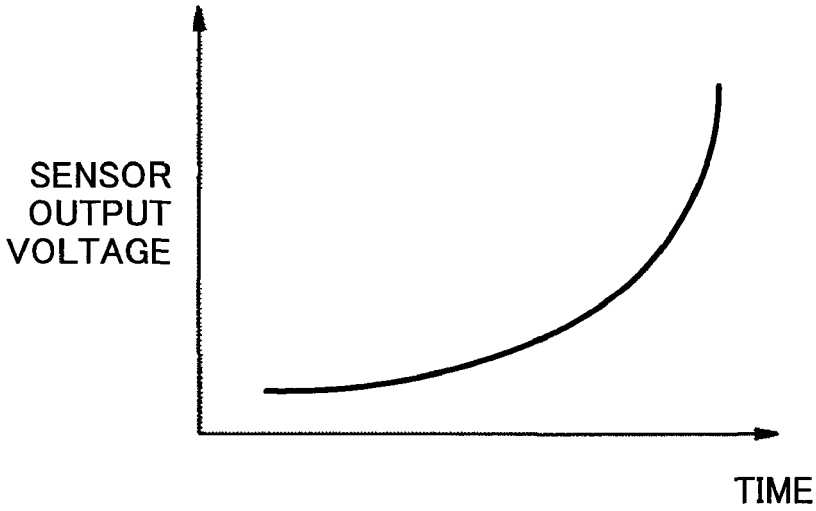
FIG. 12 is a graph showing the relationship between the time elapsed after a liquid droplet is placed on a target surface and a sensor output voltage.

As shown in FIG. 10, the liquid droplet 500 jetted onto a target surface 600 has a glossy hemispherical surface. Therefore, most of incident light 601 on the liquid droplet 500 is reflected as diffusely reflected light 602 and only a small portion of the incident light 601 is reflected as specularly reflected light 603. However, as shown in FIG. 11, the liquid droplet 500 gradually flattens and its surface becomes less glossy as it dries over time. As a result, the proportion of the specularly reflected light 603 to the diffusely reflected light 602 increases. Therefore, as shown in FIG. 12, the sensor output voltage based on the specularly reflected light 603 received by the light-receiving element 403 increases and the detection accuracy decreases as time passes.

Next, an exemplary mechanism of detecting positions of the liquid droplets 500 forming the test patterns 400 is described with reference to FIG. 13.

The conveyor belt 31 has a glossy surface (belt surface) that reflects most of the light from the light-emitting element 401 as specularly reflected light. Therefore, the amount of specularly reflected light 603 from a droplet-absent area of the belt surface, where the liquid droplets 500 are not present, is large as shown in FIG. 13(*b*), and the sensor output voltage output from the light-receiving element 403 when receiving the specularly reflected light 603 from the droplet-absent area becomes comparatively large as shown in FIG. 13(*a*).

Figure 13:
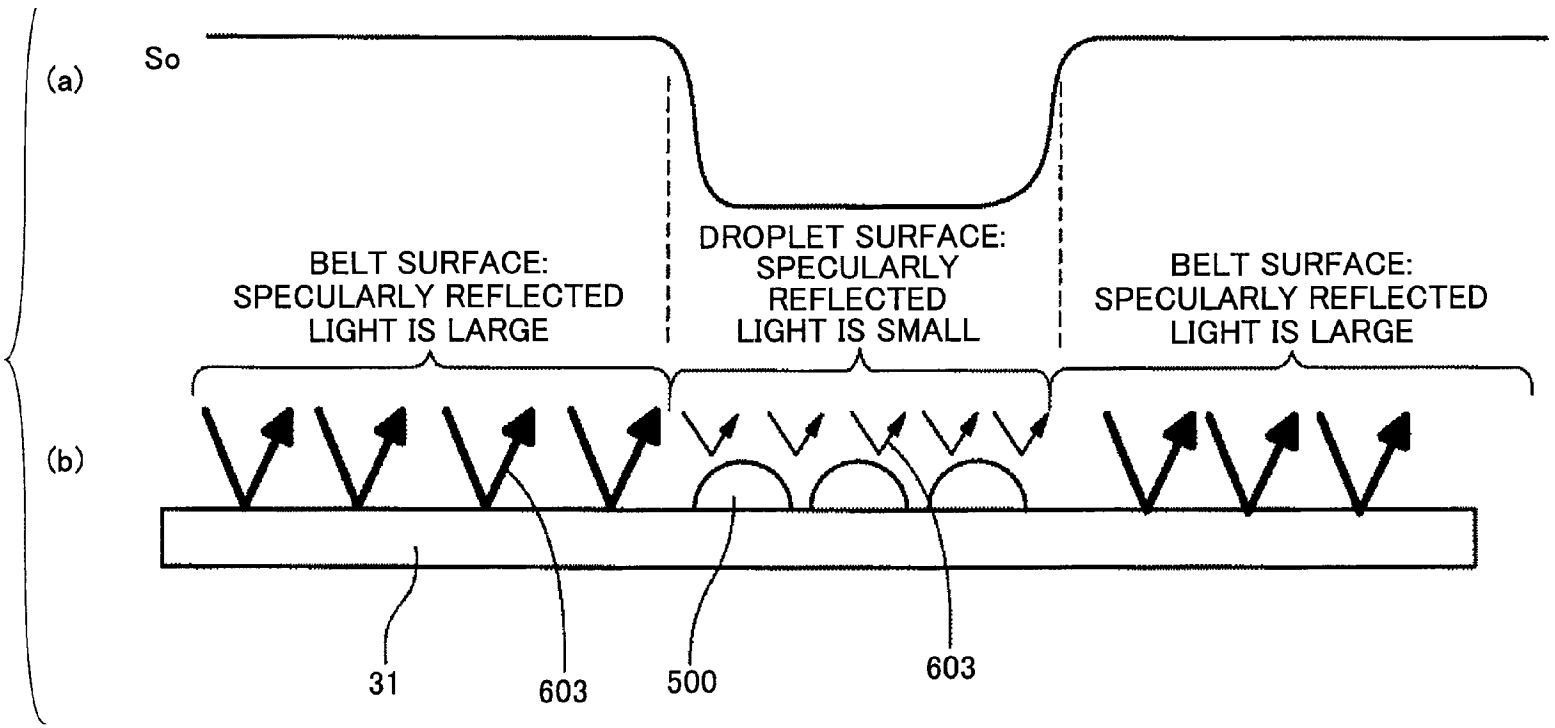
FIG. 13 is a drawing illustrating a test pattern according to an embodiment of the present invention.

On the other hand, the amount of specularly reflected light 603 from a droplet-present area of the belt surface, where the liquid droplets 500 are present and separated from each other, is small as shown in FIG. 13(*b*), and the sensor output voltage output from the light-receiving element 403 when receiving the specularly reflected light 603 from the droplet-present area becomes comparatively small as shown in FIG. 13(*a*). Accordingly, it is possible to detect landing positions of ink droplets (or a test pattern) by the difference in the level of an output voltage from the light-receiving element 403. In other words, it is possible to detect the test pattern 400 based on a low-level portion of the detection signal from the light-receiving element 403 which low-level portion indicates that the amount of specularly reflected light is small.

Figure 14:
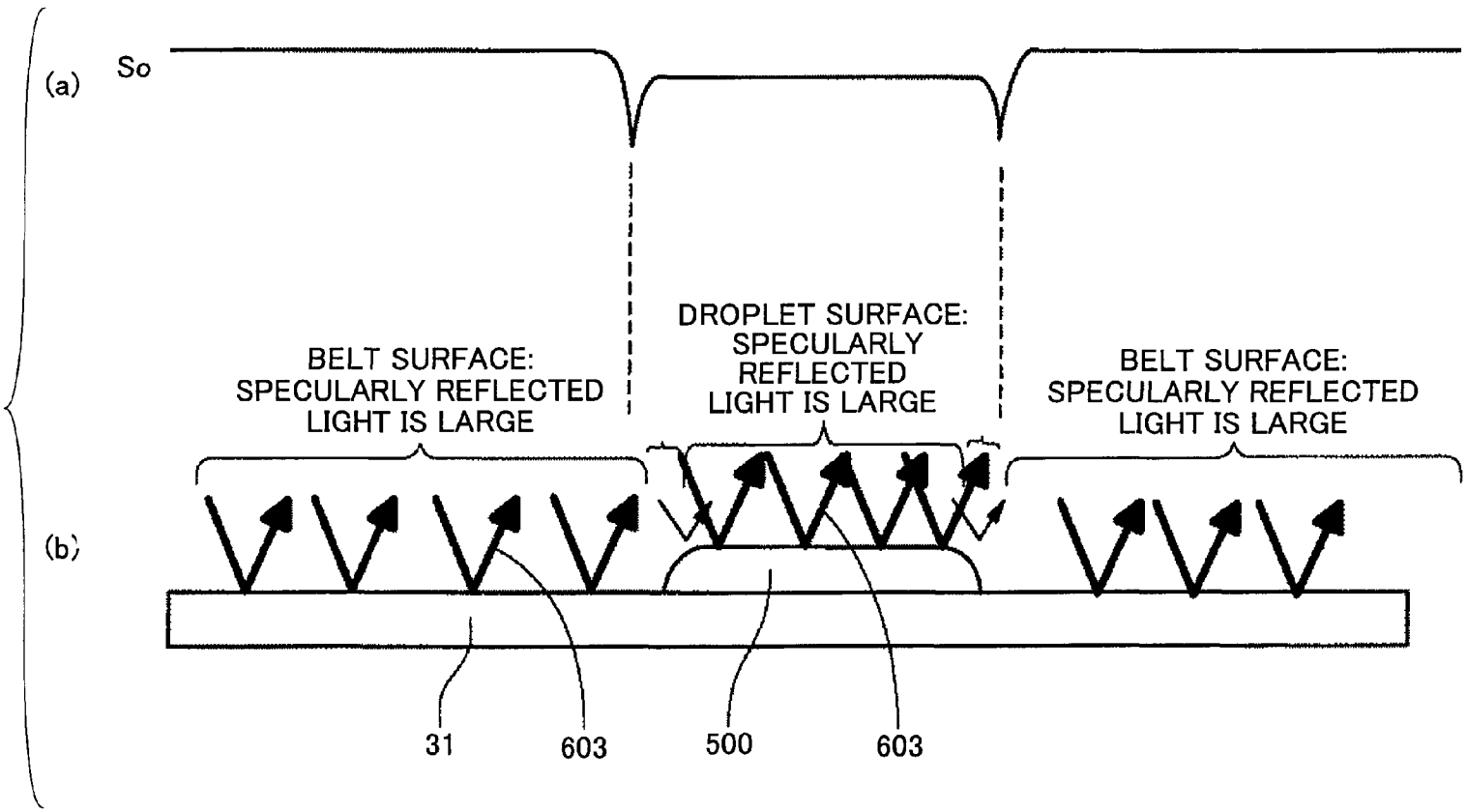
FIG. 14 is a drawing illustrating a test pattern of a comparative example.

Meanwhile, if adjoining liquid droplets 500 clump together on the conveyor belt 31 as shown in FIG. 14(*b*) to form a larger liquid droplet 500 with a flat top surface, the amount of specularly reflected light 603 from the droplet-present area increases, and the sensor output voltage of the droplet-present area becomes substantially as large as that of the liquid-absent area. This in turn makes it difficult to detect the position of the liquid droplet 500. Although a small portion of the incident light is diffusely reflected at the edge of the liquid droplet 500 formed as a result of clumping, it is difficult to detect the diffusely reflected light since the diffuse reflection occurs in a very small area. Reducing the coverage area of the light-receiving element 403 (the area that the light-receiving element 403 can detect at once) may make it possible to detect such a very small area. However, reducing the coverage area increases noise in detection results caused by tiny foreign objects or flaws on the surface of the conveyor belt 31, and therefore reduces the accuracy and reliability of the detection results.

To reduce or obviate the above problem, i.e., to accurately detect landing positions of ink droplets, the test pattern 400 is preferably composed of separate ink droplets in the detection range of the image sensor 401. Using such a test pattern, in turn, makes it possible to accurately detect a test pattern (or landing positions of liquid droplets) with a simple image sensor including a light-emitting element and a light-receiving element. Also, separate liquid droplets forming the test pattern 400 are preferably arranged densely. In other words, in a detection range of the detecting unit, an area of the test pattern not occupied by the liquid droplets is preferably smaller than an area of the test pattern occupied by the liquid droplets.

Figure 15:
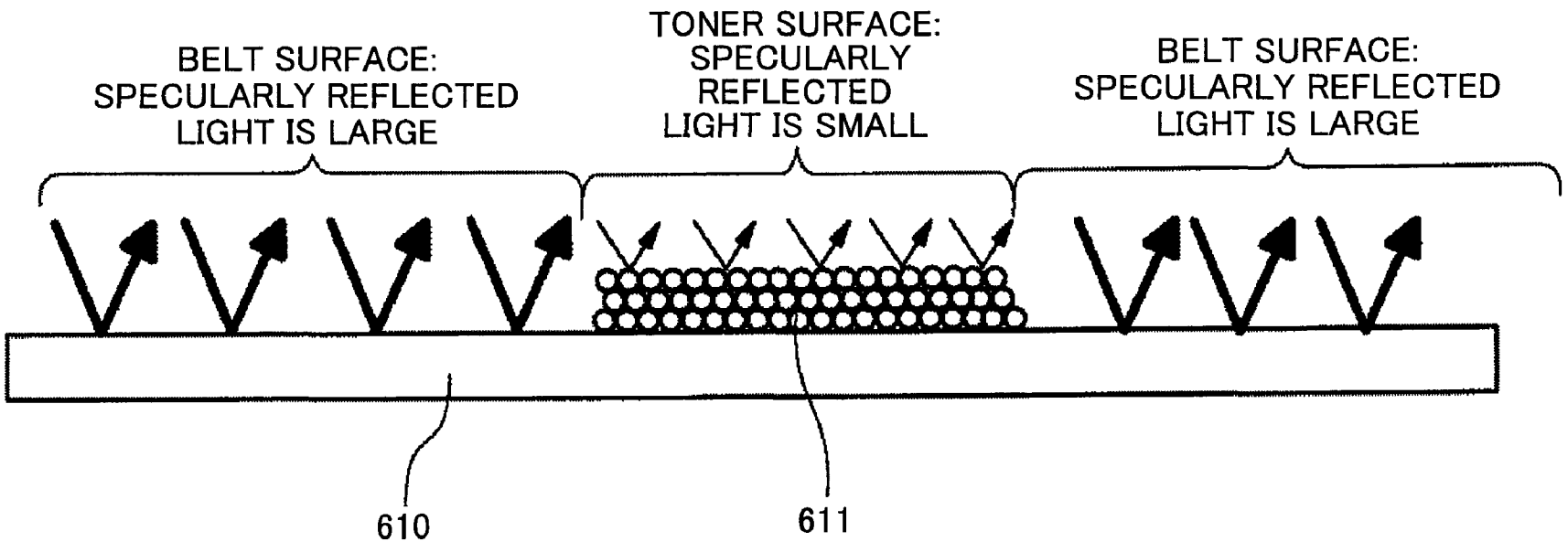
FIG. 15 is a drawing illustrating a test pattern formed with toner.

A difference between a test pattern formed with toner and a test pattern formed with liquid droplets is described below with reference to FIG. 15.

Toner used in electrophotographic printing does not change its shape even after being transferred onto a target surface. Therefore, when a test pattern is formed on a target surface 610 with toner 611, the amount of specularly reflected light from a toner-present area of the target surface 610 is constantly smaller than that from a toner-absent area of the target surface 610. In other words, when a test pattern is formed with toner, it is possible to accurately detect the test pattern based on an output voltage from a light-receiving element for receiving specularly reflected light.

On the other hand, as described above, when a test pattern is formed with liquid droplets, the liquid droplets tend to clump together to form a larger liquid droplet with a flat top surface, and the amount of specularly reflected light from a droplet-present area becomes substantially the same as that from a droplet-absent area. Without taking into account such characteristics of liquid droplets, it is not possible to accurately detect a test pattern based on the amount of specularly reflected light. Embodiments of the present invention provide a liquid-jet device and an image forming apparatus that can form a test pattern composed of separate liquid droplets, accurately detect the test pattern based on the amount of specularly reflected light from the test pattern, and thereby accurately adjust landing positions of liquid droplets.

Exemplary processes of detecting the position of the test pattern 400 formed on the conveyor belt 31 are described below with reference to FIGS. 16A through 18.

Figure 16A:
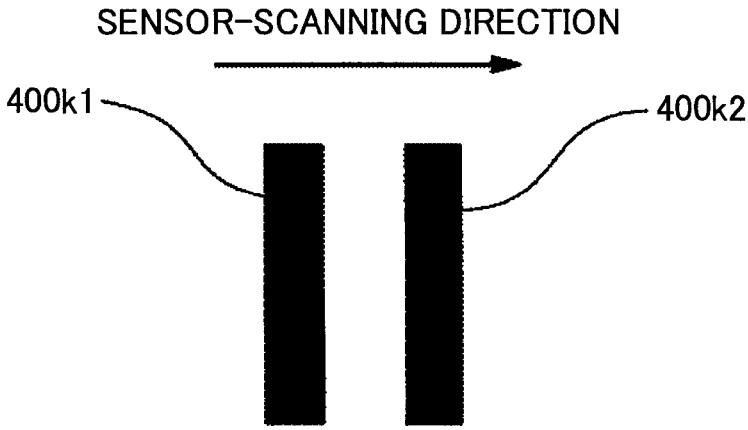
FIGS. 16A and 16B are drawings used to describe a first exemplary position detecting process.
Figure 16B:
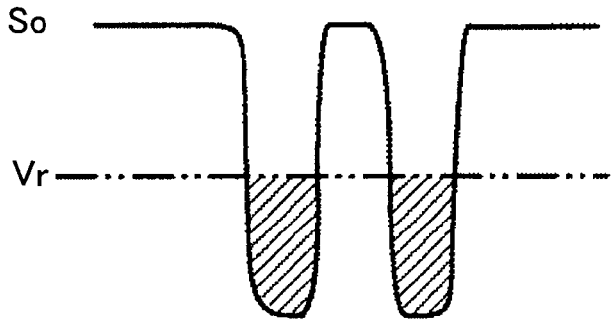

FIGS. 16A and 16B are drawings used to describe a first exemplary position detecting process. In the first exemplary position detecting process, line patterns (test patterns) 400*k*1 and 400*k*2 are formed, respectively, by the recording heads 24*k*1 and 24*k*2 on the conveyor-belt 31 as shown in FIG. 16A. The line patterns 400*k*1 and 400*k*2 are scanned in the sensor-scanning direction (the main-scanning direction of the carriage 23) by the image sensor 401. As shown in FIG. 16B, the light-receiving element 403 of the image sensor 401 outputs a sensor output voltage So that falls at positions corresponding to the line patterns 400*k*1 and 400*k*2.

Then, the sensor output voltage So is compared with a predetermined threshold value Vr, and positions at which the sensor output voltage So becomes lower than the threshold value Vr are detected as edges of the corresponding line patterns 400*k*1 and 400*k*2. That is, it is possible to obtain a center point of a low-level portion of a detection signal from the light-receiving element 403 by comparing the detection signal with a predetermined threshold value and to use the obtained center point as an edge of a line pattern (or a test pattern) Also, centroids of hatched areas (in FIG. 16B) surrounded by a line indicating the threshold value Vr and a line indicating the sensor output voltage So may be obtained and used as the centers of the corresponding line patterns 400*k*1 and 400*k*2. In other words, it is possible to obtain a centroid of a low-level portion of a detection signal from the light-receiving element 403 by comparing the detection signal with a predetermined threshold value and to use the obtained centroid as an edge of a line pattern (or a test pattern). Using a centroid makes it possible to reduce an error caused by small fluctuation of the sensor output voltage.

Figure 17A:
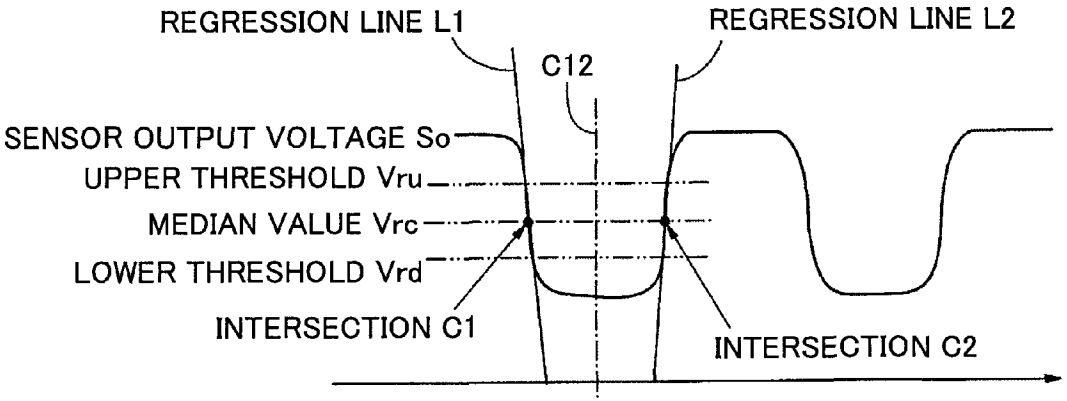
FIGS. 17A and 17B are graphs used to describe a second exemplary position detecting process.
Figure 17B:
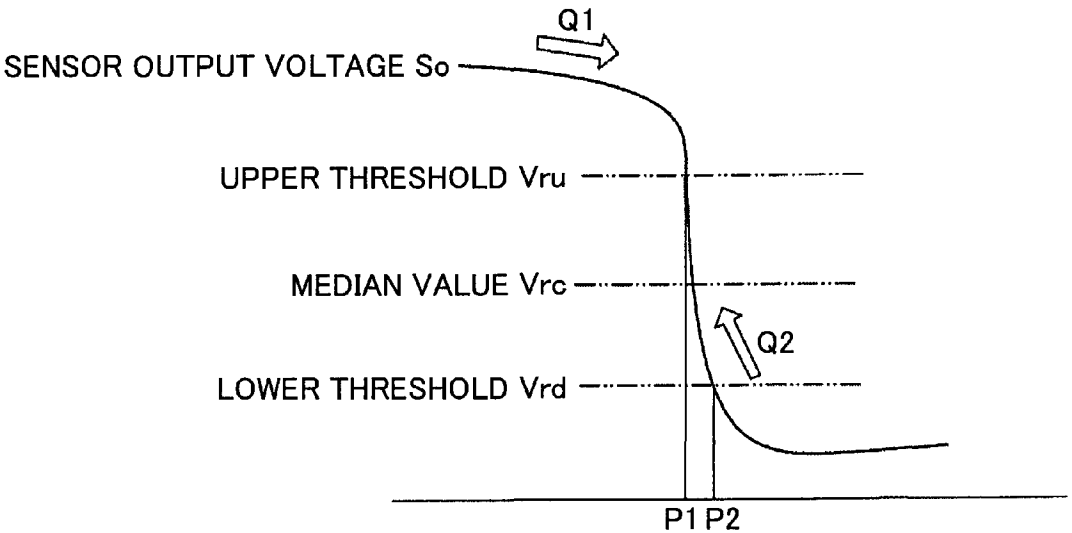

FIGS. 17A and 17B are graphs used to describe a second exemplary position detecting process. In the second exemplary position detecting process, a sensor output voltage So as shown in FIG. 17A is obtained by scanning the line patterns 400*k*1 and 400*k*2 used in the first exemplary position detecting process with the image sensor 401. FIG. 17B is an enlarged view of a falling portion of the sensor output voltage So.

The falling portion of the sensor output voltage So is searched in a direction indicated by an arrow Q1 shown in FIG. 17B to find a point P2 where the sensor output voltage So becomes equal to a lower threshold Vrd, and the found point P2 is stored in a memory. Next, the falling portion of the sensor output voltage So is searched from the point P2 in a direction indicated by an arrow Q2 to find a point P1 where the sensor output voltage So becomes equal to an upper threshold Vru, and the found point P1 is stored in a memory. Next, a regression line L1 is obtained from the sensor output voltage So between the points P1 and P2, and an intersection C1 of the regression line L1 and an median value Vrc between the upper and lower thresholds Vru and Vrd is obtained. Similarly, a regression line L2 is obtained for the rising portion of the sensor output voltage So, and an intersection C2 of the regression line L2 and the median value Vrc between the upper and lower thresholds Vru and Vrd is obtained. Then, a center point between the intersections C1 and C2 is obtained by the formula (C1+C2)/2, and a center line C12 is obtained from the center point. The center line C12 or an intermediate position between the regression lines L1 and L2 can be used as an edge of a line pattern (or a test pattern).

Figure 18:
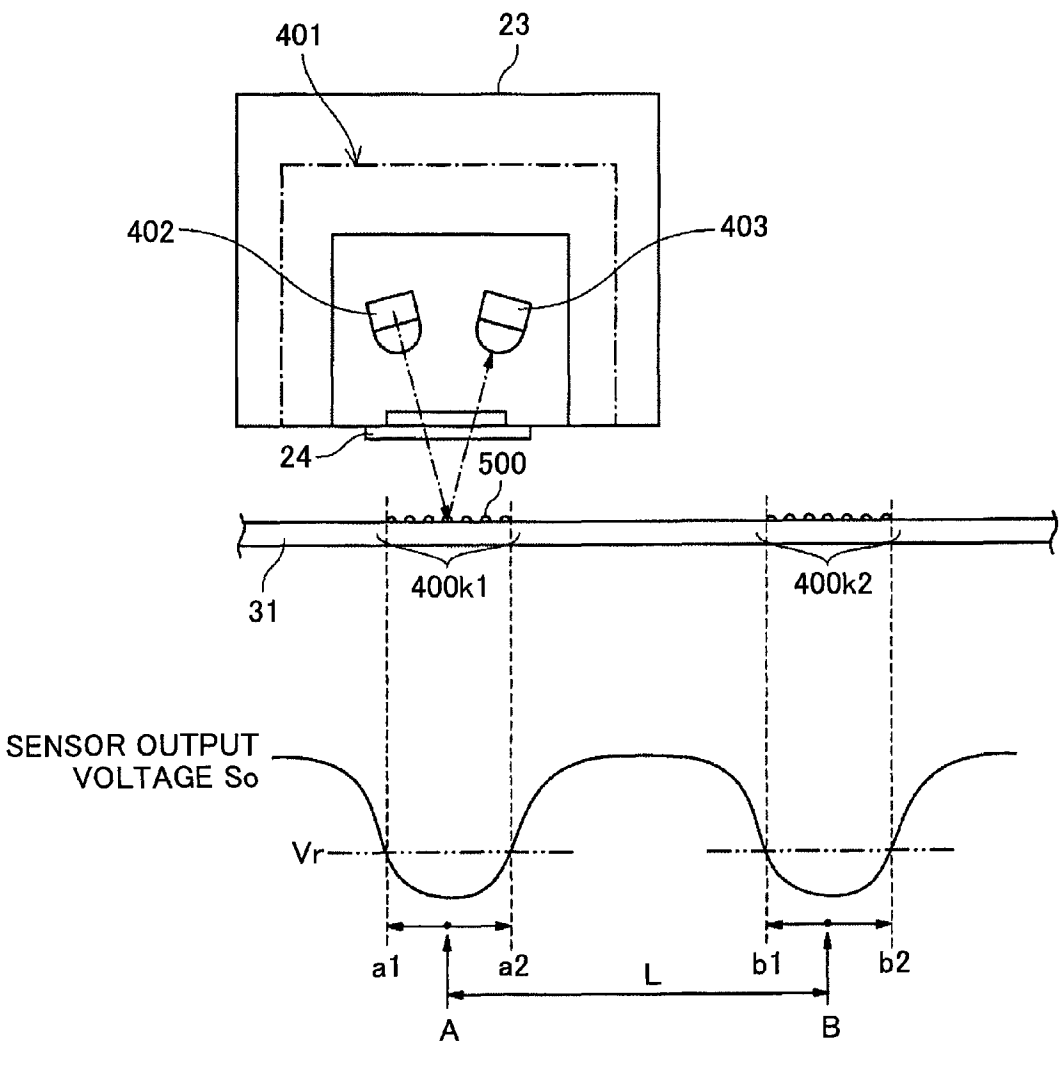
FIG. 18 is a drawing used to describe a third exemplary position detecting process.

FIG. 18 is a drawing used to describe a third exemplary position detecting process. In the third exemplary position detecting process, a sensor output voltage So as shown in FIG. 18(*b*) is obtained by scanning the line patterns 400*k*1 and 400*k*2, which are formed by the recording heads 24*k*1 and 24*k*2 as in the first exemplary position detecting process, with the image sensor 401.

The processing algorithm 526 described above removes harmonic noise from a detection signal of the image sensor 401 using an IIR filter, estimates the quality of the detection signal (determines whether there are incompleteness, instability, and redundancy in the detection signal), detects sloping portions of the detection signal near a threshold Vr, and thereby obtains a regression curve. Next, intersections a1, a2, b1, and b2 between the regression curve and the threshold Vr are obtained (for example, with a position counter implemented by an application specific IC (ASIC)). Then, a center point A between the intersections a1 and a2 and a center point B between the intersections b1 and b2 are obtained, and a distance L between the intermediate points A and B is obtained. Accordingly, the distance L indicates the distance between the line patterns 400*k*1 and 400*k*2.

A difference between the distance L and an optimum distance between the recording heads 24*k*1 and 24*k*2 is obtained by subtracting the distance L from the optimum distance. The difference indicates the amount of positional deviation of liquid droplets. Based on the obtained amount of positional deviation, an adjustment value for adjusting the timing (liquid-jet timing) of jetting liquid droplets from the recording heads 24*k*1 and 24*k*2 is obtained and set in the liquid-jetting control unit 502. The liquid-jetting control unit 502 drives the recording heads 24*k*1 and 24*k*2 at the adjusted liquid-jet timing to adjust the landing positions of liquid droplets.

Next, exemplary arrangements of liquid droplets forming the test pattern 400 are described.

Figure 19:
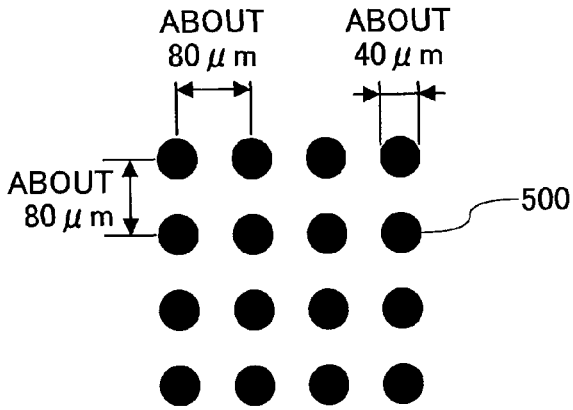
FIG. 19 is a drawing illustrating a first exemplary arrangement of liquid droplets forming a test pattern.

FIG. 19 is a drawing illustrating a first exemplary arrangement of liquid droplets forming the test pattern 400 (or a line pattern 400*a*) where separate liquid droplets 500 are arranged in a grid.

Figure 20A:
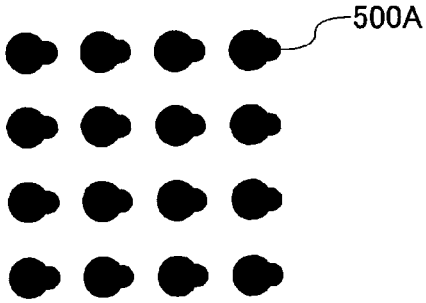
FIGS. 20A and 20B are drawings illustrating second exemplary arrangements of liquid droplets forming a test pattern.
Figure 20B:
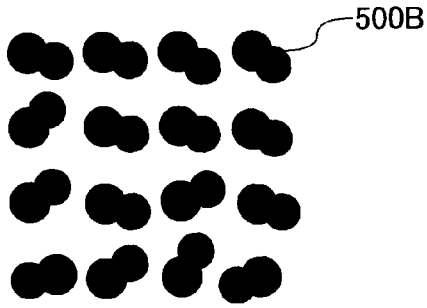

FIGS. 20A and 20B are drawings illustrating second exemplary arrangements of liquid droplets. In FIG. 20A, a larger droplet (primary droplet) and a smaller droplet (secondary droplet) are combined to form a pear-shaped liquid droplet 500A, and separate liquid droplets 500A are arranged in a grid. In FIG. 20B, two droplets of substantially the same size are combined to form a droplet 500B, and separate liquid droplets 500B are arranged in a grid.

Figure 21A:
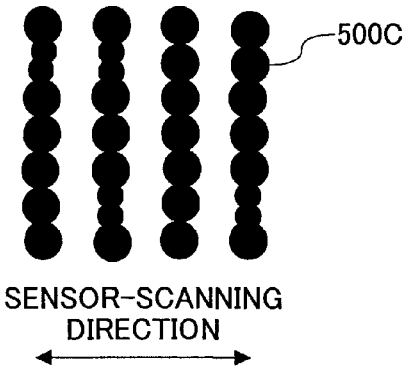
FIGS. 21A and 21B are drawings illustrating third exemplary arrangements of liquid droplets forming a test pattern.
Figure 21B:
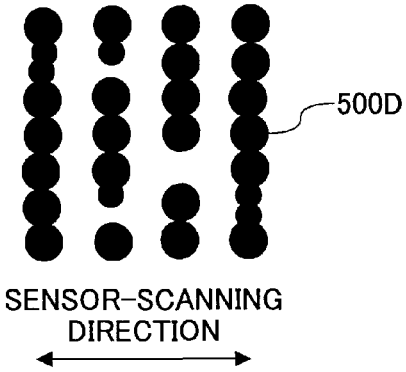

FIGS. 21A and 21B are drawings illustrating third exemplary arrangements of liquid droplets. In FIG. 21A, multiple droplets are arranged in a direction orthogonal to the sensor-scanning direction and combined to form a line-shaped droplet 500C, and multiple line-shaped droplets 500C are arranged in the sensor-scanning direction. In FIG. 21B, each droplet 500D is shaped like the droplet 500C with one or more missing parts (the lengths of the droplets 500C and 500D may be either the same or different), and multiple droplets 500D are arranged in the scanning direction of the image sensor 401.

Figure 22A:
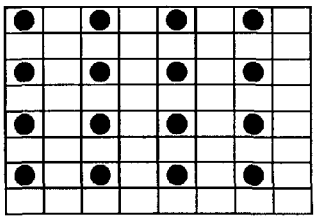
FIGS. 22A through 22C are drawings illustrating other exemplary arrangements of liquid droplets forming a test pattern.
Figure 22B:
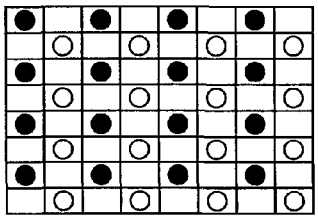
Figure 22C:
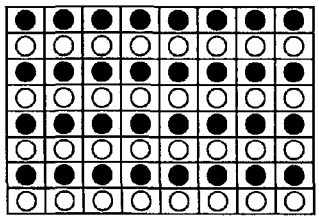

Arrangements of liquid droplets preferable to accurately detect the landing positions are described below with reference to FIGS. 22A through 22C.

First, it is necessary to maintain the proportion of diffusely reflected light in reflected light from the test pattern 400. In other words, it is necessary to jet the liquid droplets 500 onto the conveyor belt 31 (or a target surface) in such a manner that the proportion of diffusely reflected light from the test pattern 400 becomes constant as shown in the middle of FIG. 13. Maintaining the proportion of diffusely reflected light improves reproducibility of the sensor output voltage (or a detection signal) to be processed by the processing algorithm 526, and thereby makes it possible to accurately detect the test pattern 400 (landing positions of liquid droplets) and to accurately adjust landing positions of liquid droplets.

To maintain the proportion of diffusely reflected light from the test pattern 400, it is necessary to keep constant a diffuse reflection area, which is the total area of surfaces (diffuse reflection surfaces) that diffusely reflect light, of liquid droplets. In the example shown in FIG. 22A, separate liquid droplets 500 forming the test pattern 400 are placed in every other dot position. With this arrangement, regularly-arranged (or regularly-spaced) liquid droplets do not clump together, and therefore the diffuse reflection area of the liquid droplets is kept constant. Also, as long as adjacent liquid droplets 500 are separated from each other, the liquid droplets 500 may be arranged in a staggered manner as shown in FIG. 22B or placed in all dot positions as shown in FIG. 22C.

As described above with reference to FIG. 12, liquid droplets dry over time after they are placed on a target surface and the proportion of diffusely reflected light from the liquid droplets changes. Therefore, to improve reproducibility of the sensor output voltage, it is preferable to cause the image sensor 401 to detect specularly reflected light at a predetermined timing after liquid droplets are placed on a target surface.

Further, as long as the proportion of diffusely reflected light is maintained, the test pattern 400 may be composed of regularly-arranged (or regularly-spaced) liquid droplets 500 each formed by two or more liquid droplets as shown in FIGS. 20A through 21B.

Figure 23:
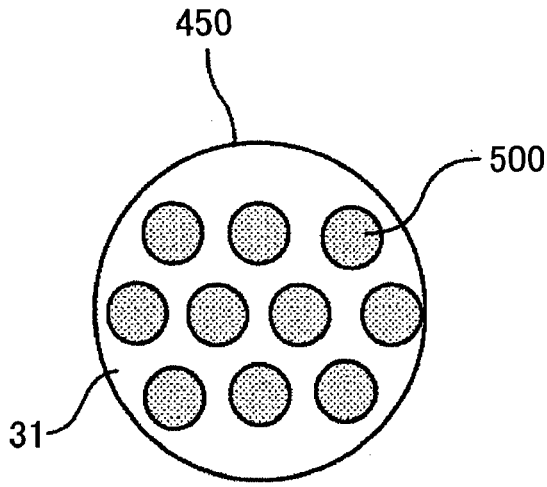
FIG. 23 is a drawing used to describe a contact area of liquid droplets in a detection range.

Meanwhile, to maintain the proportion of diffusely reflected light from the test pattern 400, it is also preferable to keep constant the contact area of the liquid droplets 500 with the conveyor belt 31 in a detection range (detection area) 450 of the image sensor 401. In the example shown in FIG. 23, separate liquid droplets 500 forming the test pattern 400 are placed in every other dot position. In this case, it is possible to make constant the contact area of the liquid droplets 500 with the conveyor belt 31 by jetting the same amount of liquid to form each of the liquid droplets 500. As long as the liquid droplets 500 are separated from each other, the liquid droplets 500 may be arranged in a staggered manner. Also, using a pigment ink in combination with the conveyor belt 31 made of a fluorine resin (e.g., ethylene-tetrafluoroethylene (ETFE)), which is repellent to a pigment ink, makes it easier to keep the contact area constant.

Accordingly, it is possible to more effectively maintain the proportion of diffusely reflected light from a test pattern and improve the reproducibility of a sensor output voltage by maintaining the diffuse reflection area of liquid droplets and by keeping constant the contact area of liquid droplets with a conveyor belt at the same time.

Figure 24:
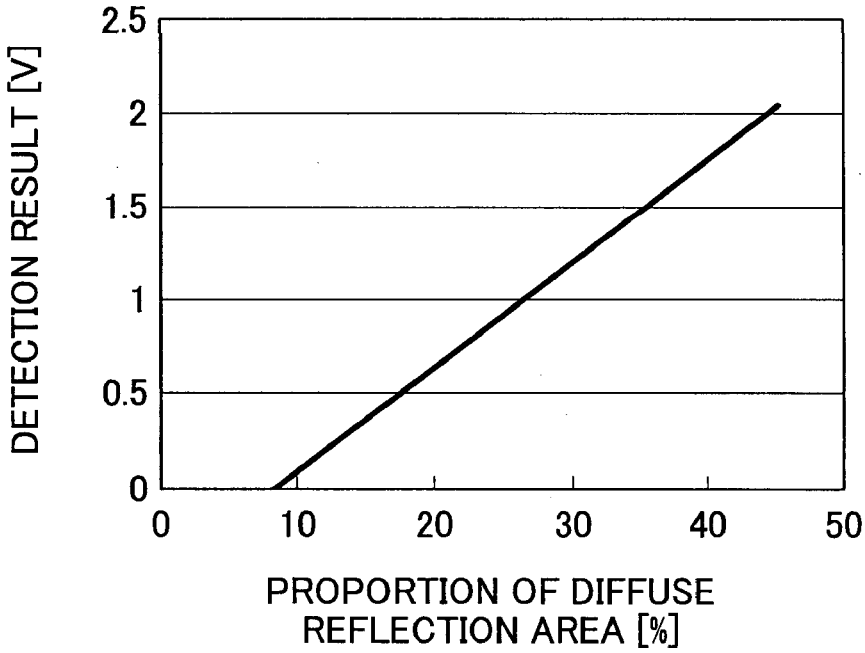
FIG. 24 is a graph showing the relationship obtained by an experiment between the proportion of diffuse reflection area of liquid droplets and a detection result.

It is also important to arrange liquid droplets sufficiently densely to obtain a detection result high enough to determine whether the test pattern 400 is present. FIG. 24 is a graph showing the relationship obtained by an experiment between the proportion of the diffuse reflection area of liquid droplets in the total area of the test pattern 400 and a detection result. As shown in FIG. 24, a sufficient detection result can be obtained when the proportion of the diffuse reflection area in the total area of the test pattern 400 is 10% or larger.

Next, characteristics of liquid droplets forming the test pattern 400 are described in terms of a pattern diffuse reflection rate.

A pattern diffuse reflection rate indicates the proportion of the diffuse reflection area in the detection range (see FIG. 23) of the image sensor 401. A pattern diffuse reflection rate is obtained by the following formula: pattern diffuse reflection rate=diffuse reflection area/detection range area (*detection range area indicates the area of a surface that can be covered by the image sensor 401 at once).

Figure 25:
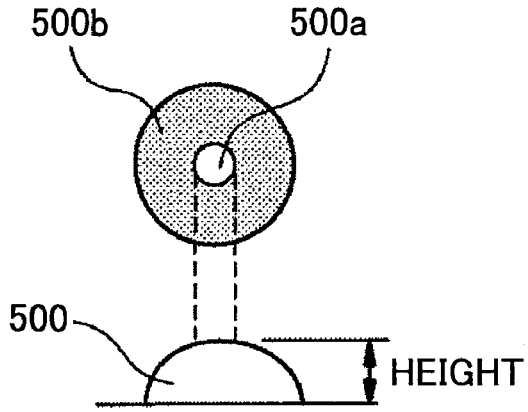
FIG. 25 is a drawing illustrating a liquid droplet and used to describe a pattern diffuse reflection rate.
Figure 26:
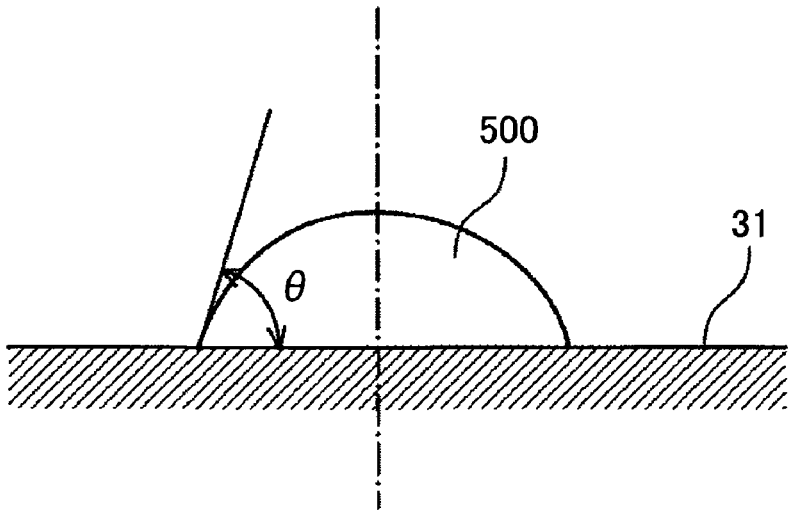
FIG. 26 is a drawing illustrating a contact angle of a liquid droplet.

Assuming that the detection range of the image sensor 401 is constant, the pattern diffuse reflection rate can be increased by increasing the diffuse reflection area. As shown in FIG. 25, when the wettability of the surface of the conveyor belt 31 is low (when the surface has a large contact angle θ (see FIG. 26) with the liquid droplet 500), the liquid droplet 500 on the conveyor belt 31 takes on a hemispherical shape. In this case, a portion 500*a* of the outer surface of the liquid droplet 500 specularly reflects light arriving from a given direction, and a portion 500*b* diffusely reflects the light. The diffuse reflection area of each liquid droplet 500 or a droplet diffuse reflection rate can be increased by jetting the liquid droplet 500 in such a manner that the portion 500*b* becomes large.

The droplet diffuse reflection rate indicates the proportion of the diffuse reflection area (portion 500*b*) of a liquid droplet with respect to the contact area of the liquid droplet with the conveyor belt 31, and can be obtained by the following formula: droplet diffuse reflection rate=diffuse reflection area of droplet/contact area.

Also, it is preferable to use the largest liquid droplets (with the largest droplet volume) available for image formation (or the largest liquid droplets that the recording heads 24 can jet) to form the test pattern 400. In other words, it is preferable to form the test pattern 400 in a print mode that uses largest liquid droplets. Using the largest liquid droplet makes it possible to increase the height of the liquid droplet 500 shown in FIG. 25 and thereby to increase the droplet diffuse reflection rate.

Meanwhile, the composition of ink varies depending on its color (e.g., cyan, magenta, yellow, or black), and the shape of the liquid (ink) droplet 500 may vary depending on the composition of ink used. Therefore, to effectively increase the droplet diffuse reflection rate, it is more preferable to change the size (or volume) of ink droplets used to form the test pattern 400 depending on the color of the ink.

In a landing position adjusting process described above, a test pattern is formed on a conveyor belt by jetting liquid droplets with a liquid-jetting unit, the test pattern is illuminated by a light-emitting element, specularly reflected light from the test pattern is received by a light-receiving element, and landing positions of the liquid droplets are adjusted based on a low-level portion of a detection signal from the light-receiving element. In this process, it is possible to improve the detection results of the light-receiving element (a sensor) by controlling the liquid-jetting unit so as to maximize the pattern diffuse reflection rate of liquid droplets forming the test pattern and thereby to accurately detect and adjust the landing positions of the liquid droplets.

The pattern diffuse reflection rate can be increased by controlling the liquid-jetting unit so as to increase the diffuse reflection area of each liquid droplet or the droplet diffuse reflection rate. The droplet diffuse reflection rate can be increased, for example, by (1) Controlling the amount of liquid jetted to form a liquid droplet (or controlling the volume of a liquid droplet);

(2) Controlling the amount of liquid jetted to form a liquid droplet depending on the color of the liquid;

(3) Reducing the time lag between formation of a test pattern (or jetting liquid droplets) and scanning of the test pattern by light-emitting and light-receiving elements, and performing the formation and scanning of the test pattern at substantially the same time in one operation;

(4) Selecting materials of a conveyor belt and a liquid (or ink) such that the conveyor belt has a large contact angle with a liquid droplet;

(5) Using liquid droplets that take on a circular shape or a pear shape on a conveyor belt; and (6) Maximizing the area occupied by substantially separate liquid droplets in the detection range of an image sensor (light-emitting and light-receiving elements) by, for example, arranging liquid droplets such that the gaps between them are minimized.

Next, a method of forming and detecting the test pattern 400 is described. As described above, the shape of a liquid droplet changes because it dries over time after it is jetted onto the belt surface. Therefore, the proportion of specularly reflected light from the test pattern 400 increases as time passes and the sensor output voltage from the image sensor 401 increases.

To obviate this problem and to accurately detect landing positions of liquid droplets, it is preferable to scan the test pattern 400 with the image sensor 401 just after the test pattern 400 is formed. This objective can be achieved, for example, by forming the test pattern 400 at a test-pattern forming speed and scanning the test pattern 400 as it is formed at a scanning speed that is substantially the same as the test-pattern forming speed. In this case, it is necessary to dispose the image sensor 401 upstream of the carriage 23 with respect to the direction in which the carriage 23 is moved to form the test pattern 400. With this configuration, the test pattern 400 must be formed by moving the carriage 23 in one direction only (either by the forward scan or the backward scan).

The above objective can also be achieved with a configuration where the test pattern 400 is formed at a test-pattern forming speed by both the forward and backward scans of the carriage 23 and is scanned by the image sensor 401 at a scanning speed different from the test-pattern forming speed without turning the conveyor belt 31. In this case, it is necessary to dispose the image sensor 401 so that it is positioned in an area where the test pattern 400 is formed.

Exemplary composition of pigment inks that can increase the droplet diffuse reflection rate when used in combination with the conveyor belt 31 made of a fluorine resin (e.g., ethylene-tetrafluoroethylene (ETFE)) is described below. For example, pigment inks containing materials as described below are preferably used.

Examples of preferable organic pigments include azo series, phthalocyanine series, anthraquinone series, quinacridone series, dioxazine series, indigo series, thioindigo series, perylene series, isoindolinon series, aniline black, azomethine series, rhodamine B lake pigment, and carbon black.

Examples of preferable inorganic pigments include iron oxide, titanium oxide, calcium carbonate, barium sulfate, aluminum hydroxide, barium yellow, iron blue, cadmium red, chrome-yellow, and metallic flake.

The particle diameter of a pigment is preferably between 0.01 and 0.30 μm. If the particle diameter is smaller than 0.01 μm and is close to that of dye particles, the pigment shows low light resistance and causes feathering. If the particle diameter is larger than 0.30 μm, the pigment particles may clog nozzles or filters in an image forming apparatus and thereby reduces ink-jetting performance.

Preferably, carbon black for a black pigment ink is made by a furnace method or a channel method, and has a primary particle diameter of 15-40 nm (millimicrons), a BET specific surface area of 50-300 $m^2/g$, a DBP oil absorption of 40-150 ml/100 g, a volatile matter content of 0.5-10%, and a pH value of 2-9. Examples of preferable carbon blacks include No. 2300, No. 900, MCF-88, No. 33, No. 40, No. 45, No. 52, MA7, MA8, MA100, No. 2200B (Mitsubishi Chemical Corporation); Raven 700, Raven 5750, Raven 5250, Raven 5000, Raven 3500, Raven 1255 (Columbian Chemicals Company); Regal 400R, Regal 330R, Regal 660R, MogulL, Monarch 700, Monarch 800, Monarch 880, Monarch 900, Monarch 1000, Monarch 1100, Monarch 1300, Monarch 1400 (Cabot Corporation); Color black FW1, Color black FW2, Color black FW2V, Color black FW18, Color black FW200, Color black S150, Color black S160, Color black S170, Printex 35, Printex U, Printex V, Printex 140U, Printex 140V, Special black 6, Special black 5, Special black 4A, and Special black 4 (Degussa).

Examples of preferable color pigments are listed below.

Examples of color organic pigments include azo series, phthalocyanine series, anthraquinone series, quinacridone series, dioxazine series, indigo series, thioindigo series, perylene series, isoindolinon series, aniline black, azomethine series, rhodamine B lake pigment, and carbon black. Examples of color inorganic pigments include iron oxide, titanium oxide, calcium carbonate, barium sulfate, aluminum hydroxide, barium yellow, iron blue, cadmium red, chrome yellow, and metallic flake.

More specifically, pigments as described below may be used for each color.

The following pigments may be used for yellow ink: CI pigment yellow 1, 2, 3, 12, 13, 14, 16, 17, 73, 74, 75, 83, 93, 95, 97, 98, 114, 128, 129, 151, and 154.

The following pigments may be used for magenta ink: CI pigment red 5, 7, 12, 48 (Ca), 48 (Mn), 57 (Ca), 57:1, 112, 123, 168, 184, and 202.

The following pigments may be used for cyan ink: CI pigment blue 1, 2, 3, 15:3, 15:34, 16, 22, and 60; and CI vat blue 4 and 60.

An inkjet recording liquid may be prepared by dispersing one of the above pigments in an aqueous medium using a polymer dispersant or a surfactant. As a dispersant for dispersing organic pigment powder, a water-soluble resin or a water-soluble surfactant may be used.

Examples of preferable water-soluble resins include a block copolymer, a random copolymer, and salt composed of two or more monomers selected from a group including styrene, styrene derivative, vinylnaphthalene derivative, aliphatic alcohol ester of α,β-ethylene unsaturated carboxylic acid, acrylic acid, acrylic acid derivative, maleic acid, maleic acid derivative, itaconic acid, itaconic acid derivative, fumarate, and fumarate derivative. The above water-soluble resins are alkali-soluble resins that are soluble in water solution of a base. A water-soluble resin with a weight-average molecular weight of 3000-20000 is easily dispersible, is suitable to prepare a dispersion liquid with a low viscosity, and is therefore especially preferable for an inkjet recording liquid.

As a water-soluble surfactant, an anionic surfactant, a cationic surfactant, an amphoteric surfactant, or a nonionic surfactant may be used. Examples of anionic surfactants include higher fatty acid salt, alkyl sulfate, alkyl ether sulfate, alkyl ester sulfate, alkyl arylether sulfate, alkyl sulfonate, sulfosuccinate, alkyl allyl and alkyl naphthalene sulfonate, alkyl phosphate, polyoxyethylene alkyl ether phosphate ester salt, and alkyl allyl ether phosphate. Examples of cationic surfactants include alkyl amine salt, dialkyl amine salt, tetraalkyl ammonium salt, benzalkonium salt, alkyl pyridinium salt, and imidazolinium salt. Examples of amphoteric surfactants include dimethyl alkyl lauryl betaine, alkyl glycine, alkyldi (aminoethyl) glycine, and imidazolinium betaine. Examples of nonionic surfactants include polyoxyethylene alkyl ether, polyoxyethylene alkyl allyl ether, polyoxyethylene polyoxypropylene glycol, glycerin ester, sorbitan ester, sucrose esters, polyoxyethylene ether of glycerin ester, polyoxyethylene ether of sorbitan ester, polyoxyethylene ether of sorbitol ester, fatty acid alkanolamide, polyoxyethylene fatty acid amide, amine oxide, and polyoxyethylene alkylamine.

A pigment may be microencapsulated by coating it with a resin having a hydrophilic radical. Microencapsulating gives the pigment dispersibility.

Any of conventional methods may be used to microencapsulate a water-insoluble pigment by coating it with an organic polymer. Such conventional methods include chemical manufacturing methods, physical manufacturing methods, physicochemical manufacturing methods, and mechanical manufacturing methods. For example, microencapsulation methods (1) through (10) described below may be used.

(1) Interface polymerization method: two types of monomers or two types of reactants are dissolved in a disperse phase and a continuous phase separately, and are caused to react with each other at the interface between the two phases and thereby to form wall membranes.

(2) In-situ polymerization method: aqueous or gaseous monomers and catalysts or two types of reactive substances are supplied from either the continuous phase side or the nuclear particle side, and are caused to react with each other and thereby to form wall membranes.

(3) In-liquid curing coating method: wall membranes are formed by insolubilizing drops of polymer solution containing core material particles in a liquid using a curing agent.

(4) Coacervation (phase separation) method: wall membranes are formed by separating a polymer dispersed liquid, where core material particles are dispersed, into coacervate (dense phase) with a high polymer concentration and a dilute phase.

(5) In-liquid drying method: a core material is dispersed in a solution of a wall membrane material, the core material dispersed liquid is put in another liquid, in which the continuous phase of the core material dispersed liquid do not blend, to form a multiple emulsion, then the medium in which the wall membrane material is dissolved is gradually removed to form wall membranes.

(6) Melting-dispersion-cooling process: a wall membrane material that melts when heated and solidifies at normal temperature is liquefied by heating, core material particles are dispersed in the resulting liquid, and then the liquid is changed into fine particles and cooled to form wall membranes.

(7) In-air suspension coating method: powder of core material particles is suspended in air using a fluid bed, and a coating liquid used as a wall membrane material is sprayed in the air to form wall membranes.

(8) Spray drying method: an undiluted encapsulation liquid is sprayed and brought into contact with heated air to evaporate its volatile matter content and thereby to form wall membranes.

(9) Acidification deposition method: an organic polymer, at least a part of the anionic groups of which is neutralized with a basic compound to give it water solubility, is kneaded together with a colorant in an aqueous medium, neutralized or acidified using an acidic compound so that the organic polymer is deposited and fixed to the colorant, and then neutralized again and dispersed.

(10) Phase inversion emulsification: water is put in an organic solvent phase made of a mixture of a colorant and an anionic organic polymer having water dispersibility, or the organic solvent phase is put in water.

As a material for the wall membrane of a microcapsule, the following organic polymers (resins) may be used: polyamide, polyurethane, polyester, polyurea, epoxy resin, polycarbonate, urea resin, melamine resin, phenolic resin, polysaccharide, gelatin, acacia gum, dextran, casein, protein, natural rubber, carboxypolymethylene, polyvinyl alcohol, polyvinyl pyrrolidone, polyvinyl acetate, polyvinyl chloride, polyvinylidene chloride, cellulose, ethyl cellulose, methyl cellulose, cellulose nitrate, hydroxyethyl cellulose, cellulose acetate, polyethylene, polystyrene, polymer or copolymer of (metha)acrylic acid, polymer or copolymer of (metha)acrylic acid ester, (metha)acrylic acid-(metha)acrylic acid ester copolymer, styrene-(metha)acrylic acid copolymer, styrene-maleic acid copolymer, alginic acid soda, fatty acid, paraffin, bees wax, water wax, hardened tallow, carnauba wax, and albumin.

Among them, organic polymers having an anionic group such as a carboxylic group or a sulfonic group are preferable. Also, nonionic organic polymers such as polyvinyl alcohol, polyethylene glycol monomethacrylate, polypropylene glycol monomethacrylate, methoxypolyethylene glycol monomethacrylate, (co)polymers of the preceding substances, and cationic ring-opening polymer of 2-oxazoline may be used. Especially, completely saponified polyvinyl alcohol is preferable because of its low water solubility (it is easily soluble in hot water but not in cold water).

The amount of an organic polymer in a wall membrane material for microencapsulation is preferably 1-20 weight percent of a water-insoluble colorant such as an organic pigment or carbon black. Keeping the amount of organic polymer within the above range prevents the organic polymer coating the surface of a pigment from inhibiting the color development of the pigment. When the amount of an organic polymer is less than 1 weight percent, the effect of encapsulation becomes insufficient. When the amount of an organic polymer is more than 20 weight percent, the color development of a pigment is inhibited greatly. With other factors also taken into account, the amount of an organic polymer is more preferably 5-10 weight percent of a water-insoluble colorant.

With the amount of an organic polymer kept within the above range, a part of a colorant is substantially left uncoated or exposed, and therefore the color development of the colorant is not inhibited. From a different point of view, the colorant is not exposed but substantially coated, and therefore a sufficient encapsulation effect can be obtained. The number average molecular weight of an organic polymer is preferably 2,000 or more to efficiently perform encapsulation. "Substantially left uncoated or exposed" in this case means that a part of a colorant is intentionally left uncoated and does not include cases where a part of a colorant is exposed because of a defect such as a pinhole or a crack in the coating.

Using a self-dispersing organic pigment or a self-dispersing carbon black as a colorant gives high dispersibility to a microencapsulated pigment even when the content of an organic polymer in the capsule is relatively low. Therefore, a self-dispersing organic pigment and a self-dispersing carbon black are preferable as colorants to give sufficient preservation stability to an ink.

Also, it is preferable to select an appropriate organic polymer depending on the method of microencapsulation. For the interface polymerization method, for example, polyester, polyamide, polyurethane, polyvinyl pyrrolidone, and epoxy resin are preferable. For the in-situ polymerization method, polymer or copolymer of (metha)acrylic acid ester, (metha) acrylic acid-(metha)acrylic acid ester copolymer, styrene-(metha)acrylic acid copolymer, polyvinyl chloride, polyvinylidene chloride, and polyamide are preferable. For the in-liquid curing coating method, alginic acid soda, polyvinyl alcohol, gelatin, albumin, and epoxy resin are preferable. For the coacervation method, gelatin, cellulose, and casein are preferable. Other microencapsulation methods may also be used to obtain a fine, uniform microencapsulated pigment.

For the phase inversion emulsification method and the acidification deposition method, anionic organic polymers may be used. In the phase inversion emulsification method, one of the following is preferably used as an organic solvent phase: a mixture of an anionic organic polymer having self-dispersibility or solubility in water and a colorant such as a self-dispersing organic pigment or a self-dispersing carbon black; and a mixture of a colorant such as a self-dispersing organic pigment or a self-dispersing carbon black, a curing agent, and an anionic organic polymer. In this method, water is put in the organic solvent phase or the organic solvent phase is put in water. The organic solvent phase self-disperses (inversion emulsification) and the colorant is microencapsulated. In the phase inversion emulsification method, a recording liquid vehicle or additives may also be mixed in the organic solvent phase. Especially, mixing a recording liquid medium is preferable since it makes it possible to directly produce a dispersion liquid for a recording liquid.

In the acidification deposition method, a part or all of the anionic groups of an organic polymer are neutralized with a basic compound; the organic polymer is kneaded together with a colorant such as a self-dispersing organic pigment or a self-dispersing carbon black in an aqueous medium; and the pH of the organic polymer is neutralized or acidified using an acidic compound so that the organic polymer is deposited and fixed to the colorant. Then, a part or all of the anionic groups of the resulting hydrated cake are neutralized with a basic compound so that the colorant is microencapsulated. As a result, an aqueous dispersion liquid containing fine microencapsulated anionic pigment is produced.

As a solvent in the above described microencapsulation methods, the following substances may be used: an alkyl alcohol such as methanol, ethanol, propanol, or butanol; an aromatic hydrocarbon such as benzole, toluole, or xylole; an ester such as methyl acetate, ethyl acetate, or butyl acetate; a chlorinated hydrocarbon such as chloroform or ethylene dichloride; a ketone such as acetone or methyl isobutyl ketone; an ether such as tetrahydrofuran or dioxane; and a cellosolve such as methyl cellosolve or butyl cellosolve. Microcapsules prepared as described above are separated from the solvent by centrifugation or filtration. The separated microcapsules are stirred together with water and a solvent to form a recording liquid. The average particle diameter of a microencapsulated pigment prepared as described above is preferably between 50 and 180 nm.

Next, block patterns (basic patterns) constituting the test pattern 400 are described with reference to FIGS. 27A through 27D. Each of the block patterns is composed of line patterns and used as a minimum unit for detecting the positional deviation of liquid droplets. In a method of adjusting landing positions of liquid droplets according to an embodiment of the present invention, a reference line pattern is formed along the sub-scanning direction (paper-conveying direction) of a conveyor belt with a reference recording head (or color), and similar line patterns are formed with other recording heads (or colors) at intervals in a direction orthogonal to the sub-scanning direction. The positional deviation of liquid droplets is detected based on the distance between the reference line pattern (or the reference recording head) and each of other line patterns (or other recording heads).

Figure 27A:
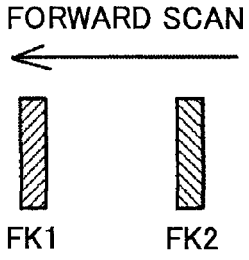
FIGS. 27A through 27D are drawings illustrating block patterns.
Figure 27C:
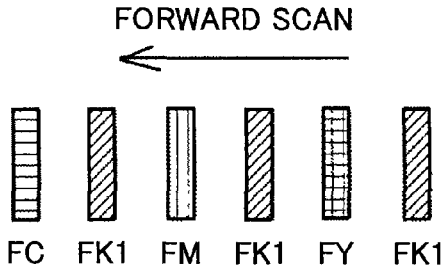
Figure 27B:
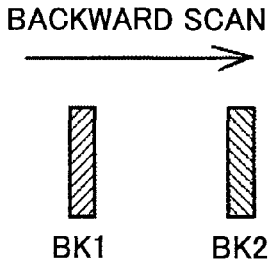
Figure 27D:
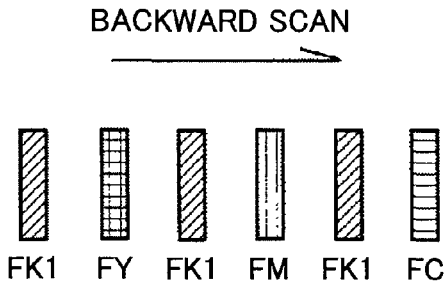

FIG. 27A shows a first block pattern composed of a line pattern FK1 formed by the recording head 24*k*1 and a line pattern FK2 formed by the recording head 24*k*2 during the forward scan (a first scan) of the carriage 23. With the first block pattern, positional deviation of the line pattern FK2 is detected with reference to the line pattern FK1. FIG. 27B shows a second block pattern composed of a line pattern BK1 formed by the recording head 24*k*1 and a line pattern BK2 formed by the recording head 24*k*2 during the backward scan (a second scan). With the second block pattern, positional deviation of the line pattern BK2 is detected with reference to the line pattern BK1. FIG. 27C shows a third block pattern composed of line patterns FK1 formed by the recording head 24*k*1 and line patterns FC, FM, and FY (cyan, magenta, and yellow) formed by the corresponding recording heads 25*c*, 24*m*, and 24*y* during the forward scan (a third scan). With the third block pattern, respective positional deviation of the line patterns FC, FM, and FY is detected with reference to the corresponding line patterns FK1. FIG. 27D shows a fourth block pattern composed of line patterns FK1 formed by the recording head 24*k*1 and line patterns FC, FM, and FY (cyan, magenta, and yellow) formed by the corresponding recording heads 25*c*, 24*m*, and 24*y* during the backward scan (a fourth scan). With the fourth block pattern, respective positional deviation of the line patterns FC, FM, and FY is detected with reference to the corresponding line patterns FK1. Various test patterns can be formed by combining the four block patterns described above.

An exemplary monochrome line misalignment test pattern and exemplary color misalignment test patterns composed of the above block patterns are described below with reference to FIGS. 28, 29A, and 29B.

Figure 28:
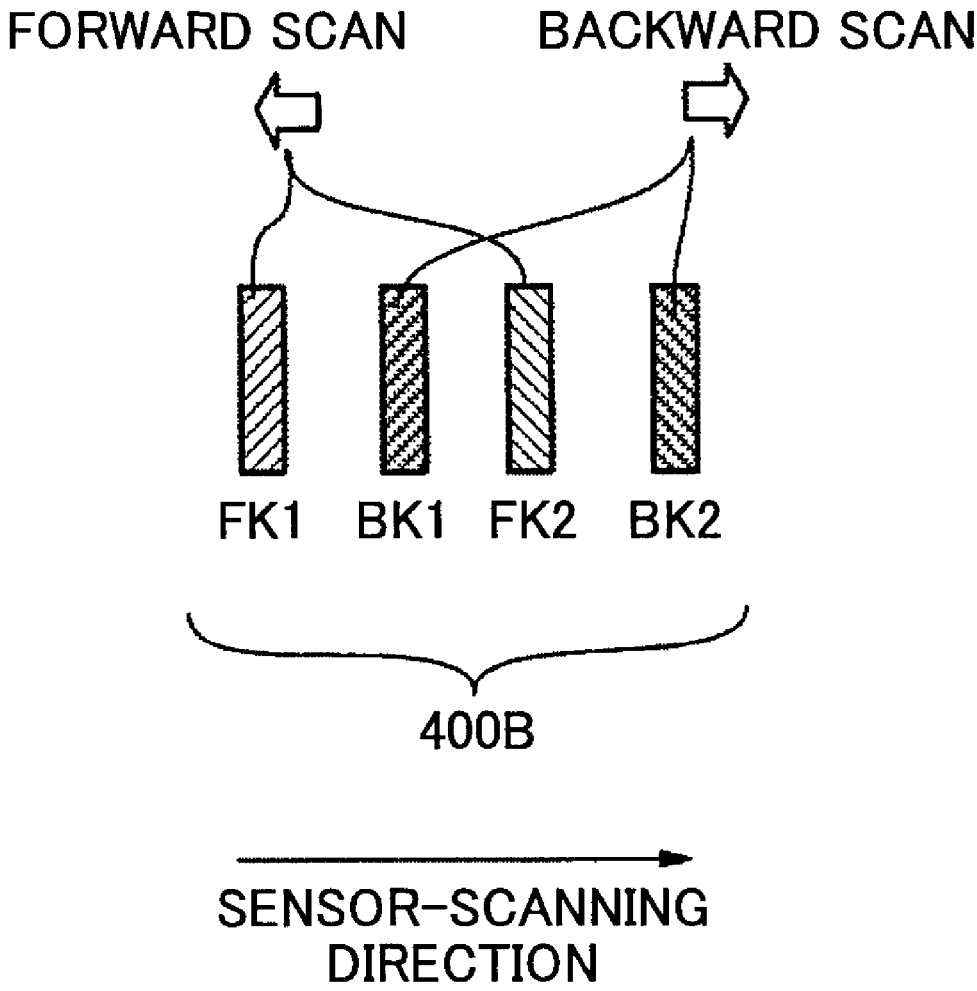
FIG. 28 is a drawing illustrating a line misalignment test pattern.

FIG. 28 shows a line misalignment test pattern 400B including a line pattern FK1 formed by the forward scan, a line pattern BK1 formed by the backward scan, a line pattern FK2 formed by the forward scan, and a line pattern BK2 formed by the backward scan. The line patterns BK1, FK2, and BK2 are formed at predetermined distances from the line pattern FK1. With the line misalignment test pattern 400B, positional deviation of the line patterns BK1, FK2, and BK2 can be detected with reference to the position of the line pattern FK1. In this example, it is assumed that the line misalignment test pattern 400B is scanned by the image sensor 401 in one direction only.

Figure 29A:
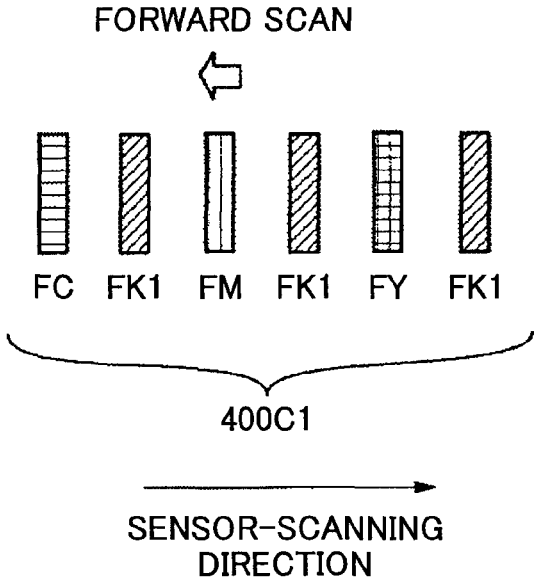
FIGS. 29A and 29B are drawings illustrating color misalignment test patterns.
Figure 29B:
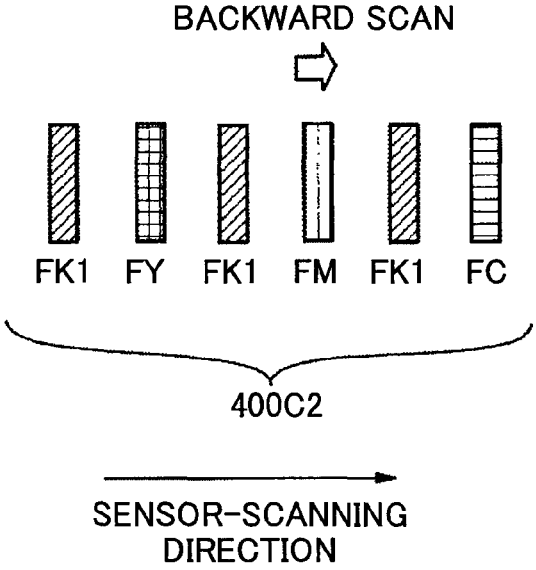

FIGS. 29A and 29B show a color misalignment test pattern 400C1 and a color misalignment test pattern 400C2, respectively. Each of the color misalignment test patterns 400C1 and 400C2 includes line patterns FK1 and color line patterns FY, FM, and FC formed at predetermined distances from the corresponding line patterns FK1. With the color misalignment test patterns 400C1 and 400C2, positional deviation of the line patterns FY, FM, and FC can be detected with reference to the positions of the corresponding line patterns FK1. In this example, it is assumed that each of the color misalignment test patterns 400C1 and 400C2 is scanned by the image sensor 401 in one direction only.

Next, an exemplary arrangement of test patterns on a conveyor belt is described with reference to FIG. 30.

Here, a direction of movement of the carriage 23 from the back side toward the front side of the image forming apparatus 200 shown in FIG. 2 is called a forward direction and a direction from the front side toward the back side is called a backward direction. Also, it is assumed that the recording heads 24*c*, 24*k*1, 24*k*2, 24*m*, and 24*y* are arranged in the forward direction in the order mentioned.

Figure 30:
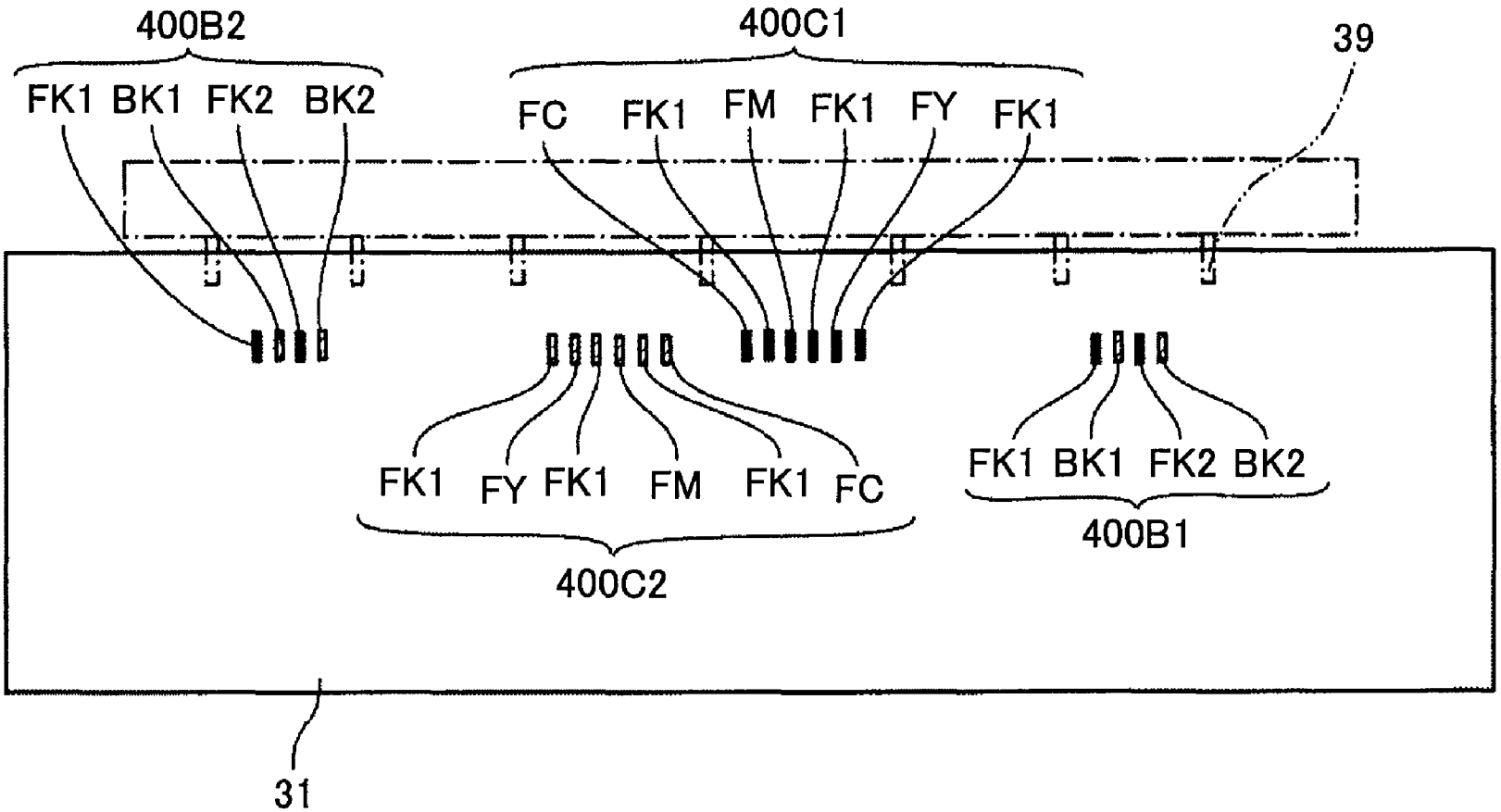
FIG. 30 is a drawing illustrating an exemplary arrangement of test patterns on a conveyor belt.

In FIG. 30, line misalignment test patterns 400B1 and 400B2 are formed near the corresponding sides of the conveyor belt 31, and color misalignment test patterns 400C1 and 400C2 are formed approximately in the middle of the conveyor belt 31. In other words, in this example, test patterns are formed within a printing area of the conveyor belt 31 and arranged in a direction orthogonal to the sub-scanning direction. Also, the test patterns are formed in areas on the conveyor belt 31 other than those where the belt surface is rough (e.g., areas where the separating claws 39, which separate a recording medium from the conveyor belt 31, are in contact with the belt surface).

Each of the test patterns 400B1, 400B2, 400C1, and 400C2 is scanned multiple times by the image sensor 401 just after it is formed. The image sensor 401 scans each test pattern multiple times either in one direction or in both directions.

An exemplary process of adjusting landing positions of liquid droplets (landing position adjusting process) performed by the main control unit 310 according to an embodiment of the present invention is described below with reference to FIG. 31.

A landing position adjusting process is performed, for example, when cleaning K1 or K2 of the recording head 24*k*1 or 24*k*2, which uses black ink, is performed, when cleaning (after-unused-period cleaning) of the recording heads 24 is performed after the image forming apparatus 200 is unused for a long time, and when the variation of the environmental temperature exceeds a predetermined value.

Figure 31:
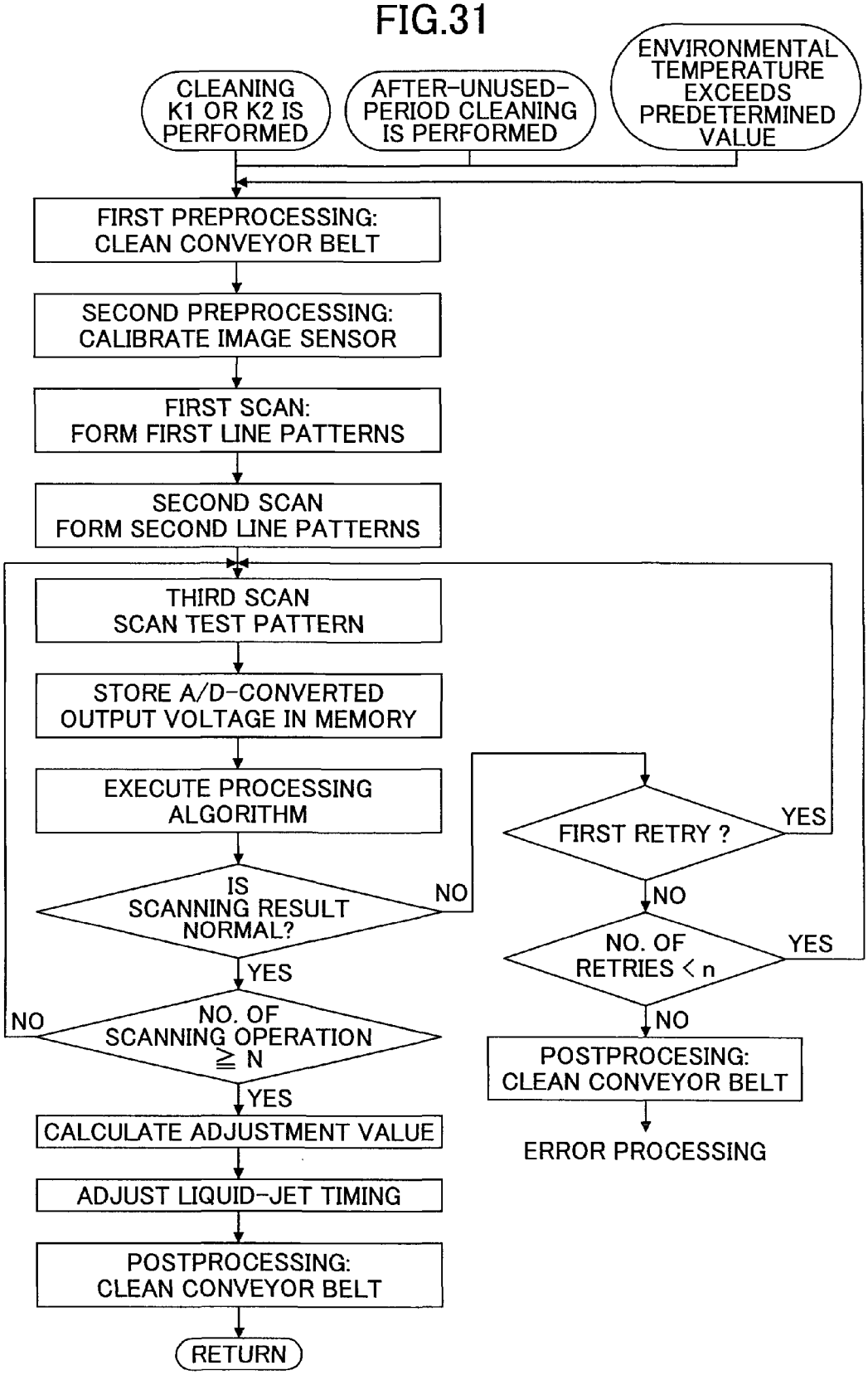
FIG. 31 is a flowchart showing an exemplary process of adjusting landing positions of liquid droplets.

First, as shown in FIG. 31, cleaning of the conveyor belt 31 is performed as first preprocessing. Next, calibration of the image sensor 401 (light-emitting element 402 and light-receiving element 403) is performed as second preprocessing so that a constant sensor output voltage is obtained from the light-emitting element 402 throughout the surface of the conveyor belt 31.

Then, first line patterns are formed by moving the carriage 23 in the forward direction (first scan), and second line patterns are formed by moving the carriage 23 in the backward direction (second scan). The first line patterns indicate line patterns formed by the forward scan (e.g., line patterns in FIG. 30 with F in their reference numbers), and the second line patterns indicate line patterns formed by the backward scan (e.g., line patterns in FIG. 30 with B in their reference numbers). The first line patterns and the second line patterns constitute the test pattern 400.

The test pattern 400 is scanned by moving the carriage 23 in the forward direction (third scan) while emitting light from the light-emitting element 402 of the image sensor 401. The sensor output voltage from the light-receiving element 403 of the image sensor 401 is converted from analog to digital, and stored in a memory.

Then, the processing algorithm 526 is executed by the CPU 301 to calculate the amount of positional deviation of liquid droplets. For example, a difference in landing positions of liquid droplets formed in the forward scan and the backward scan, and positional deviation of color liquid droplets (or color line patters) are calculated.

More specifically, reference line patterns are formed by the forward and backward scans using a reference recording head (or color) along the sub-scanning direction of the conveyor belt 31, and similar line patterns are formed at intervals using other recording heads. The line patterns (or the test pattern 400) are scanned to obtain a sensor output voltage. Based on the sensor output voltage, the processing algorithm 526 calculates center points (or center lines) of the line patterns, obtains distances between the line patterns, compares the obtained distances with optimal distances between the line patterns, and thereby obtains the amounts of positional deviation of liquid droplets (or line patterns). In this embodiment, as described above, a linear encoder is used to detect the position of the carriage 23. This makes it possible to obtain an accurate distance between line patterns by using positions of the carriage 23 at the time when liquid droplets are detected as coordinates of the liquid droplets.

Referring back to FIG. 31, after the execution of the processing algorithm 526, the main control unit 310 determines whether the scanning result from the image sensor 401 is normal. If the scanning result is normal, the main control unit 310 determines whether scanning the test pattern 400 (pattern scanning operation) has been performed N times. If No, the main control unit 310 returns to the step of scanning the test pattern 400 (the third scan). Thus, in this example, the pattern scanning operation is performed in the forward direction N times. After the pattern scanning operation is performed N times, an adjustment value for adjusting the liquid-jet timing is calculated based on the amount of positional deviation obtained by adjusting a forward-backward difference, which is a difference in landing positions of liquid droplets formed in the forward scan and the backward scan of the carriage 23, by the thickness of paper (or a recording medium). Then, the liquid-jet timing is adjusted based on the adjustment value. After adjusting the liquid-jet timing, cleaning of the surface of the conveyor belt 31 is performed as postprocessing.

If the scanning result from the image sensor 401 is abnormal, the main control unit 310 determines whether the retry is the first time. If the retry is the first time, the process returns to the step of scanning the test pattern 400. If the retry is not the first time, the main control unit 310 determines whether the number of retries is smaller than a predetermined number "n". If the number of retries is smaller than "n", the process returns to the first preprocessing. If the number of retries is equal to or larger than "n", the main control unit 310 performs cleaning of the conveyor belt 31 as postprocessing, and then performs error processing.

As described above, an embodiment of the present invention provides a liquid-jet device that forms a test pattern composed of separate liquid droplets on a water-repellent part, illuminates the test pattern, detects (or scans) the test pattern based on specularly reflected light from the test pattern, and adjusts landing positions of liquid droplets based on the detection result (scanning result). This configuration makes it possible to accurately detect landing positions of liquid droplets with a simple mechanism and thereby to accurately adjust landing positions of the liquid droplets.

Another embodiment of the present invention provides an image forming apparatus that includes a liquid-jet device configured as described above and that can form a high-quality image by accurately jetting liquid droplets.

Figure 32:
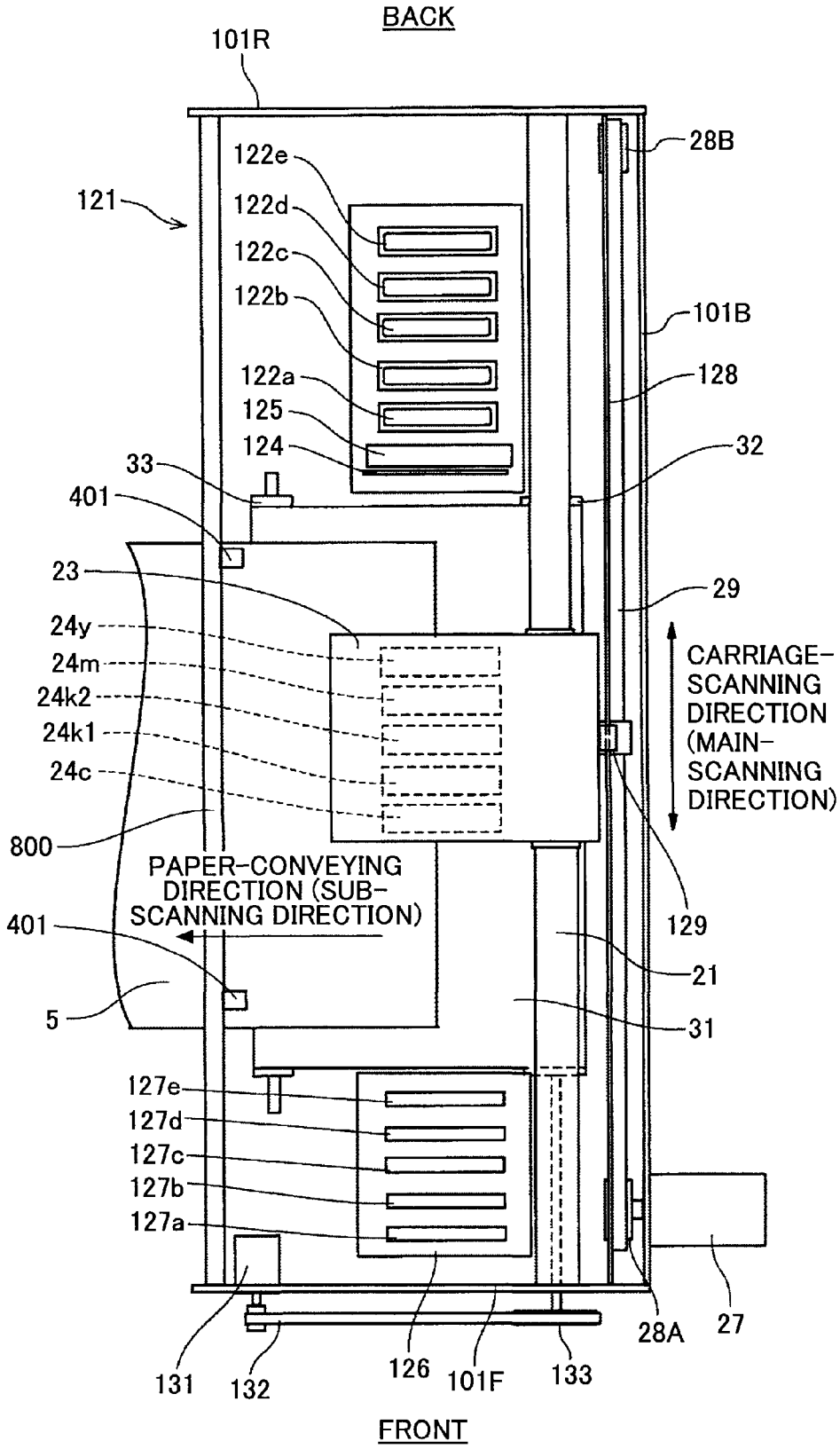
FIG. 32 is a plan view of an image forming unit and a paper conveying unit according to a second embodiment of the present invention.

A second embodiment of the present invention is described below with reference to FIG. 32.

According to the second embodiment, the image forming unit 2 of the image forming apparatus 200 includes two image sensors 401 attached to a sensor support 800 disposed between the front board 101F and the rear board 101R. This configuration makes it possible to scan the test pattern 400 without being affected by the vibration of the carriage 23. This configuration can also be applied to a line-type image forming apparatus including a line-type recording head.

Figure 33:
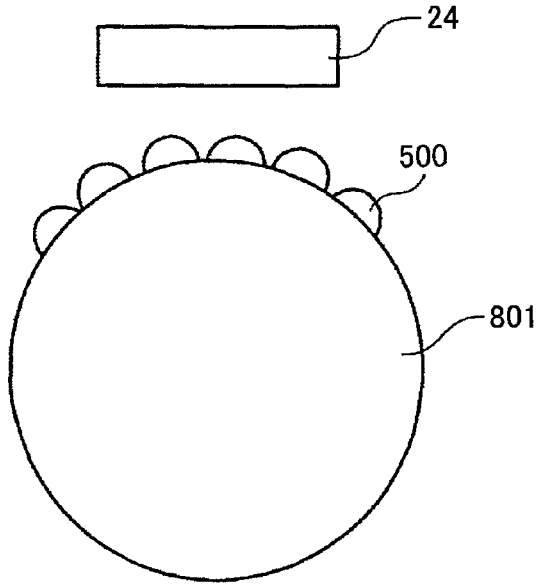
FIG. 33 is a drawing illustrating a third embodiment of the present invention.

A third embodiment of the present invention is described below with reference to FIG. 33.

An image forming apparatus of the third embodiment includes, instead of a conveyor belt, a conveyor roller 801 that conveys a recording medium (or a paper sheet) placed on or wound around it. In the image forming apparatus of the third embodiment, liquid droplets 500 are jetted onto the upper edge of the conveyor roller 801 such that the liquid droplets 500 are positioned at equal distances from the recording heads 24 (to be precise, from the image sensor 401). With this configuration, the proportion of specularly reflected light from areas where the liquid droplets 500 are not present is large, and the proportion of specularly reflected light from areas where the liquid droplets are present is small. Therefore, this configuration also makes it possible to accurately detect landing positions of liquid droplets.

Figure 34:
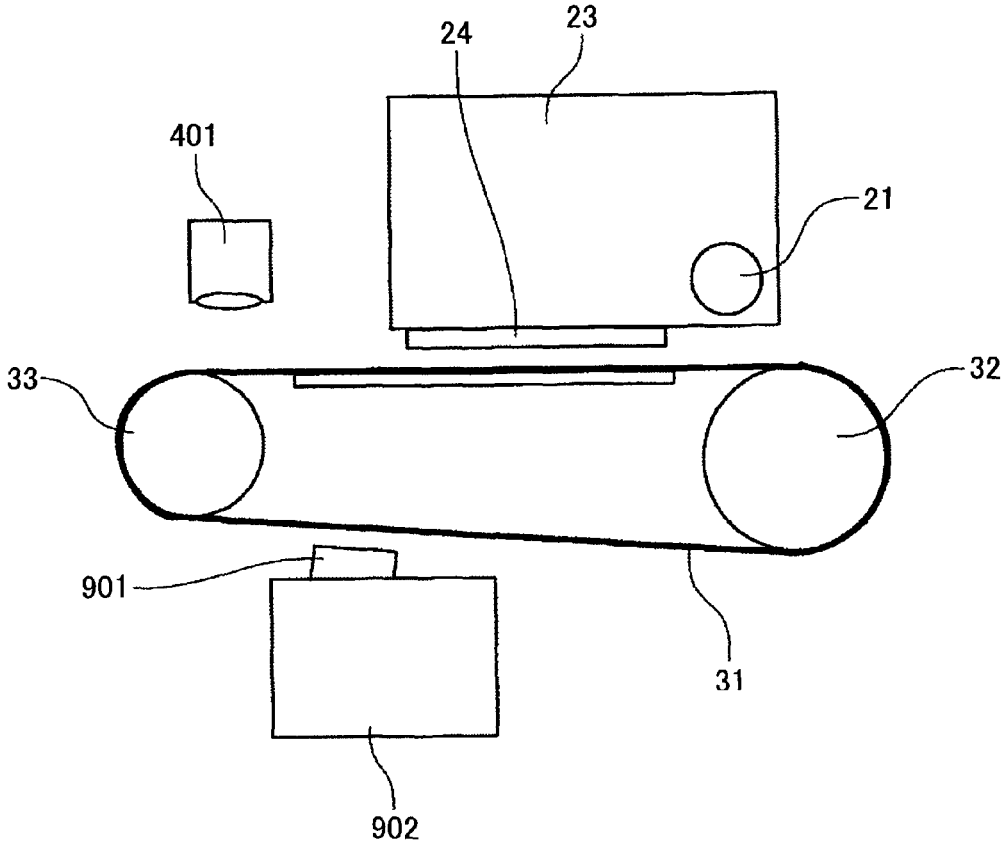
FIG. 34 is a drawing illustrating a fourth embodiment of the present invention.
Figure 35:
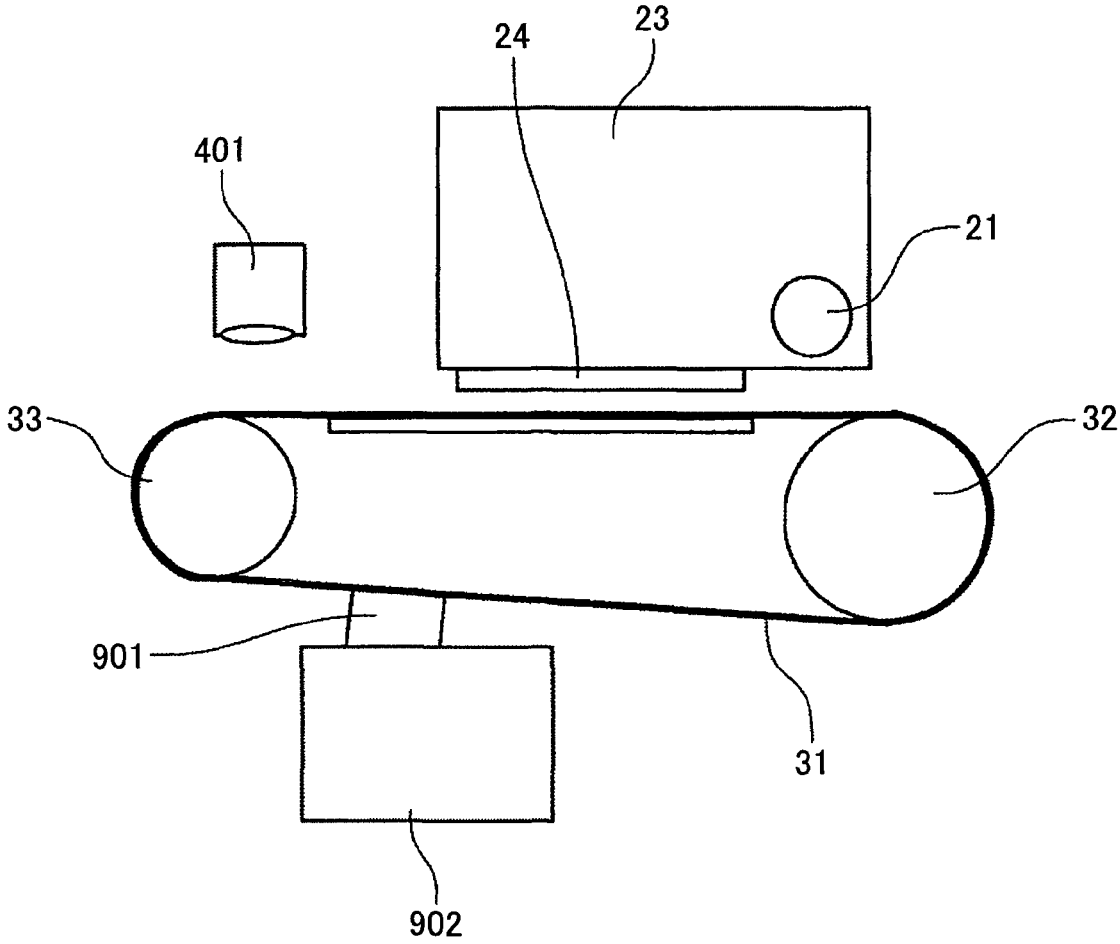
FIG. 35 is another drawing illustrating the fourth embodiment of the present invention.
Figure 36A:
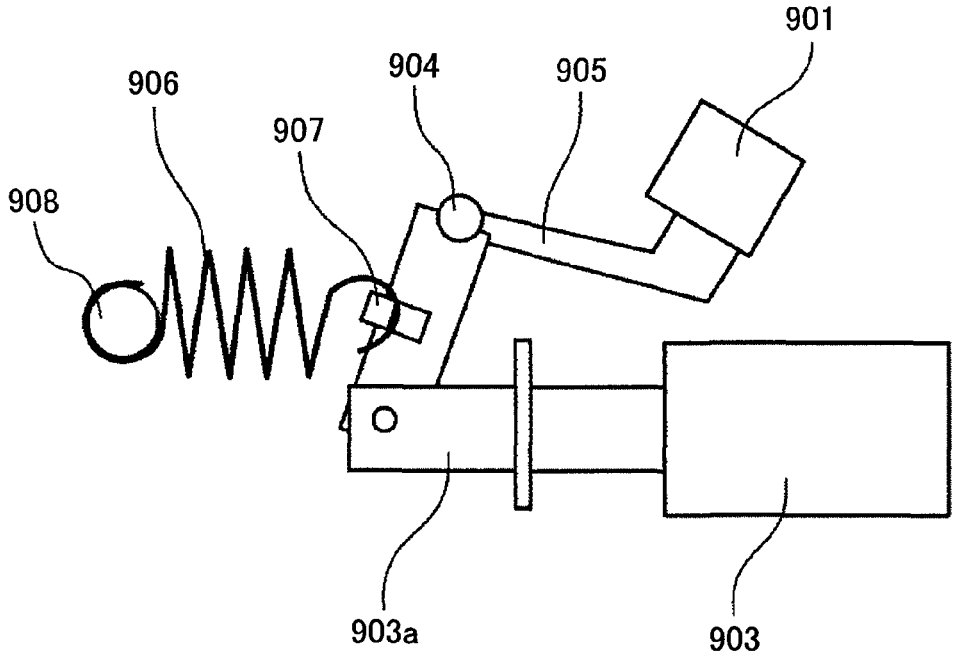
FIGS. 36A and 36B are drawings illustrating a retracting mechanism according to the fourth embodiment.
Figure 36B:
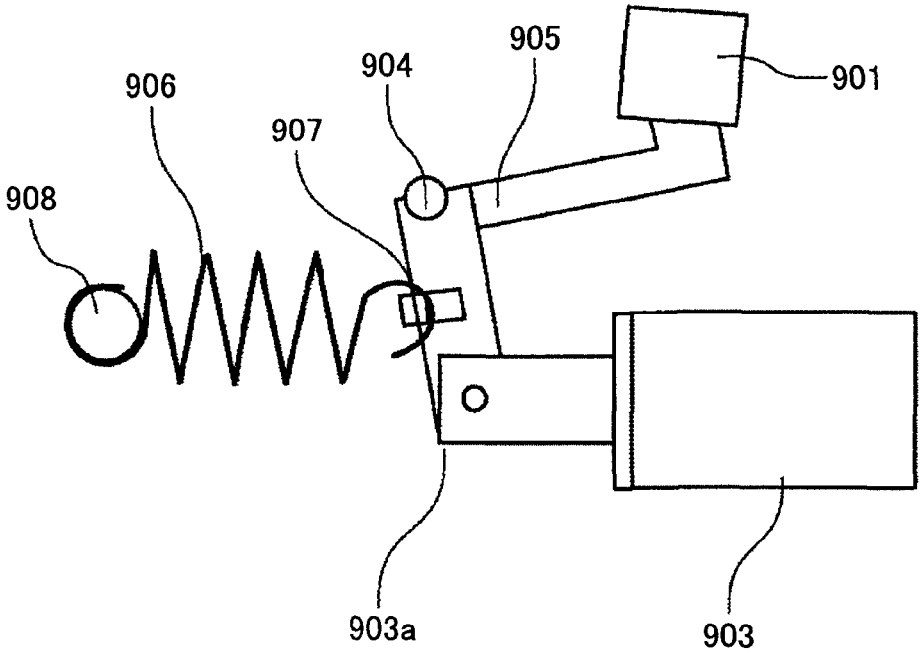
Figure 37:
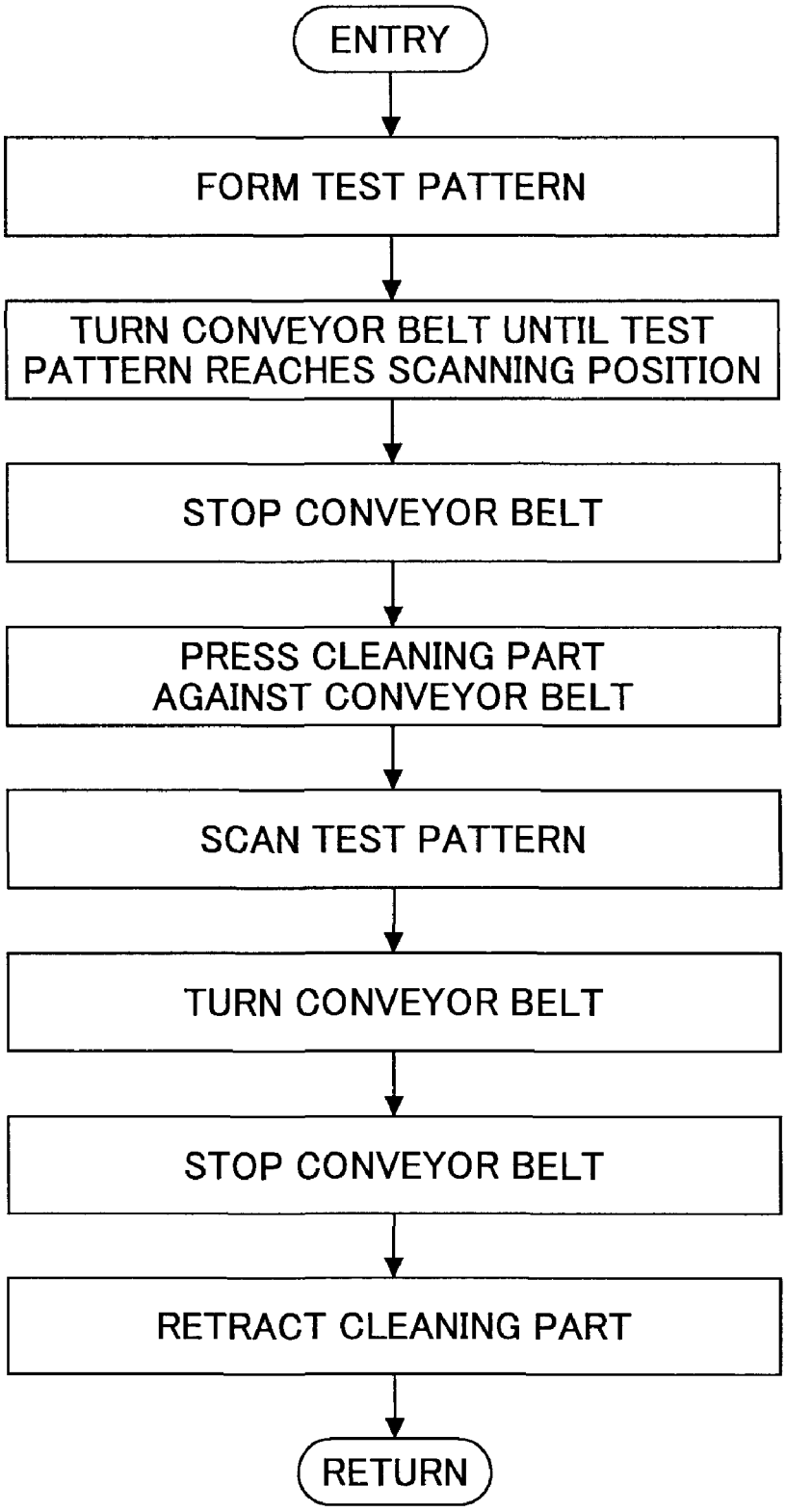
FIG. 37 is a flowchart showing an exemplary process according to the fourth embodiment.

A fourth embodiment of the present invention is described below with reference to FIGS. 34 through 37. FIG. 34 is a drawing illustrating the imaging engine unit 100 of the fourth embodiment. FIG. 35 is another drawing illustrating the imaging engine unit 100 of the fourth embodiment. FIGS. 36A and 36B are drawings illustrating a retracting mechanism according to the fourth embodiment. FIG. 37 is a flowchart showing an exemplary process according to the fourth embodiment.

The imaging engine unit 100 of the fourth embodiment includes a cleaning part (cleaning unit) 901 for removing test patterns from the surface of the conveyor belt 31. The cleaning part 901 is brought into contact with and retracted from the surface of the conveyor belt 31 by a retracting mechanism 902.

As the material of the cleaning part 901, a porous material, such as polyvinyl alcohol (PVA) sponge, that can absorb liquids such as ink is preferably used. As shown in FIGS. 36A and 36B, the retracting mechanism 902 includes a solenoid 903, an arm 905 swingably supported in the middle by a spindle 904, and a tension spring 906. One end of the arm 905 is connected to a plunger 903*a* of the solenoid 903, and the cleaning part 901 is attached to the other end of the arm 905. The tension spring 906 is interposed between a locking part 907 of the arm 905 and an anchor 908. A combination of a motor and a cam may be used instead of the solenoid 903.

When the solenoid 903 is not energized, the plunger 903*a* protrudes as shown in FIG. 36A and causes the cleaning part 901 to be retracted from the surface of the conveyor belt 31 as shown in FIG. 34. When the solenoid 903 is energized, the plunger 903*a* retreats, causes the arm 905 to swing as shown in FIG. 36B, and thereby causes the cleaning part 901 to be pressed against the surface of the conveyor belt 31 as shown in FIG. 35.

As shown in FIG. 37, after the test pattern 400 is formed on the conveyor belt 31, the conveyor belt 31 is turned until the test pattern 400 reaches the scanning position of the image sensor 401. Next, a driving unit (the sub-scanning motor 131) of the conveyor belt 31 is stopped and the cleaning part 901 is pressed against the conveyor belt 31 by driving the retracting mechanism 902. Then, with the cleaning part 901 being pressed against the conveyor belt 31, the test pattern 400 is scanned with the image sensor 401.

After scanning the test pattern 400, the conveyor belt 31 is turned to remove the test pattern 400 with the cleaning part 901. Then, the driving unit of the conveyor belt 31 is stopped, and the cleaning part 901 is retracted from the conveyor belt 31 by driving the retracting mechanism 902.

Thus, the cleaning part 901 cleans the conveyor belt 31 and also holds the conveyor belt 31 when the test pattern 400 is scanned. This configuration prevents a recording medium from being smeared by the test pattern 400 or ink adhering to the conveyor belt 31. Also, this configuration prevents the conveyor belt 31, where the test pattern 400 is formed, from being stained and thereby improves the accuracy of detecting the test pattern 400. Further, this configuration prevents vibration of the conveyor belt 31 when the test pattern 400 is scanned and thereby improves the accuracy of adjusting landing positions of liquid droplets.

Figure 38:
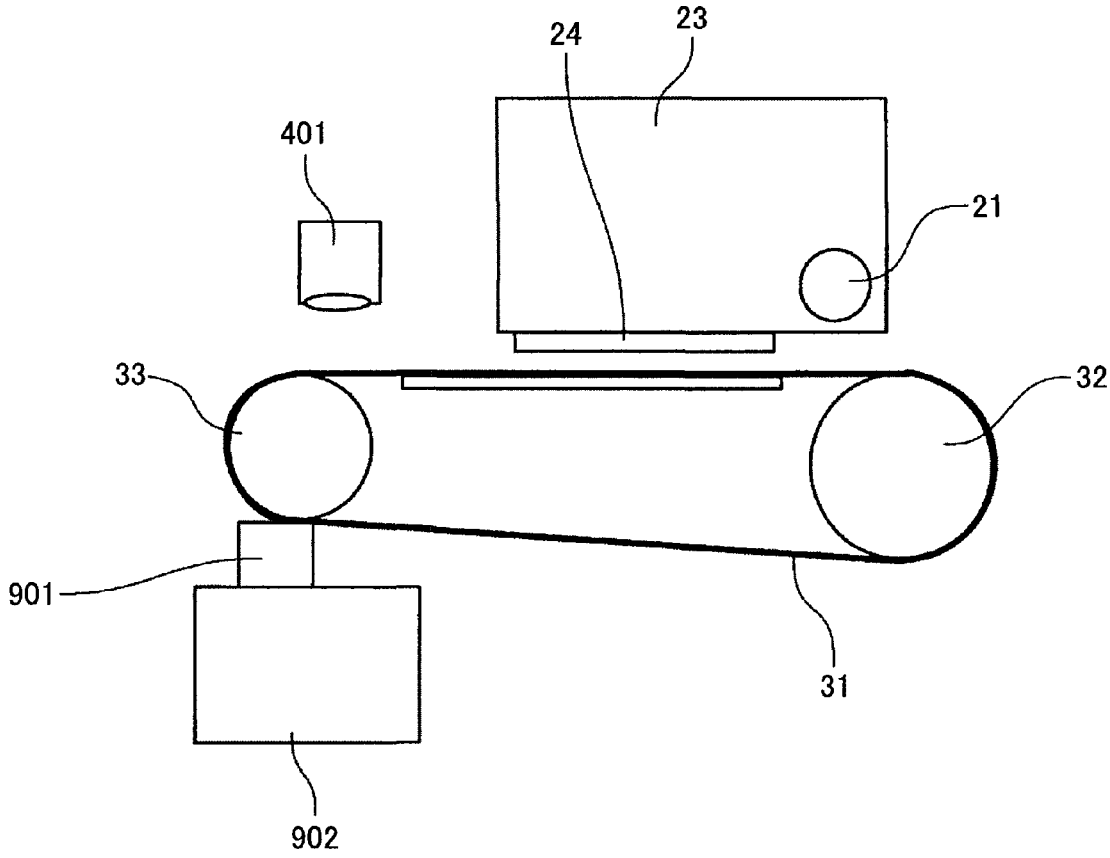
FIG. 38 is a drawing illustrating a fifth embodiment of the present invention.

A fifth embodiment of the present invention is described below with reference to FIG. 38. FIG. 38 is a drawing illustrating the fifth embodiment of the present invention.

In the fifth embodiment, the cleaning part 901 is placed in a position facing the driven roller 33. With this configuration, the conveyor belt 31 is sandwiched between the cleaning part 901 and the driven roller 33, and cannot escape when pressed by the cleaning part 901. Therefore, this configuration makes it possible to firmly press the cleaning part 901 against the conveyor belt 31. As an alternative configuration, the cleaning part 901 may be placed in a position facing the conveying roller (drive roller) 32.

Figure 39:
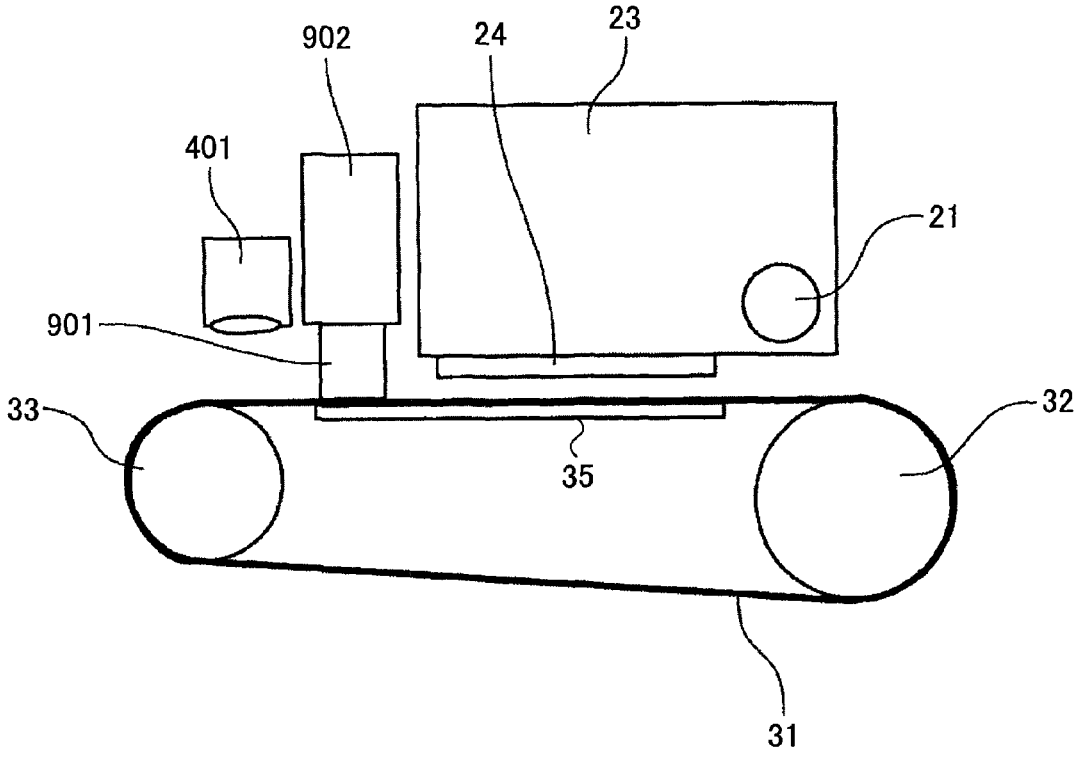
FIG. 39 is a drawing illustrating a sixth embodiment of the present invention.

A sixth embodiment of the present invention is described below with reference to FIG. 39. FIG. 39 is a drawing illustrating the sixth embodiment of the present invention.

In the sixth embodiment, the cleaning part 901 is placed in a position facing the platen guide 35. This configuration provides advantageous effects similar to those of the fifth embodiment.

Figure 40:
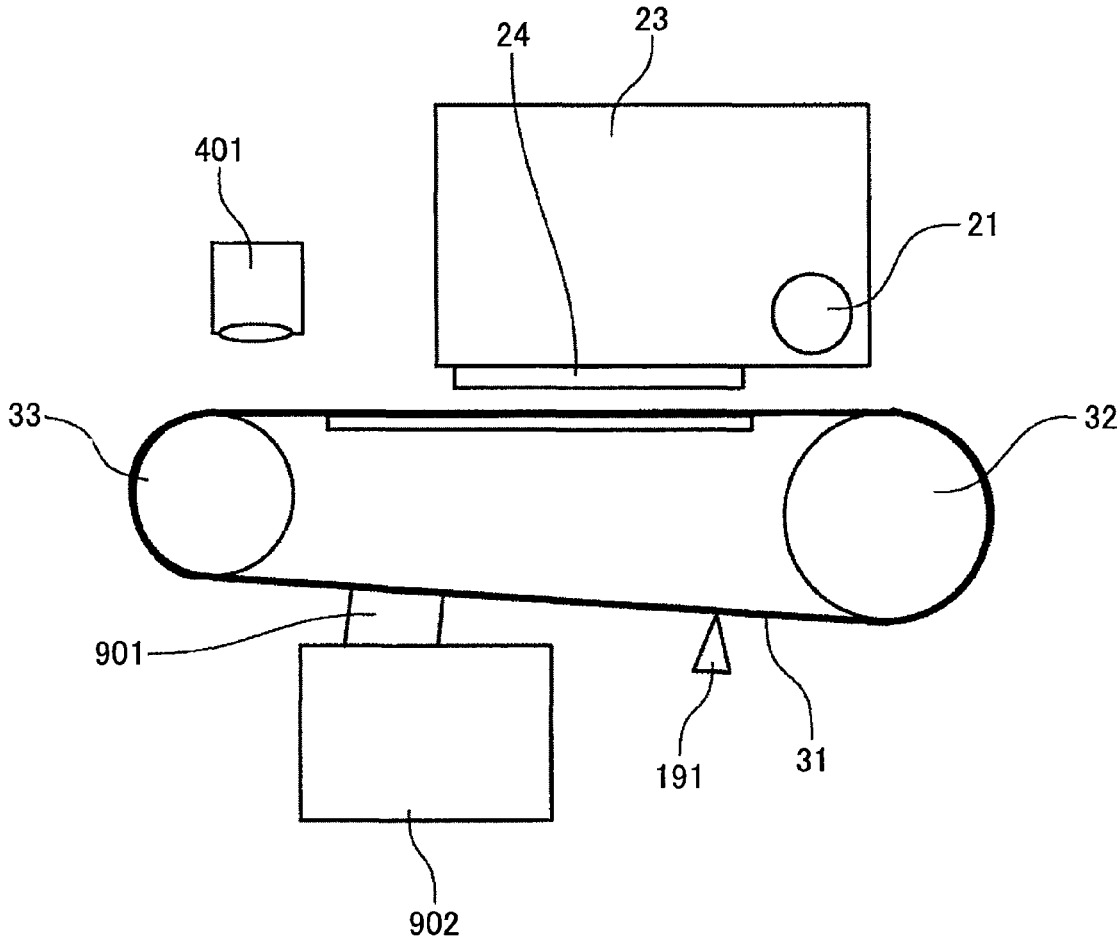
FIG. 40 is a drawing illustrating a seventh embodiment of the present invention.

A seventh embodiment of the present invention is described below with reference to FIG. 40. FIG. 40 is a drawing illustrating the seventh embodiment of the present invention.

In the seventh embodiment, the cleaning part 901 is placed upstream of the paper dust removing part 191. If the paper dust removing part 191 is smeared by the ink of the test pattern 400, its cleaning performance is reduced, and also the smeared paper dust removing part 191, in turn, smears the conveyor belt 31. Placing the cleaning part 901 upstream of the paper dust removing part 191 makes it possible to prevent this problem.

As the conveyor belt 31 in the above embodiments, any conveyor belt that holds paper or a recording medium by stiction, air suction, electrostatic attraction, or their combination may be used.

Figure 41:
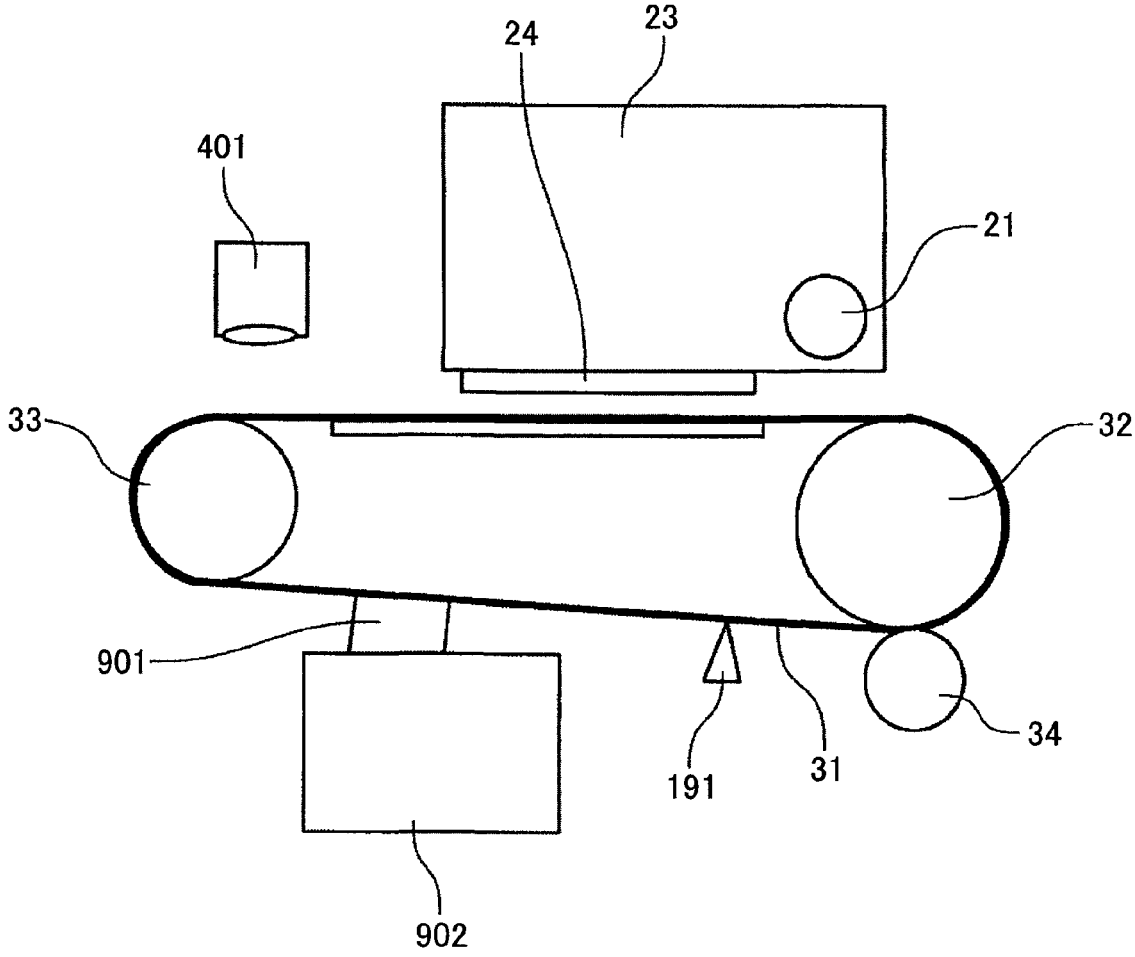
FIG. 41 is a drawing illustrating an eighth embodiment of the present invention.

An eighth embodiment of the present invention is described below with reference to FIG. 41. FIG. 41 is a drawing illustrating the eighth embodiment of the present invention.

In the eighth embodiment, the cleaning part 901 is placed upstream of the charging roller 34 for charging the conveyor belt 31. If the charging roller 34 is smeared by the ink of the test pattern 400, its charging performance is reduced, and also the smeared charging roller 34, in turn, smears the conveyor belt 31. Placing the cleaning part 901 upstream of the charging roller 34 makes it possible to prevent this problem.

Figure 42:
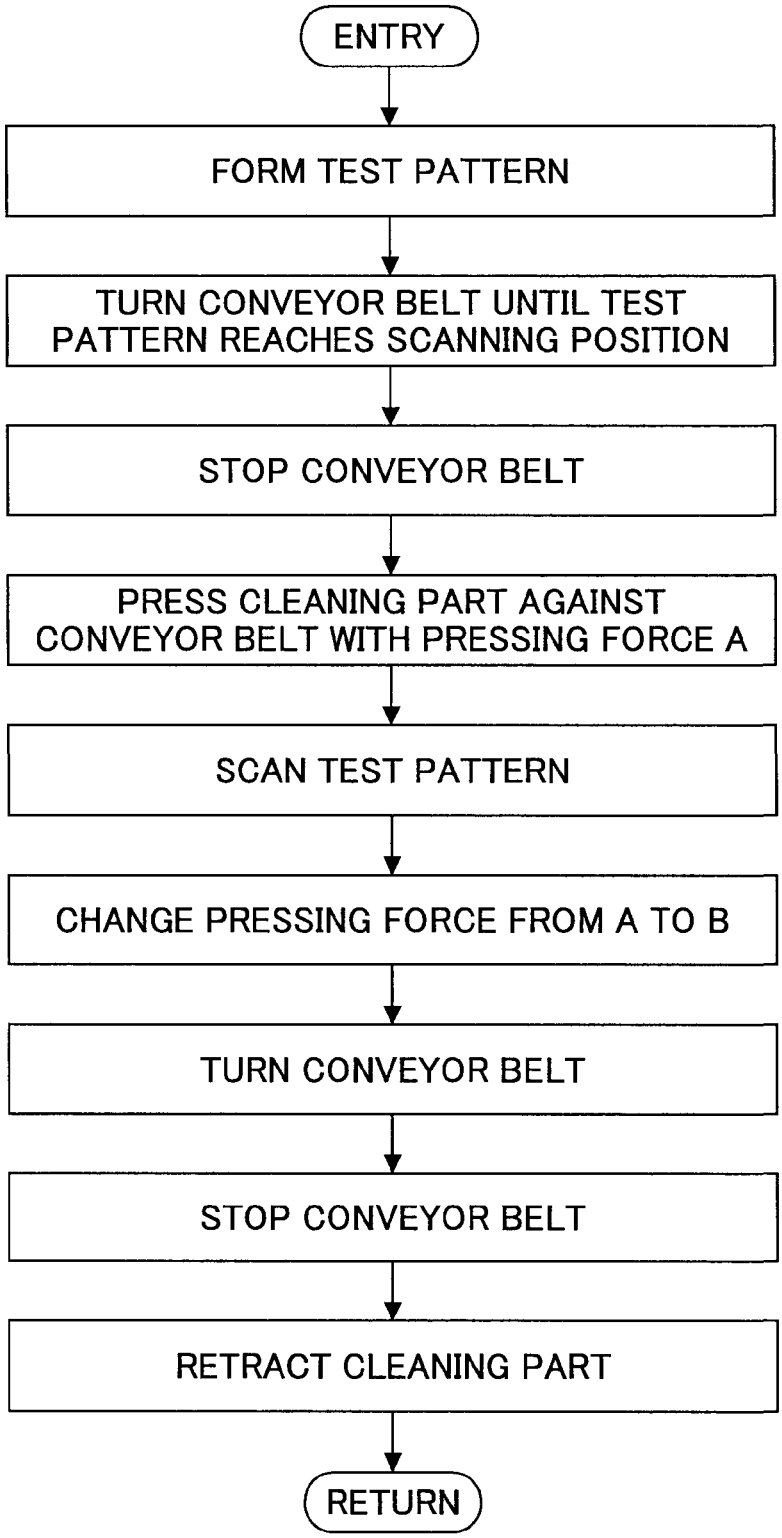
FIG. 42 is a flowchart showing an exemplary process according to a ninth embodiment.

A ninth embodiment of the present invention is described below with reference to FIG. 42. FIG. 42 is a flowchart showing an exemplary process according to the ninth embodiment.

In the ninth embodiment, as shown in FIG. 42, after the test pattern 400 is formed on the conveyor belt 31, the conveyor belt 31 is turned until the test pattern 400 reaches the scanning position of the image sensor 401. Next, the driving unit of the conveyor belt 31 is stopped and the cleaning part 901 is pressed against the conveyor belt 31 with a pressing force A by driving the retracting mechanism 902. Then, with the cleaning part 901 being pressed against the conveyor belt 31, the test pattern 400 is scanned with the image sensor 401.

After scanning the test pattern 400, the pressing force A being applied to the cleaning part 901 is changed to a pressing force B (B<A), and the conveyor belt 31 is turned to remove the test pattern 400 with the cleaning part 901. Then, the driving unit of the conveyor belt 31 is stopped, and the cleaning part 901 is retracted from the conveyor belt 31 by driving the retracting mechanism 902.

When the cleaning part 901 is pressed against the conveyor belt 31 being turned to remove the test pattern 400, the cleaning part 901 may damage the conveyor belt 31. In this embodiment, to reduce the damage, the pressing force A is used to press the cleaning part 901 against the conveyor belt 31 to hold and stabilize the conveyor belt 31 while the test pattern 400 is being scanned, and the pressing force B, which is weaker than the pressing force A and is still sufficient to remove the test pattern 400, is used during cleaning.

The pressing force applied to the cleaning part 901 can be easily changed by varying the electric current supplied to the solenoid 903 of the retracting mechanism 902.

Figure 43:
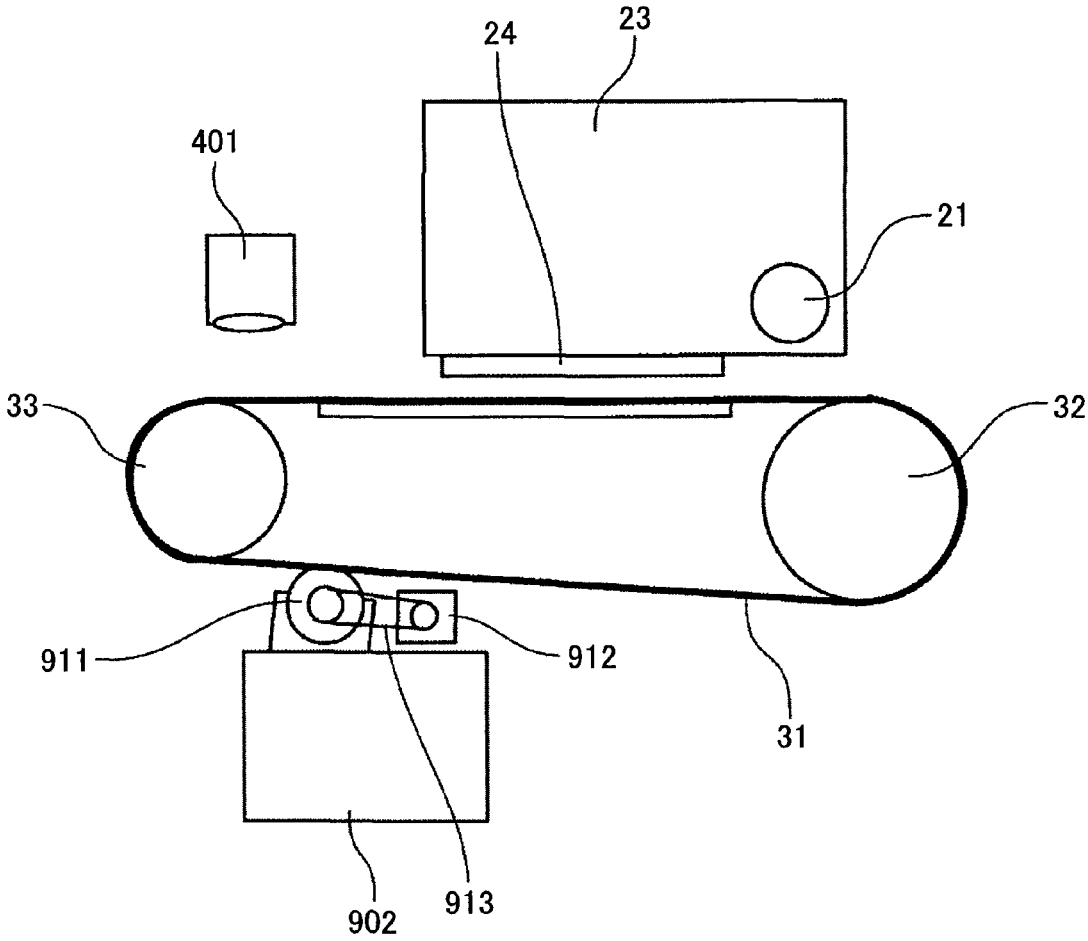
FIG. 43 is a drawing illustrating a tenth embodiment of the present invention.

A tenth embodiment of the present invention is described below with reference to FIG. 43. FIG. 43 is a drawing illustrating the tenth embodiment of the present invention.

The imaging engine unit 100 of the tenth embodiment includes a cleaning roller (cleaning unit) 911 instead of the cleaning part 901 and a motor 912 used as a driving unit for rotating the cleaning roller 911 via a belt 913. The cleaning roller 911 is moved along with the motor 912 by the retracting mechanism 902. As the material of the cleaning roller 911, a porous material, such as PVA sponge, that can absorb liquids such as ink is preferably used.

Figure 44:
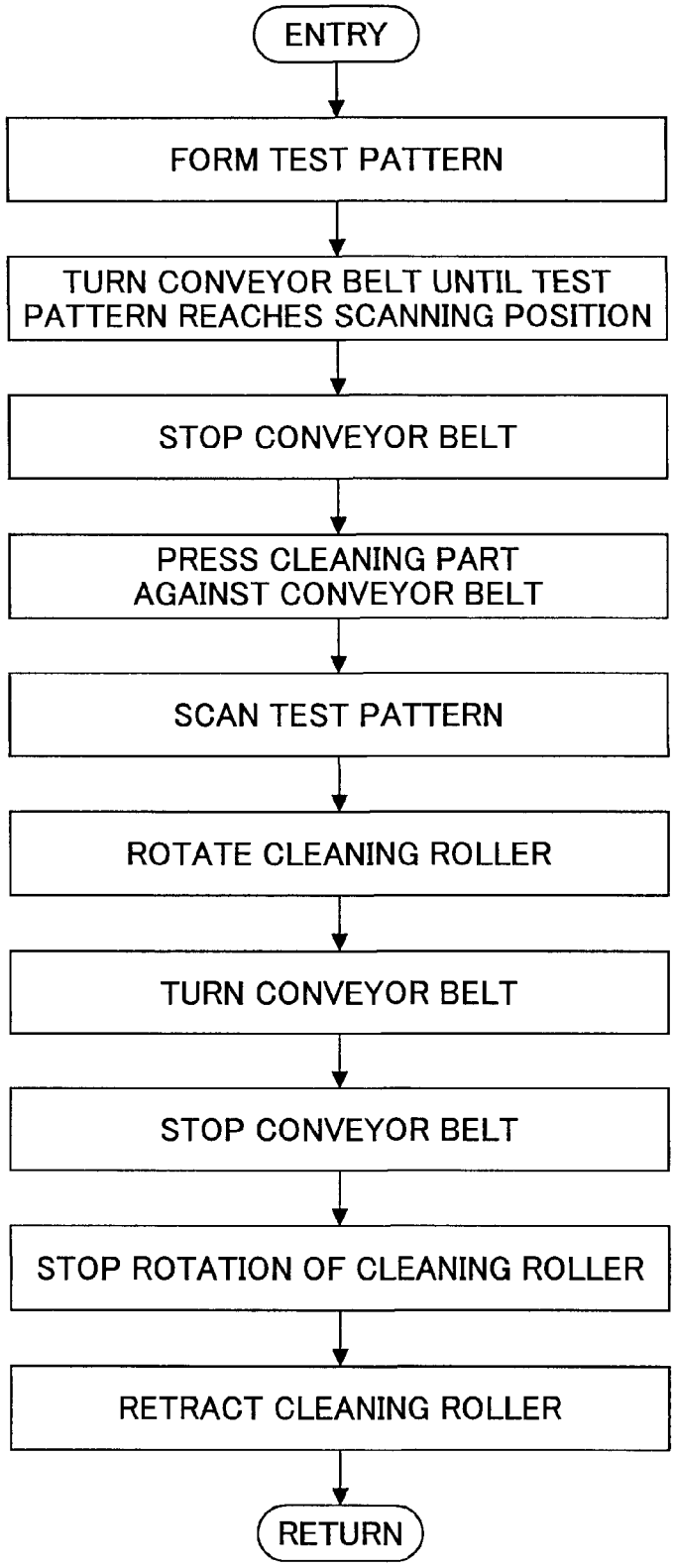
FIG. 44 is a flowchart showing an exemplary process according to the tenth embodiment.

As shown in FIG. 44, after the test pattern 400 is formed on the conveyor belt 31, the conveyor belt 31 is turned until the test pattern 400 reaches the scanning position of the image sensor 401. Next, the driving unit of the conveyor belt 31 is stopped and the cleaning roller 911 is pressed against the conveyor belt 31 by driving the retracting mechanism 902. Then, with the cleaning roller 911 being pressed against the conveyor belt 31, the test pattern 400 is scanned with the image sensor 401.

After scanning the test pattern 400, the cleaning roller 911 is rotated (preferably in a direction opposite to the moving direction of the conveyor belt 31) and the conveyor belt 31 is turned to remove the test pattern 400 with the cleaning roller 911. Then, after stopping the driving unit of the conveyor belt 31 and the rotation of the cleaning roller 911, the cleaning roller 911 is retracted from the conveyor belt 31 by driving the retracting mechanism 902.

Using the cleaning roller 911, which is rotated in a direction opposite to the moving direction of the conveyor belt 31, instead of the cleaning part 901 makes it possible to more efficiently remove the test pattern 400 from the conveyor belt 31. Meanwhile, the cleaning roller 911 is preferably not rotated when it is pressed against the conveyor belt 31 to hold the belt during the step of scanning the test pattern 400. This makes it possible to prevent the cleaning roller 911 from vibrating the conveyor belt 31.

As a driving unit for the cleaning roller 911, a stepping motor is preferably used. When pressing the cleaning roller 911 against the conveyor belt 31 to hold the belt during the step of scanning the test pattern 400, it is preferable to completely stop the rotation of the cleaning roller 911 by exciting the stepping motor.

The cleaning part 901 and the cleaning roller 911 are just examples of a cleaning unit for removing a test pattern from a conveyor belt, and other types of cleaning units may also be used.

Figure 45:
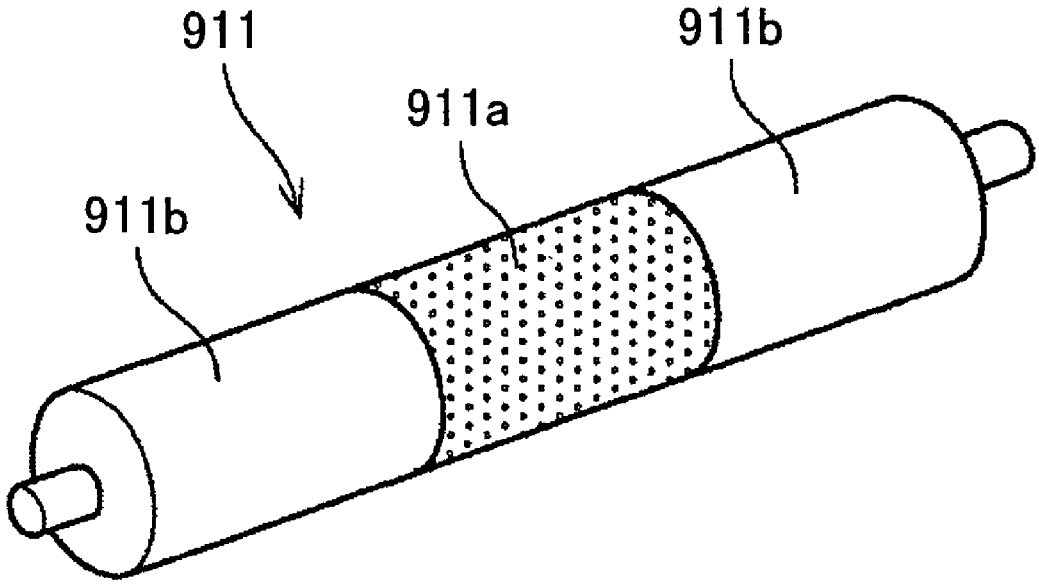
FIG. 45 is a perspective view of a cleaning roller according to an eleventh embodiment of the present invention.

An eleventh embodiment of the present invention is described below with reference to FIG. 45. FIG. 45 is a perspective view of a cleaning roller according to the eleventh embodiment of the present invention.

According to the eleventh embodiment, the cleaning roller 911 described in the tenth embodiment comprises a first roller part 911*a* disposed in the middle of the cleaning roller 911 and made of an ink-absorbent material for removing the test pattern 400, and second roller parts 911*b* disposed at the ends of the cleaning roller 911 and made of a material with a high friction coefficient suitable for holding the conveyor belt 31.

This configuration is suitable for a case where the test pattern 400 is formed substantially in the middle of (not near the edges of) the conveyor belt 31 with respect to the main-scanning direction. In this case, the first roller part 911*a* can efficiently remove the test pattern 400 and the second roller parts 911*b* can effectively hold the conveyor belt 31.

Figure 46:
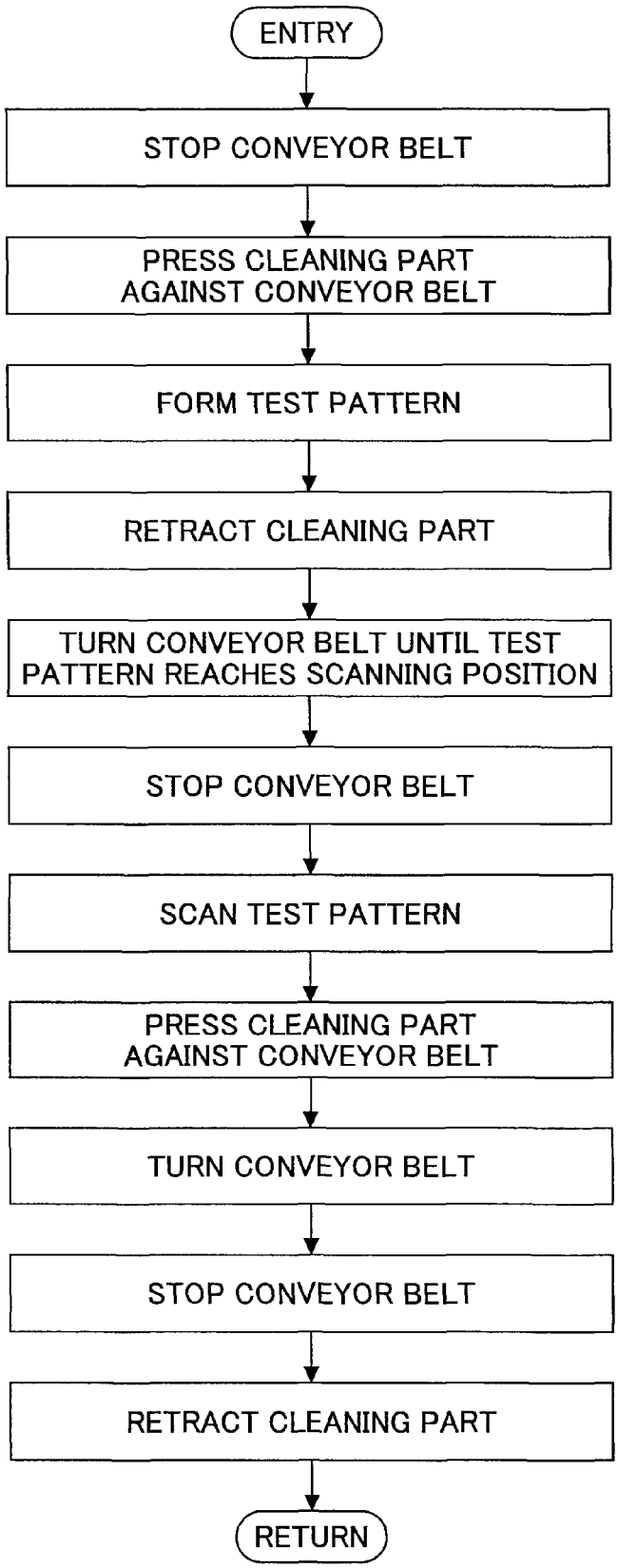
FIG. 46 is a flowchart showing an exemplary process according to a twelfth embodiment of the present invention.

A twelfth embodiment of the present invention is described below with reference to FIG. 46. FIG. 46 is a flowchart showing an exemplary process according to the twelfth embodiment.

In this exemplary process, the conveyor belt 31 is stopped first, and the cleaning part 901 (or the cleaning roller 911) is pressed against the conveyor belt 31 by driving the retracting mechanism 902. Next, the test pattern 400 is formed on the conveyor belt 31, the cleaning part 901 is retracted from the conveyor belt 31 by driving the retracting mechanism 902, the conveyor belt 31 is turned until the test pattern 400 reaches the scanning position of the image sensor 401, the driving unit of the conveyor belt 31 is stopped, and the test pattern 400 is scanned by the image sensor 401.

After scanning the test pattern 400, the cleaning part 901 (or the cleaning roller 911) is pressed against the conveyor belt 31 again by driving the retracting mechanism 902, the conveyor belt 31 is turned to remove the test pattern 400 with the cleaning part 901. Then, the driving unit of the conveyor belt 31 is stopped, and the cleaning part 901 is retracted from the conveyor belt 31 by driving the retracting mechanism 902.

Thus, in this embodiment, the conveyor belt 31 is held by the cleaning part 901 (or the cleaning roller 911) while the test pattern 400 is formed. This configuration reduces vibration of the conveyor belt 31 and thereby makes it possible to accurately form the test pattern 400.

A thirteenth embodiment of the present invention is described below.

If the image scanning unit 11 of the image forming apparatus 200 is operated while a landing position adjusting process is being performed, the vibration of the image scanning unit 11 may cause the conveyor belt 31 to vibrate and thereby influence the result of the landing position adjusting process. In the thirteenth embodiment, to obviate or reduce this problem, the conveyor belt 31 is held and stabilized by the cleaning part 901 (or the cleaning roller 911) if the test pattern 400 is scanned during a scanning process of the image scanning unit 11.

A fourteenth embodiment of the present invention is described below.

In the fourteenth embodiment, the image forming apparatus 200 includes a vibration detecting unit (not shown) for detecting vibration and is configured to hold and stabilize the conveyor belt 31 with the cleaning part 901 (or the cleaning roller 911) when the vibration detected by the vibration detecting unit exceeds a predetermined value. This configuration makes it possible to accurately perform a landing position adjusting process.

Figure 47:
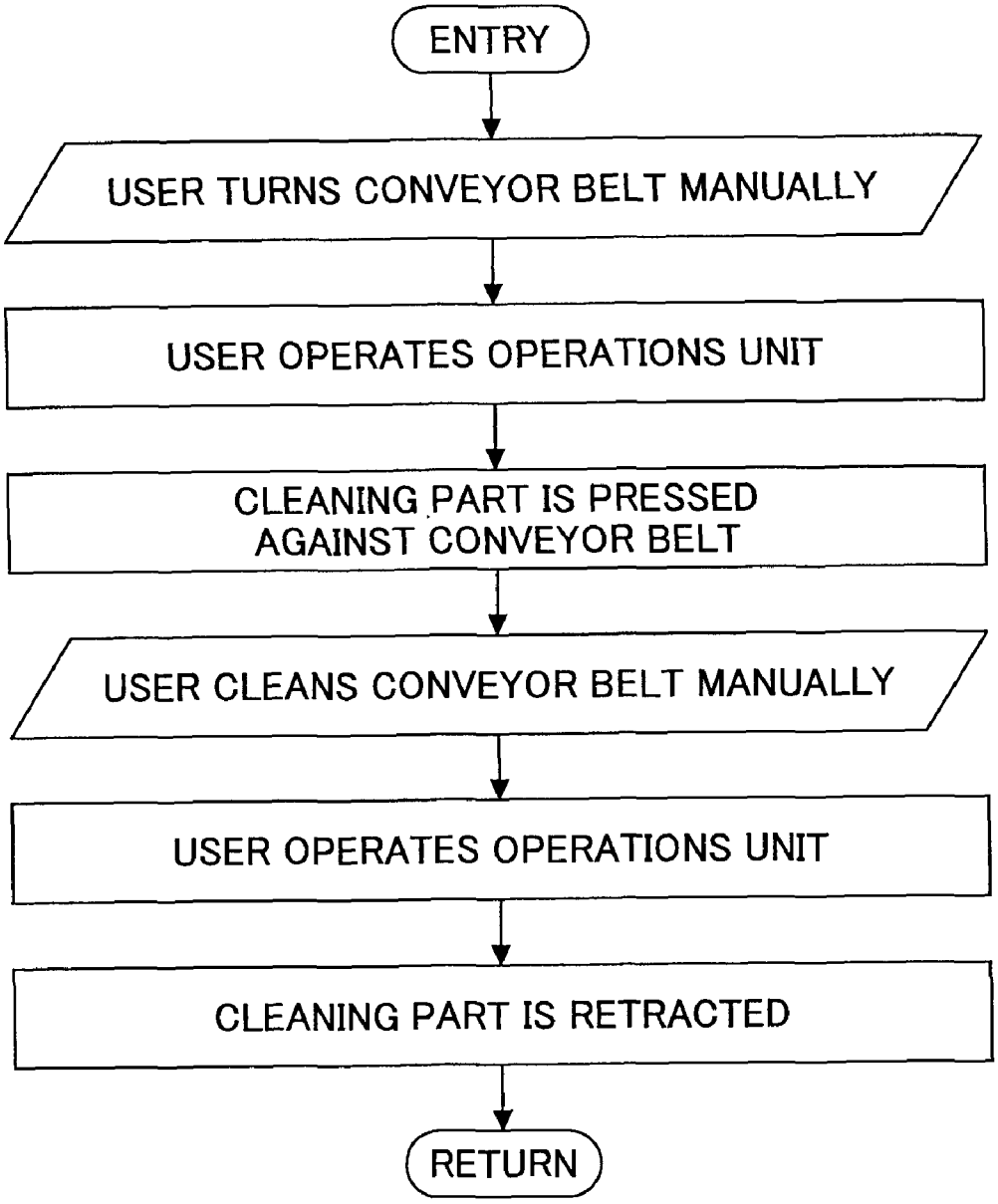
FIG. 47 is a flowchart showing an exemplary process according to a fifteenth embodiment of the present invention.

A fifteenth embodiment of the present invention is described below with reference to FIG. 47. FIG. 47 is a flowchart showing an exemplary process according to the fifteenth embodiment.

In the fifteenth embodiment, the user turns the conveyor belt 31 manually to move a smeared portion of the conveyor belt 31 to a position suitable for cleaning, and operates an operations unit (operations panel) to press the cleaning part 901 (or the cleaning roller 911) against the conveyor belt 31 and thereby to hold the conveyor belt 31. Then, the user cleans the smeared portion of the conveyor belt 31 manually. Holding the conveyor belt 31 by the cleaning part 901 (or the cleaning roller 911) makes it easier for the user to clean the conveyor belt 31. After cleaning the conveyor belt 31, the user operates the operations unit again to retract the cleaning part 901 (or the cleaning roller 911) from the conveyor belt 31.

Figure 48:
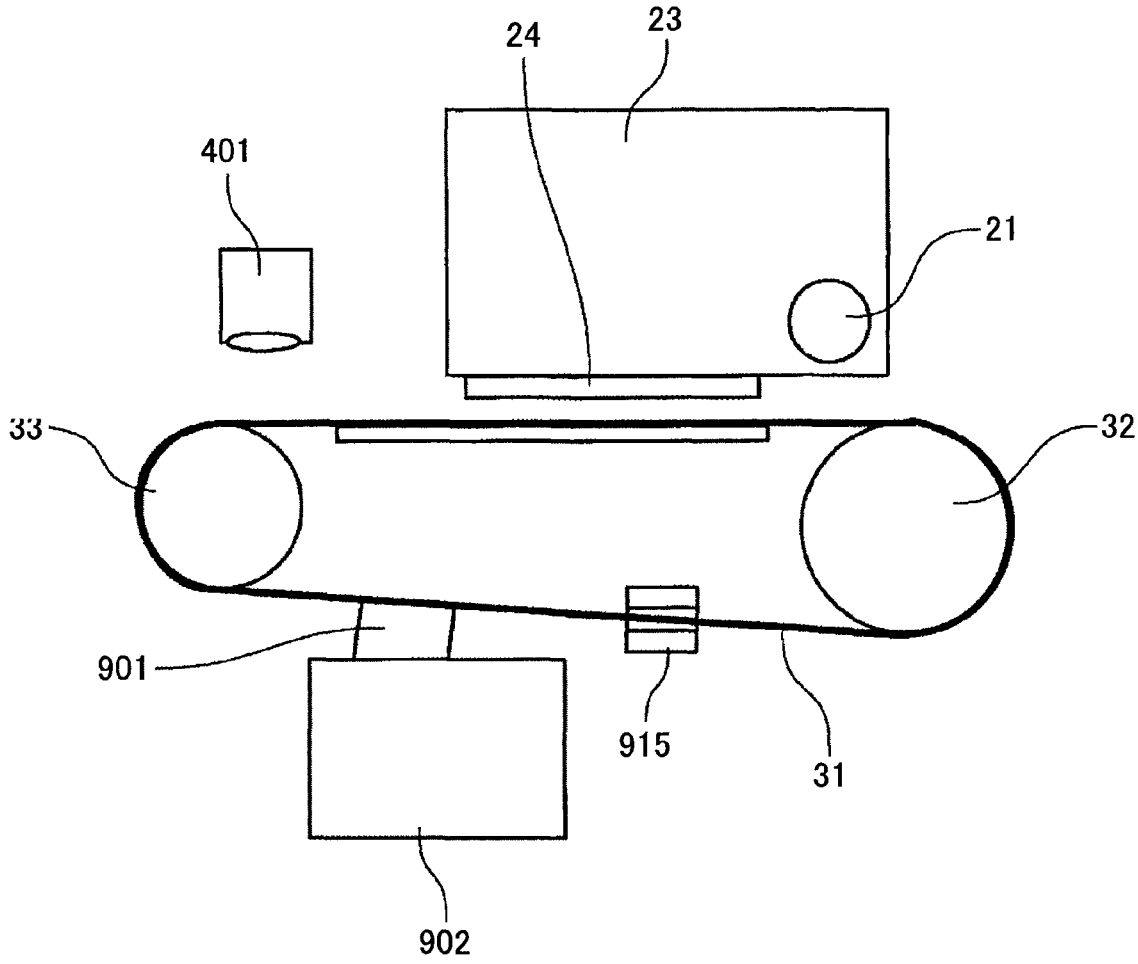
FIG. 48 is a drawing illustrating a sixteenth embodiment of the present invention.
Figure 49:
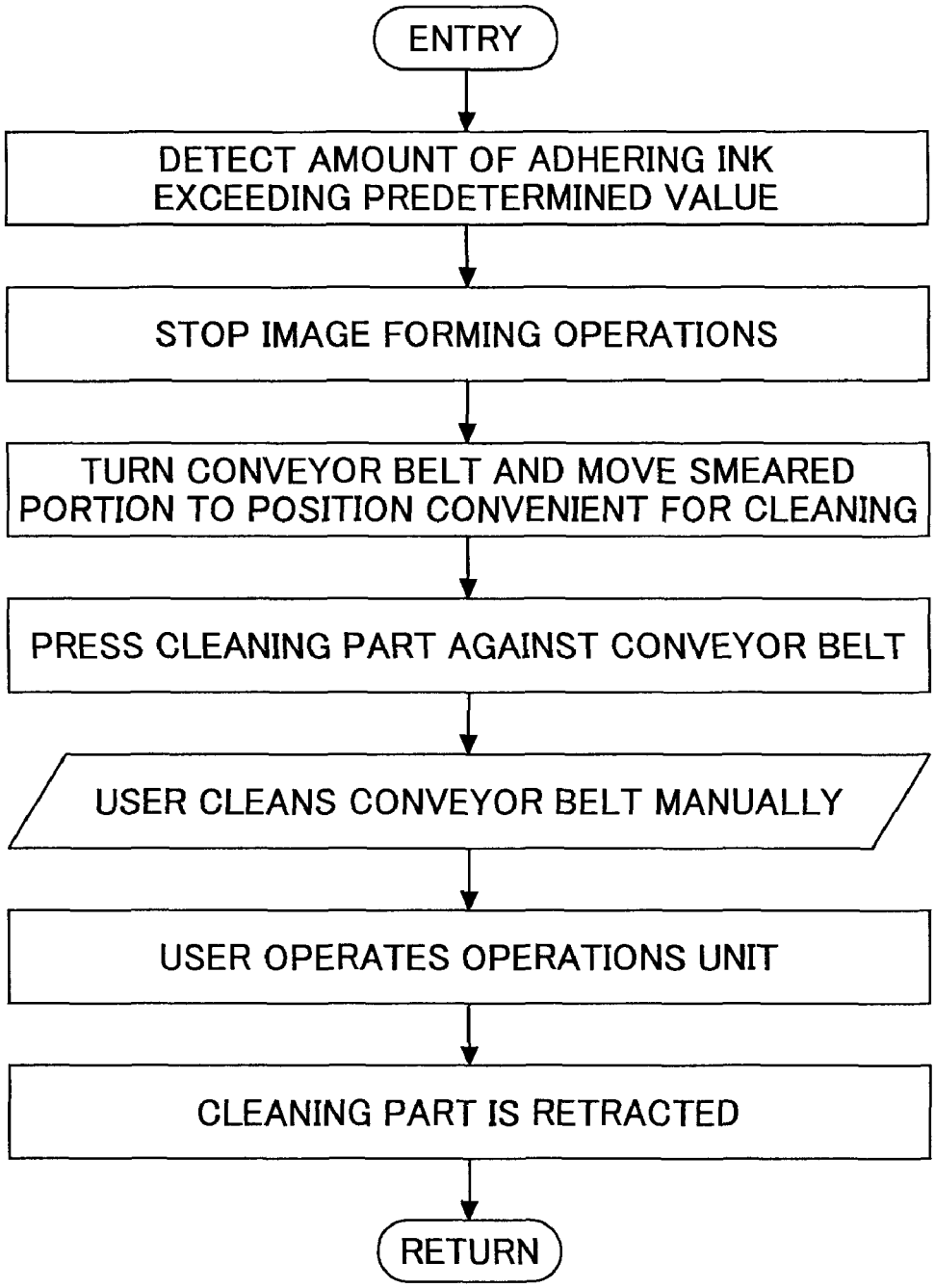
FIG. 49 is a flowchart showing an exemplary process according to the sixteenth embodiment.

A sixteenth embodiment of the present invention is described below with reference to FIGS. 48 and 49. FIG. 48 is a drawing illustrating the sixteenth embodiment of the present invention. FIG. 49 is a flowchart showing an exemplary process according to the sixteenth embodiment.

In the sixteenth embodiment, the imaging engine unit 100 includes a smear detection sensor 915 for detecting a smear on the conveyor belt 31. For example, a laser micrometer may be used as the smear detection sensor 915. The smear detection sensor 915 continuously monitors the thickness of the conveyor belt 31, detects the amount of adhering ink (or liquid) on the conveyor belt 31 based on the increase in thickness of the conveyor belt 31 from the initial value, and outputs a signal if the detected amount of adhering ink exceeds a predetermined value or a level that is difficult to remove with the cleaning part 901 (or the cleaning roller 911).

As shown in FIG. 49, if the detected amount of adhering ink exceeds the predetermined value, the main control unit 310 of the image forming apparatus 200 stops image forming operations and turns the conveyor belt 31 to move its smeared portion to a position convenient for the user or a serviceperson to perform cleaning (e.g., to a position where the smeared portion is exposed when a cover is opened). Then, the main control unit 310 presses the cleaning part 901 (or the cleaning roller 911) against the conveyor belt 31, and the user or the serviceperson cleans the conveyor belt 31 manually. Holding the conveyor belt 31 by the cleaning part 901 (or the cleaning roller 911) makes it easier for the user or the serviceperson to clean the conveyor belt 31. After cleaning the conveyor belt 31, the user operates an operations unit (not shown) to retract the cleaning part 901 (or the cleaning roller 911) from the conveyor belt 31.

Figure 50:
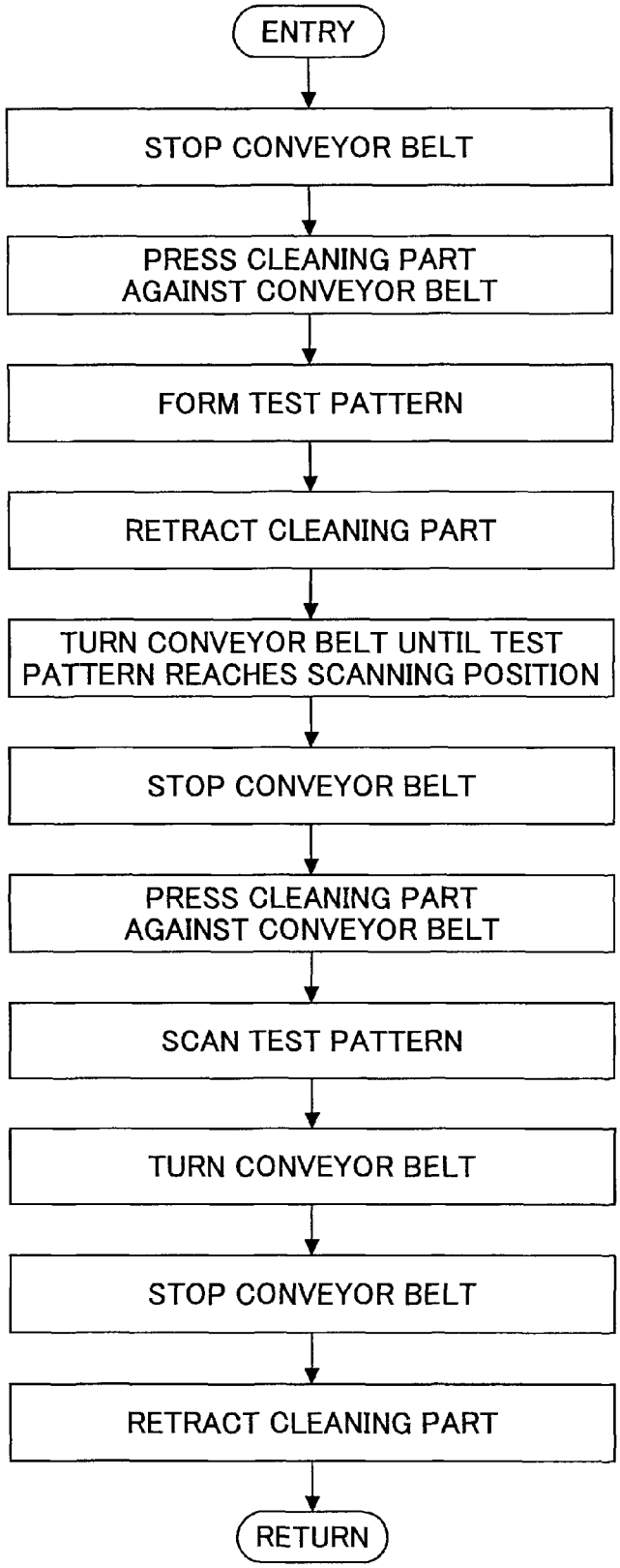
FIG. 50 is a flowchart showing an exemplary process according to a seventeenth embodiment of the present invention.

A seventeenth embodiment of the present invention is described below with reference to FIG. 50. FIG. 50 is a flowchart showing an exemplary process according to the seventeenth embodiment.

In this exemplary process, the conveyor belt 31 is stopped first, and the cleaning part 901 (or the cleaning roller 911) is pressed against the conveyor belt 31 by driving the retracting mechanism 902. Next, the test pattern 400 is formed on the conveyor belt 31, the cleaning part 901 (or the cleaning roller 911) is retracted from the conveyor belt 31 by driving the retracting mechanism 902, the conveyor belt 31 is turned until the test pattern 400 reaches the scanning position of the image sensor 31, the driving unit of the conveyor belt 31 is stopped, and the cleaning part 901 (or the cleaning roller 911) is pressed against the conveyor belt 31 again by driving the retracting mechanism 902. Then, the test pattern 400 is scanned with the image sensor 401.

After scanning the test pattern 400, the conveyor belt 31 is turned to remove the test pattern 400 with the cleaning part 901 (or the cleaning roller 911). Then, the driving unit of the conveyor belt 31 is stopped, and the cleaning part 901 is retracted from the conveyor belt 31 by driving the retracting mechanism 902.

Thus, in this embodiment, the conveyor belt 31 is held by the cleaning part 901 (or the cleaning roller 911) while the test pattern 400 is formed and scanned. This configuration reduces vibration of the conveyor belt 31 and thereby makes it possible to accurately form and scan the test pattern 400.

Thus, embodiments of the present invention make it possible to accurately detect a test pattern composed of liquid droplets and thereby to accurately adjust landing positions of liquid droplets.

Embodiments of the present invention provide a liquid-jet device, an image forming apparatus, and a method for adjusting landing positions of liquid droplets where a test pattern composed of separate liquid droplets are formed on a water-repellent part, the test pattern is detected by illuminating the test pattern and receiving specularly reflected light from the test pattern, and landing positions of liquid droplets are adjusted based on the detection result (scanning result). This configuration makes it possible to accurately detect landing positions of liquid droplets with a simple mechanism and thereby to accurately adjust the landing positions of the liquid droplets.

The present invention is not limited to the specifically disclosed embodiments, and variations and modifications may be made without departing from the scope of the present invention.

The present application is based on Japanese Priority Application No. 2007-069688, filed on Mar. 17, 2007, the entire contents of which are hereby incorporated herein by reference.

What is claimed is:

1. A liquid-jet device, comprising: a liquid-jet configured to jet liquid droplets; a pattern formation control unit configured to control the liquid-jet head and thereby to form a test pattern composed of separate liquid droplets on a water repellent part; a detecting unit including a light emitting element configured to illuminate the test pattern on the water repellent part and a light receiving element configured to receive specularly reflected light form the illuminated test pattern and to output a detection signal proportional to the received specularly reflected light; and a landing position adjusting unit configured to adjust landing positions of the liquid droplets base on the detection signal from the light receiving element, wherein the landing position adjusting unit is configured to obtain a first and second sections of the low-level portion of the detection signal, each of the first and second sections being between an upper threshold value and a lower threshold value, to obtain a first regression line of the first section and a section regression line of the second section, to obtain an intermediate position between the first and second regression lines, and to use the intermediate position as an edge of the test pattern.

2. The liquid-jet device as claimed in claim 1, wherein the pattern formation control unit is configured to form the test pattern in such a manner that in a detection range of the detecting unit, an area of the test pattern not occupied by the liquid droplets is smaller than an area of the test pattern occupied by the liquid droplets.

3. The liquid-jet device as claimed in claim 1, wherein the pattern formation control unit is configured to form the test pattern in such a manner that a proportion of diffusely reflected light in reflected light from the test pattern becomes constant.

4. The liquid-jet device as claimed in claim 1, wherein the pattern formation control unit is configured to form the test pattern in such a manner that the total area of diffuse reflection surfaces of the liquid droplets forming the test pattern becomes constant.

5. The liquid-jet device as claimed in claim 1, wherein the pattern formation control unit is configured to form the test pattern in such a manner that the contact area of the liquid droplets forming the test pattern with the water-repellent part becomes constant.

6. The liquid-jet device as claimed in claim 1, wherein the pattern formation control unit is configured to form the test pattern in at least one of the following manners:

(a) the liquid droplets are regularly arranged in the test pattern;

(b) the liquid droplets are placed in every other dot position in the test pattern; and (c) the liquid droplets are arranged in a staggered manner in the test pattern.

7. The liquid-jet device as claimed in claim 1, wherein a surface of the water-repellent part, onto which surface the liquid droplets are jetted, comprises a fluorine resin.

8. The liquid-jet device as claimed in claim 1, wherein the pattern formation control unit is configured to form the test pattern using the largest liquid droplets that the liquid-jet head can jet.

9. The liquid-jet device as claimed in claim 1, wherein the pattern formation control unit is configured to change the size of the liquid droplets forming the test pattern depending on a color of the liquid droplets.

10. The liquid-jet device as claimed in claim 1, wherein the pattern formation control unit is configured to form the test pattern in such a manner that each of the liquid droplets forming the test pattern is composed of two or more liquid droplets.

11. The liquid jet device as claimed in claim 1, wherein the landing position adjusting unit is configured to detect the test pattern based on a low-level portion of the detection signal from the light-receiving element, the low-level portion indicating that the amount of specularly reflected light is small.

12. The liquid-jet device as claimed in claim 11, wherein the landing position adjusting unit is configured to obtain a center point of the low-level portion by comparing the detection signal with a predetermined threshold value and to use the obtained center point as an edge of the test pattern.

13. The liquid-jet device as claimed in claim 11, wherein the landing position adjusting unit is configured to obtain a centroid of the low-level portion by comparing the detection signal with a predetermined threshold value and to use the obtained centroid as an edge of the test pattern.

14. The liquid jet device as claimed in claim 1, wherein the landing position adjusting unit is configured to obtain the amount of positional deviation of the liquid droplets based on the detection signal and to adjust a timing of jetting the liquid droplets from the liquid-jet head based on the obtained amount of the positional deviation.

15. The liquid-jet device as claimed in claim 1, wherein the landing position adjusting unit determines a positional deviation of the liquid droplets relative to a predetermined reference position, determines an adjustment value, based on the positional deviation, for adjusting a timing of jetting the liquid droplets, and modifies the timing of jetting liquid droplets based on the adjustment value to adjust the landing positions of the liquid droplets.

16. The liquid-jet device as claimed in claim 1, wherein the landing position adjusting unit determines a lower end of a first line segment on a falling edge of the detection signal at a predetermined lower threshold value and an upper end of the first line segment on the falling edge at a predetermined upper threshold value, determines a lower end of a second line segment on a rising edge of the detection signal subsequent to the falling edge at the predetermined lower threshold value and an upper end of the second line segment on the rising edge at the predetermined upper threshold value, determines an intermediate position between the first line segment and the second line segment, and determines a positional deviation of the liquid droplets based on the intermediate position.

17. An image forming apparatus for forming an image or a recording medium, comprising: a water-repellent conveyor belt configured to convey the recording medium; and a liquid-jet device that includes a liquid-jet head configured to jet liquid droplets, a pattern formation control unit configured to control the liquid-jet head and thereby to form a test pattern composed of separate liquid droplets on the conveyor belt, a detecting unit including a light emitting element configured to illuminate the test patter on the convey belt and a light receiving element configured to receive specularly reflected light from the illuminated test patter to out a detection signal proportional received specularly reflected light, and a landing position adjusting unit configured to adjust landing positions of the liquid droplets based on the detection signal from the light receiving element, wherein the landing position adjusting unit is configured to obtain a first and second sections of the low-level portion of the detection signal, each of the first and second sections being between an upper threshold value and a lower threshold value, to obtain a first regression line of the first section and a section regression line of the second section, to obtain an intermediate position between the first and second regression lines, and to use the intermediate position as an edge of the test pattern.

18. The image forming apparatus as claimed in claim 17, further comprising:

a cleaning unit configured to remove the test pattern from the conveyor belt;

wherein the cleaning unit holds the conveyor belt while the detecting unit scans the test pattern.

19. The image forming apparatus as claimed in claim 17, further comprising:

a cleaning unit configured to remove the test pattern from the conveyor belt;

wherein the cleaning unit holds the conveyor belt while the pattern formation control unit forms the test pattern on the conveyor belt.

* * * * *